US006645711B2

(12) United States Patent
Uchida et al.

(10) Patent No.: US 6,645,711 B2
(45) Date of Patent: Nov. 11, 2003

(54) SILVER HALIDE PHOTOGRAPHIC LIGHT-SENSITIVE MATERIAL

(75) Inventors: Osamu Uchida, Minami-ashigara (JP); Toshio Kawagishi, Minami-ashigara (JP); Masaaki Tsukase, Minami-ashigara (JP); Kazuhiko Matsumoto, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/197,488

(22) Filed: Jul. 18, 2002

(65) Prior Publication Data

US 2003/0129551 A1 Jul. 10, 2003

(30) Foreign Application Priority Data

Jul. 18, 2001 (JP) ..... 2001-218229
Jul. 18, 2001 (JP) ..... 2001-218872
Nov. 16, 2001 (JP) ..... 2001-352413

(51) Int. Cl.[7] ..... G03C 1/08; G03C 7/26; G03C 7/32

(52) U.S. Cl. ..... 430/542; 430/435; 430/448; 430/467; 430/470; 430/483; 430/203; 430/226; 430/566

(58) Field of Search ..... 430/542, 448, 430/435, 467, 420, 483, 203, 226, 566

(56) References Cited

U.S. PATENT DOCUMENTS 6,013,420 A * 1/2000 Wingender et al. ..... 430/350
6,372,416 B1 * 4/2002 Morita et al. ..... 430/351
2002/0110763 A1 * 8/2002 Matsumoto et al. ..... 430/350

FOREIGN PATENT DOCUMENTS

EP 1 113 316 A2 7/2001
EP 1 113 322 A2 7/2001
EP 1 113 323 A2 7/2001
EP 1 113 324 A2 7/2001
EP 1 113 325 A2 7/2001
EP 1 113 326 A2 7/2001
JP A-61-34540 2/1986
JP A-2001-312026 11/2001

* cited by examiner

*Primary Examiner*—Geraldine Letscher
(74) *Attorney, Agent, or Firm*—Birch, Stewart, Kolasch & Birch, LLP

(57) ABSTRACT

A silver halide color photographic light-sensitive material containing a compound of the formula:

wherein $R_1$, $R_2$ and $R_3$ each represent a hydrogen atom or a substituent; $R_4$ represents an alkyl, aryl or heterocyclic group; $R_1$ and $R_2$, or/and $R_2$ and $R_4$ may combine with each other to form a 5-membered, 6-membered or 7-membered ring; Z represents a group of non-metallic atoms that form a 5-membered, 6-membered or 7-membered ring together with the nitrogen atom and two carbon atoms in the benzene ring; $R_5$ represents an alkyl, aryl or heterocyclic group, in which the compound of the formula contains none of a hydroxyl group, a carboxyl group and a sulfo group in each of $R_1$, $R_2$, $R_3$ and $R_4$.

15 Claims, No Drawings

SILVER HALIDE PHOTOGRAPHIC LIGHT-SENSITIVE MATERIAL

FIELD OF THE INVENTION

The present invention relates to a silver halide color photographic light-sensitive material, and more particularly to an incorporated color-developing agent that enables simply and quickly obtaining a dye image by heat development.

BACKGROUND OF THE INVENTION

Heretofore, processes for forming an image by heat development are described in, for example, U.S. Pat. Nos. 3,152,904 and 3,457,075, by D. Klosterboer in "Thermally Processed Silver Systems" (Imaging Processes and Materials, Neblette, 8th edition, edited by J. Sturge, V. Walworth, and A. Shepp, Chapter 9, page 279, 1989). These heat-developable light-sensitive materials contain a reducible non-photosensitive silver source (e.g., an organosilver salt), a catalytically active amount of a photocatalyst (e.g., a silver halide), and a reducing agent for silver, which are ordinarily in a state of dispersion in an organic binder matrix. The light-sensitive materials are stable at normal temperature, but when heated to a high temperature (e.g., 80° C. or above) after exposure to light, silver is formed through an oxidation-reduction reaction between the reducible silver source (acting as an oxidizing agent) and the reducing agent. This oxidation-reduction reaction is accelerated by a catalytic action of the latent image formed by the exposure to light. The silver produced by the reaction of the reducible silver salt in the exposed area becomes black in contrast with the non-exposed area, thereby to form an image.

On the other hand, the method utilizing a coupling reaction between a coupler and an oxidized product of a developing agent is most common, as a color-image-forming method of a photographic light-sensitive material. The heat-developable light-sensitive materials adopting this method are disclosed in U.S. Pat. Nos. 3,761,270 and 4,021,240, JP-A-59-231539 ("JP-A" means unexamined published Japanese patent application) and JP-A-60-128438. In these publications, p-sulfonamidophenols are used as developing agents. Since the coupler before the processing has no absorption in a visible region, the light-sensitive materials according to the coupling method are advantageous in terms of sensitivity, compared with a light-sensitive material that employs a color material containing a conventional dye. Accordingly, such light-sensitive materials are thought to have the advantage that, beyond use for print materials, they can also be used as photographic materials for shooting. However, in the method of incorporating p-sulfonamidophenol, there has been a problem that any proper image could not be obtained due to deterioration of p-sulfonamidophenol in the light-sensitive material prior to processing.

As methods of solving this problem, the heat developable photosensitive materials having incorporated therein blocked p-phenylenediamine-series developing agents and processing methods therefor have been proposed by EP 1,113,316 A2, EP 1,113,322 A2, EP 1,113,323 A2, EP 1,113,324 A2, EP 1,113,325 A2, and EP 1,113,326 A2. However, these heat developable photosensitive materials do not always have proper characteristics about their image formation temperatures, color formation efficiencies, photographic sensitivities, anti-fog properties, and the like.

SUMMARY OF THE INVENTION

The present invention is a silver halide color photographic light-sensitive material, which contains a color-developing agent represented by formula (1):

formula (1)

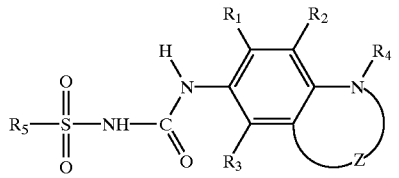

wherein $R_1$, $R_2$, and $R_3$ each independently represent a hydrogen atom or a substituent; $R_4$ represents an alkyl group, an aryl group, or a heterocyclic group; $R_1$ and $R_2$, or/and $R_2$ and $R_4$ may combine with each other to form a 5-membered, 6-membered or 7-membered ring; Z represents a group of non-metallic atoms that form a 5-membered, 6-membered or 7-membered ring together with the nitrogen atom and two carbon atoms in the benzene ring; $R_5$ represents an alkyl group, an aryl group or a heterocyclic group, in which the compound represented by formula (1) contains none of a hydroxyl group, a carboxyl group and a sulfo group in each of $R_1$, $R_2$, $R_3$ and $R_4$.

Other and further features and advantages of the invention will appear more fully from the following description.

DETAILED DESCRIPTION OF THE INVENTION

According to the present invention, there is provided the following means:

(1) A silver halide color photosensitive material, which contains a color-developing agent represented by the following formula (1):

formula (1)

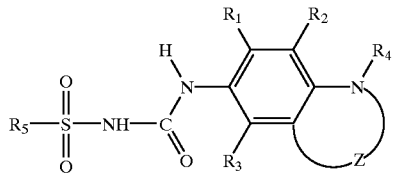

wherein $R_1$, $R_2$, and $R_3$ each independently represent a hydrogen atom or a substituent; $R_4$ represents an alkyl group, an aryl group, or a heterocyclic group; $R_1$ and $R_2$, or/and $R_2$ and $R_4$ may combine with each other to form a 5-membered, 6-membered or 7-membered ring; Z represents a group of non-metallic atoms that form a 5-membered, 6-membered or 7-membered ring together with the nitrogen atom and two carbon atoms in the benzene ring; and $R_5$ represents an alkyl group, an aryl group or a heterocyclic group, in which the compound represented by formula (1) contains none of a hydroxyl group, a carboxyl group and a sulfo group in each of $R_1$, $R_2$, $R_3$, and $R_4$.

(2) The silver halide color photosensitive material according to the above item (1), wherein $R_5$ in the compound represented by formula (1) is represented by the following formula (2):

formula (2)

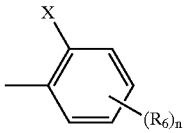

wherein X represents a halogen atom, or a substituent which is bonded to the benzene ring through a hetero atom; $R_6$ represents a substituent; and n is an integer of 0 (zero) to 4.

(3) The silver halide color photosensitive material according to the above item (1), wherein a compound obtained by replacing $R_5$—$SO_2$—NH—CO— in the compound represented by formula (1) by a hydrogen atom has a ClogP value of 3.0 or more.

Herein, the numerical ranges as used herein each are meant to include the starting and ending values as a minimum and a maximum, respectively, unless otherwise specified.

[I] Heat-developable Photosensitive Material

A preferred embodiment of the silver halide color photosensitive material of the present invention is a heat-developable photosensitive material. The heat development photosensitive material has, on a support, a layer (image-forming layer) that contains the color developing agent for use in the present invention, a coupler, an organic silver salt as a reducible silver salt, and a binder, and that forms an image by a dye generated from the color developing agent for use in the present invention and the coupler, and the material has, on the side of the image forming layer, a photosensitive silver halide emulsion layer (photosensitive layer) containing a photosensitive silver halide. Preferably, the image-forming layer is the photosensitive layer. By incorporating a compound represented by the formula (1) and a coupler compound into the side of the image-forming layer, a dye image can be obtained.

According to the heat-developable photosensitive material of the present invention, in which the compound of the formula (1) is contained, a dye image can be preferably obtained, by providing at least three photosensitive silver halide emulsion layers (photosensitive layers) which are different from each other in their photosensitive wavelength ranges and/or absorption wavelength ranges of dyes formed from the oxidized color-developing agents represented by the formula (1) and the couplers.

The compound represented by formula (1), which the heat-developable photosensitive material of the present invention contains, is a compound which hardly has an absorption wavelength in a visible wavelength range. However, when the photosensitive material is subjected to heat-development, the compound releases a reducing agent to contribute to the formation of a silver image. At this time, an oxidized product of the released reducing agent (hereinafter, also referred to as an oxidized product of the color-developing agent) is produced. When the oxidized product reacts with a coupler compound, a dye is produced, to give an image-wise dye image in accordance with the silver image. In the present invention, the dye-donating coupler and the compound represented by formula (1) may be contained in a photosensitive layer, or may be separately added to different layers if they are in the reactive condition.

(A) Color-developing Agent

A compound represented by the formula (1) according to the present invention will be described in detail.

In formula (1), $R_1$, $R_2$ and $R_3$ each represent a hydrogen atom or a substituent, independently. Examples of substituents represented by $R_1$, $R_2$, and $R_3$ include a halogen atom, an alkyl group (including a cycloalkyl group, a bicycloalkyl group, and the like), an alkenyl group (including a cycloalkenyl group, a bicycloalkenyl group, and the like), an alkynyl group, an aryl group, a heterocyclic group, a cyano group, a nitro group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoyl amino group, an alkyl- or aryl-sulfonylamino group, a mercapto group, an alkylthio group, an arylthio group, a heterocyclic thio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, and a silyl group.

In more detail, examples of substituents represented by $R_1$, $R_2$, and $R_3$ include a halogen atom (e.g., a chlorine atom, a bromine atom, and an iodine atom); an alkyl group [which represents a straight-chain, branched-chain or cyclic and substituted or unsubstituted alkyl group, such as an alkyl group (preferably an alkyl group having 1 to 30 carbon atoms, e.g., a methyl group, an ethyl group, a n-propyl group, an isopropyl group, a t-butyl group, a n-octyl group, an eicosyl group, a 2-chloroethyl group, a 2-cyanoethyl group, a 2-ethylhexyl group), a cycloalkyl group (preferably a substituted or unsubstituted cycloalkyl group having 3 to 30 carbon atoms, e.g., a cyclohexyl group, a cyclopentyl group, a 4-n-dodecyl cyclohexyl group), a bicycloalkyl group (preferably a substituted or unsubstituted bicycloalkyl group having 5 to 30 carbon atoms, that is, a monovalent group obtained by removing one hydrogen atom from a bicycloalkane having 5 to 30 carbon atoms, e.g., a bicyclo[1,2,2]heptane-2-yl group, a bicyclo[2,2,2]octane-3-yl group); and the alkyl group includes a tricycloalkyl group and the like, which group has a larger number of rings; and alkyl groups included as a part of substituents which will be described later (e.g., an alkyl group of an alkylthio group) have the same meaning as described herein]; an alkenyl group [which represents a straight-chain, branched-chain or cyclic and substituted or unsubstituted alkenyl group, such as an alkenyl group (preferably a substituted or unsubstituted alkenyl group having 2 to 30 carbon atoms; e.g., a vinyl group, an allyl group, a prenyl group, a geranyl group, an oleyl group), a cycloalkenyl group (preferably a substituted or unsubstituted cycloalkenyl group having 3 to 30 carbon atoms, that is, a monovalent group obtained by removing one hydrogen atom from a cycloalkene having 3 to 30 carbon atoms; e.g., a 2-cyclopentene-1-yl group, a 2-cyclohexene-1-yl group), a bicycloalkenyl group (a substituted or unsubstituted bicycloalkenyl group, preferably a substituted or unsubstituted bicycloalkenyl group having 5 to 30 carbon atoms, that is, a monovalent group obtained by removing one hydrogen atom from a bicycloalkene having one double bond; e.g., a bicyclo[2,2,1]hepto-2-ene-1-yl group, a bicyclo[2,2,2]octo-2-ene-4-yl group); and the alkenyl group includes a tricycloalkenyl group and the like, which group has a larger number of rings]; an alkynyl group (preferably a substituted or unsubstituted alkynyl group having 2 to 30 carbon atoms; e.g., an ethynyl group, a propargyl group, a trimethylsilylethynyl group); an aryl group (preferably a substituted or unsubstituted aryl group having 6 to 30 carbon atoms; e.g., a phenyl group, a p-tolyl group, a naphthyl group, a m-chlorophenyl group, a o-hexadecanoylaminophenyl group); a heterocyclic group (preferably a monovalent group obtained by removing one hydrogen atom from a substituted or unsubstituted and aromatic or non-aromatic 5- or 6-membered heterocyclic group, more preferably a 5- or 6-membered aromatic heterocyclic group having 3 to 30 carbon atoms; e.g., a 2-furyl group, a 2-thienyl group, a 2-pyrimidinyl group, a 2-benzothiazolyl group); a cyano group; a nitro group; an alkoxy group (preferably a substituted or unsubstituted alkoxy group having 1 to 30 carbon atoms; e.g., a methoxy group, an ethoxy group, an isopropoxy group, a t-butoxy group, a n-octyloxy group, a 2-methoxyethoxy group); an aryloxy group (preferably a substituted or unsubstituted aryloxy group having 6 to 30 carbon atoms; e.g., a phenoxy group, a 2-methylphenoxy group, a 4-t-buthylphenoxy group, a 3-nitrophenoxy group, a 2-tetradecanoylaminophenoxy group); a silyloxy group (preferably a silyloxy group having 3 to 20 carbon atoms; e.g., a trimethylsilyloxy group, a t-butyldimethylsilyloxy group); a heterocyclic oxy group (preferably a substituted or unsubstituted heterocyclic oxy group having 2 to 30 carbon atoms; e.g., a 1-phenyltetrazole-5-oxy group, a 2-tetrahydropyranyloxy group); an acyloxy group (preferably a formyloxy group, a substituted or unsubstituted alkylcarbonyloxy group having 2 to 30 carbon atoms, and a substituted or unsubstituted arylcarbonyloxy group having 6 to 30 carbon atoms; e.g., a formyloxy group, an acetyloxy group, a pivaloyloxy group, a stealoyloxy group, a benzoyloxy group, a p-methoxyphenylcarbonyloxy group); a carbamoyloxy group (preferably a substituted or unsubstituted carbamoyloxy group having 1 to 30 carbon atoms; e.g., a N,N-dimethylcarbamoyloxy group, a N,N-diethylcarbamoyloxy group, a morpholinocarbonyloxy group, a N,N-di-n-octylaminocarbonyloxy group, a N-n-octylcarbamoyloxy group); an alkoxycarbonyloxy group (preferably a substituted or unsubstituted alkoxycarbonyloxy group having 2 to 30 carbon atoms; e.g., a methoxycarbonyloxy group, an ethoxycarbonyloxy group, a t-butoxycarbonyloxy group, and a n-octylcarbonyloxy group); an aryloxycarbonyloxy group (preferably a substituted or unsubstituted aryloxycarbonyloxy group having 7 to 30 carbon atoms; e.g., a phenoxycarbonyloxy group, a p-methoxyphenoxycarbonyloxy group, a p-n-hexadecyloxyphenoxycarbonyloxy group); an amino group (preferably an amino group, a substituted or unsubstituted alkylamino group having 1 to 30 carbon atoms, and a substituted or unsubstituted anilino group having 6 to 30 carbon atoms; e.g., an amino group, a methylamino group, a dimethylamino group, an anilino group, a N-methylanilino group, a diphenylamino group); an acylamino group (preferably a formylamino group, a substituted or unsubstituted alkylcarbonylamino group having 1 to 30 carbon atoms, and a substituted or unsubstituted arylcarbonylamino group having 6 to 30 carbon atoms; e.g., a formylamino group, an acetylamino group, a pivaloylamino group, a lauroylamino group, a benzoylamino group, a 3,4,5-tri-n-octyloxyphenylcarbonylamino group); an aminocarbonylamino group (preferably a substituted or unsubstituted aminocarbonylamino group having 1 to 30 carbon atoms; e.g., a carbamoylamino group, a N,N-dimethylaminocarbonylamino group, a N,N-diethylamino carbonylamino group, a morpholinocarbonylamino group); an alkoxycarbonylamino group (preferably a substituted or unsubstituted alkoxycarbonylamino group having 2 to 30 carbon atoms; e.g., a methoxycarbonylamino group, an ethoxycarbonylamino group, a t-butoxycarbonylamino group, a n-octadecyloxycarbonylamino group, a N-methylmethoxycarbonylamino group); an aryloxycarbonylamino group (preferably a substituted or unsubstituted aryloxycarbonylamino group having 7 to 30 carbon atoms; e.g., a phenoxycarbonylamino group, a p-chlorophenoxycarbonylamino group, a m-n-octyloxyphenoxycarbonylamino group); a sulfamoyl amino group (preferably a substituted or unsubstituted sulfamoylamino group having 0 (zero) to 30 carbon atoms; e.g., a sulfamoylamino group, a N,N-dimethylaminosulfonylamino group, a N-n-octyl aminosulfonylamino group); an alkyl- or aryl-sulfonylamino group (preferably a substituted or unsubstituted alkyl sulfonylamino group having 1 to 30 carbon atoms and a substituted or unsubstituted aryl sulfonylamino group having 6 to 30 carbon atoms; e.g., a methyl sulfonylamino group, a butylsulfonylamino group, a phenylsulfonylamino group, a 2,3,5-trichlorophenylsulfonylamino group, a p-methylphenylsulfonylamino group); a mercapto group; an alkylthio group (preferably a substituted or unsubstituted alkylthio group having 1 to 30 carbon atoms, e.g., a methylthio group, an ethylthio group, a n-hexadecylthio group); an arylthio group (preferably a substituted or unsubstituted arylthio group having 6 to 30 carbon atoms, e.g., a phenylthio group, a p-chlorophenylthio group, a m-methoxyphenylthio group); a heterocyclic thio group (preferably a substituted or unsubstituted heterocyclic thio group having 2 to 30 carbon atoms, e.g., a 2-benzothiazolylthio group, a 1-phenyltetrazol-5-yl thio group); a sulfamoyl group (preferably a substituted or unsubstituted sulfamoyl group having 0 (zero) to 30 carbon atoms, e.g., a N-ethylsulfamoyl group, a N-(3-dodecyloxypropyl)sulfamoyl group, a N,N-dimethylsulfamoyl group, a N-acetylsulfamoyl group, a N-benzoylsulfamoyl group, a N-(N'-phenylcarbamoyl) sulfamoyl group); an alkyl- or aryl-sulfinyl group (preferably a substituted or unsubstituted alkylsulfinyl group having 1 to 30 carbon atoms and a substituted or unsubstituted arylsulfinyl group having 6 to 30 carbon atoms; e.g., a methylsulfinyl group, an ethylsulfinyl group, a phenylsulfinyl group, a p-methylphenylsulfinyl group); an alkyl- or aryl-sulfonyl group (preferably a substituted or unsubstituted alkylsulfonyl group having 1 to 30 carbon atoms and a substituted or unsubstituted arylsulfonyl group having 6 to 30 carbon atoms; e.g., a methylsulfonyl group, an ethylsulfonyl group, a phenylsulfonyl group, a p-methylphenylsulfonyl group); an acyl group (preferably a formyl group, a substituted or unsubstituted alkylcarbonyl group having 2 to 30 carbon atoms, and a substituted or unsubstituted arylcarbonyl group having 7 to 30 carbon atoms; e.g., an acetyl group, a pivaloyl group, a 2-chloroacetyl group, a stearoyl group, a benzoyl group, a p-n-octyloxyphenylcarbonyl group); an aryloxycarbonyl group (preferably a substituted or unsubstituted aryloxycarbonyl group having 7 to 30 carbon atoms, e.g., a phenoxycarbonyl group, a o-chlorophenoxycarbonyl group, a m-nitrophenoxycarbonyl group, a p-t-butylphenoxycarbonyl group); an alkoxycarbonyl group (preferably a substituted or unsubstituted alkoxycarbonyl group having 2 to 30 carbon atoms, e.g., a methoxycarbonyl group, an ethoxycarbonyl group, a t-butoxycarbonyl group, a n-octadecyloxycarbonyl group); a carbamoyl group (preferably a substituted or unsubstituted carbamoyl group having 1 to 30 carbon atoms; e.g., a carbamoyl group, a N-methylcarbamoyl group, a N,N-dimethylcarbamoyl group, a N,N-di-n-octylcarbamoyl group, a N-(methylsulfonyl)carbamoyl group); an aryl- or heterocyclic-azo group (preferably a substituted or unsubstituted aryl azo group having 6 to 30 carbon atoms, and a substituted or unsubstituted heterocyclic azo group having 3 to 30 carbon atoms; e.g., a phenylazo group, a p-chlorophenylazo group, a 5-ethylthio-1,3,4-thiadiazole-2-yl azo group); an imido group (preferably a N-succinimido group, a N-phthalimido group); a phosphino group (preferably a substituted or unsubstituted phosphino group having 2 to 30 carbon atoms, e.g., a dimethylphosphino group, a diphenylphosphino group, a methylphenoxyphosphino group); a phosphinyl group (preferably a substituted or unsubstituted phosphinyl group having 2 to 30 carbon atoms, e.g., a phosphinyl group, a dioctyloxyphosphinyl group, a diethoxyphosphinyl group); a phosphinyloxy group (preferably a substituted or unsubstituted phosphinyloxy group having 2 to 30 carbon atoms, e.g., a diphenoxyphosphinyloxy group, a dioctyloxyphosphinyloxy group); a phosphinylamino group (preferably a substituted or unsubstituted phosphinylamino group having 2 to 30 carbon atoms, e.g., a dimethoxyphosphinylamino group, a dimethylaminophosphinylamino group); and a silyl group (preferably a substituted or unsubstituted silyl group having 3 to 30 carbon atoms, e.g., a trimethylsilyl group, a t-butyldimethylsilyl group, a phenyldimethylsilyl group).

In the case in which the group represented by each of $R_1$, $R_2$ and $R_3$ can be further substituted, the group represented by each of $R_1$, $R_2$ and $R_3$ may have a substituent. In this case, preferred examples of the substituent are the same substituents as described for $R_1$, $R_2$ and $R_3$. In the case in which the group represented by each of $R_1$, $R_2$ and $R_3$ is substituted with two or more substituents, these substituents may be the same or different.

$R_4$ and $R_5$ each independently represent an alkyl group, an aryl group, or a heterocyclic group. Preferred scope of the alkyl group, the aryl group and the heterocyclic group are the same to those of the alkyl group, the aryl group, and the heterocyclic group described as the substituent represented by each of $R_1$, $R_2$ and $R_3$. In the case in which the group represented by $R_4$ or $R_5$ can be further substituted, the group represented by $R_4$ or $R_5$ may further have a substituent. In this case, preferred examples of the substituent are the same substituents as described as $R_1$, $R_2$ and $R_3$. In the case in which the group represented by each of $R_4$ and $R_5$ is substituted with two or more substituents, these substituents may be the same or different.

$R_1$ and $R_2$, or/and $R_2$ and $R_4$ may bond with each other respectively, to form a 5-, 6-, or 7-membered carbocycle or hetero cycle.

A preferable range (examples) of the compound represented by formula (1) is described below.

$R_1$, $R_2$ and $R_3$ are preferably a hydrogen atom, a halogen atom, an alkyl group, an aryl group, an acylamino group, an alkyl- or an aryl-sulfonylamino group, an alkoxy group, an aryloxy group, an alkylthio group, an arylthio group, an acyl group, an alkoxycarbonyl group, an aryloxycarbonyl group, a carbamoyl group, a cyano group, a nitro group, a sulfamoyl group, an alkylsulfonyl group, an arylsulfonyl group, and an acyloxy group, more preferably, a hydrogen atom, a halogen atom, an alkyl group, an acylamino group, an alkyl- or an aryl-sulfonylamino group, an alkoxy group, an alkylthio group, an arylthio group, an alkoxycarbonyl group, a carbamoyl group, a cyano group, a nitro group, a sulfamoyl group, an alkylsulfonyl group, and an arylsulfonyl group, and particularly preferably any one of $R_1$ and $R_3$ is a hydrogen atom. $R_2$ is preferably an alkyl group or an alkoxy group.

$R_4$ is preferably an alkyl group.

$R_5$ is preferably an alkyl or an aryl group, and more preferably a substituted phenyl group represented by the following formula (2):

formula (2)

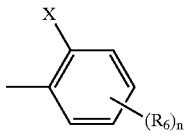

wherein X represents a halogen atom, or a substituent which is bonded to the benzene ring through a hetero atom; $R_6$ represents a hydrogen atom or a substituent; n is an integer of 0 (zero) to 4; when n is 2 or more, $R_6$s may be the same or different, and $R_6$s adjacent each other may bond together to form a 5- to 7-membered carbocycle or heterocycle.

Examples of X include a halogen atom, a hydroxyl group, a nitro group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl-sulfonylamino group, an aryl-sulfonylamino group, a mercapto group, an alkylthio group, an arylthio group, a heterocyclic thio group, a sulfamoyl group, a sulfo group, an alkyl-sulfinyl group, an aryl-sulfinyl group, an alkyl-sulfonyl group, an aryl-sulfonyl group, an aryl-azo group, a heterocyclic-azo group, an imido group, a phosphino group, a phosphinyl group, a phosphinyloxy group, a phosphinylamino group, and a silyl group. A preferred scope of these groups is the same as the substituent represented by above-described $R_1$, $R_2$ and $R_3$.

X is preferably a halogen atom, a hydroxyl group, an alkoxy group, an aryloxy group, a silyloxy group, a heterocyclic oxy group, a carbamoyloxy group, an amino group, an acylamino group, an aminocarbonylamino group, an alkoxycarbonylamino group, an alkyl-sulfonylamino group, an aryl-sulfonylamino group, a mercapto group, an alkylthio group, a sulfamoyl group, an alkyl-sulfonyl group, an aryl-sulfonyl group, or a silyl group, and more preferably a halogen atom, a hydroxyl group, an alkoxy group, an acylamino group, an aminocarbonylamino group, an alkoxycarbonylamino group, an alkyl-sulfonyl amino group or an aryl-sulfonylamino group.

$R_6$ represents a substituent. The substituent represented by $R_6$ is the same as the substituent represented by the above-described $R_1$, $R_2$ and $R_3$.

$R_6$ is preferably a halogen atom, an alkyl group, an aryl group, an alkoxy group, an aryloxy group, an amino group, an acylamino group, an aminocarbonylamino group, an alkoxycarbonylamino group, an alkyl-sulfonylamino group, an aryl-sulfonylamino group, or an alkylthio group, and more preferably a halogen atom, an alkyl group, an alkoxy group, or an acylamino group. n is preferably an integer of 0 (zero) to 3.

Z preferably represents a group of non-metallic atoms that form a 1,2,3,4-tetrahydroquinoline skeleton or indoline skeleton together with the adjacent nitrogen atom and benzene ring, in which a hydrogen atom in hydrocarbon constituting Z may be substituted by a substituent.

In the compound represented by the formula (1), it is preferred that a compound obtained by replacing $R_5$—$SO_2$—NH—CO— in the formula by a hydrogen atom has a ClogP value of 3.0 or more. The ClogP value is a calculated value of water/octanol distribution coefficient of the compound. The inventors of the present invention have calculated this value by using Chem Draw Ultra Ver. 5.0 (trade name) manufactured by Cambridge Soft Corporation.

The specific examples of the compound represented by formula (1) will be described, but the present invention is not limited by these examples.

DEVP-1

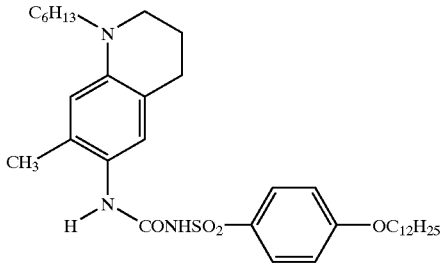

DEVP-2

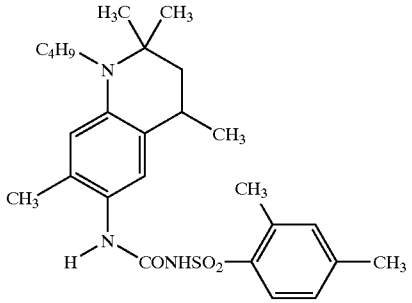

DEVP-3

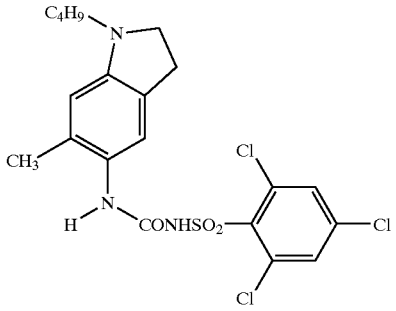

DEVP-4

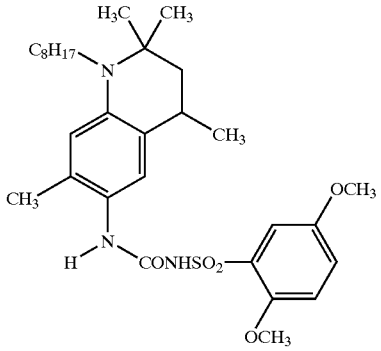

-continued

DEVP-5

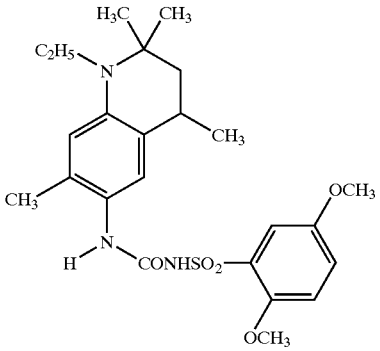

DEVP-6

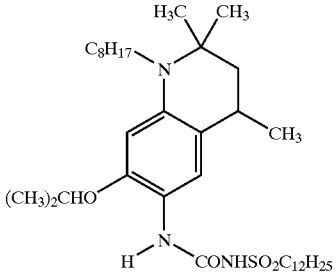

DEVP-7

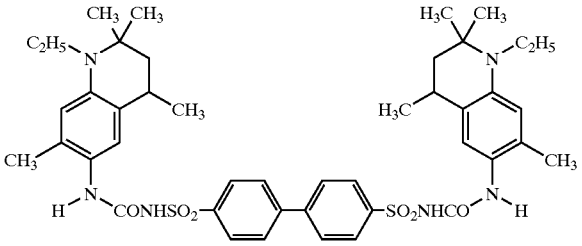

DEVP-8

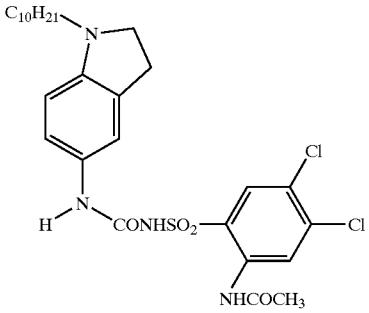

DEVP-9

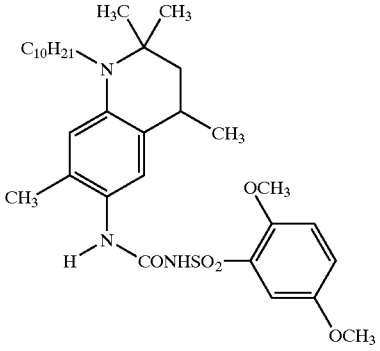

-continued
DEVP-10
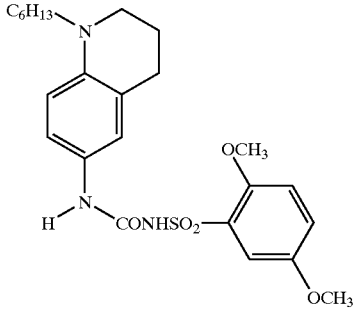
DEVP-11
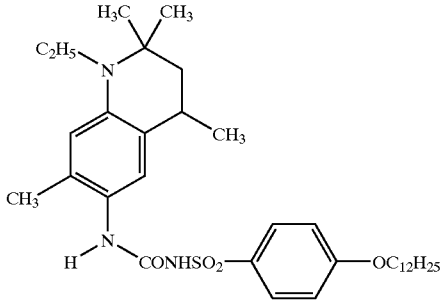
DEVP-12
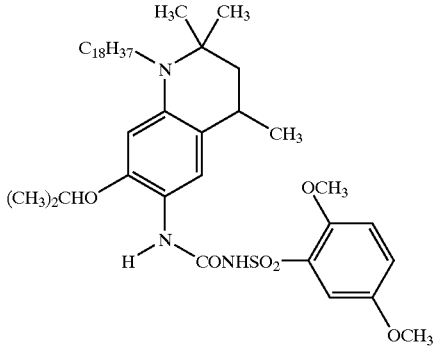
DEVP-13
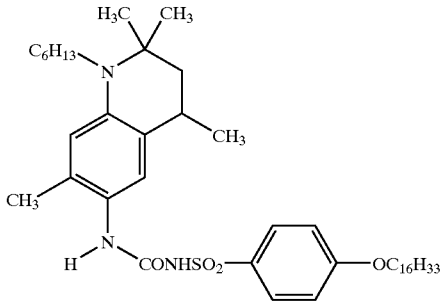
DEVP-14
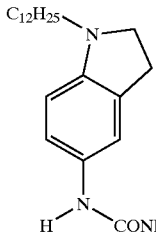
-continued
DEVP-15
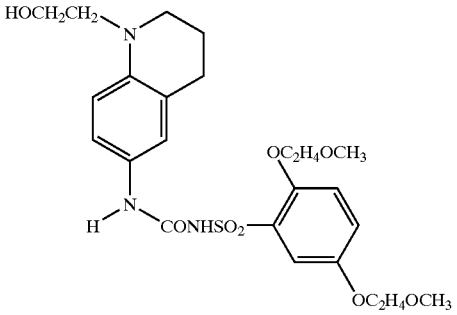
DEVP-16
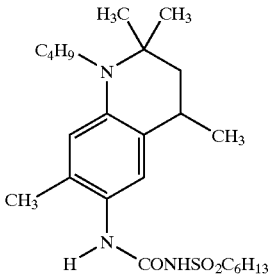
DEVP-17
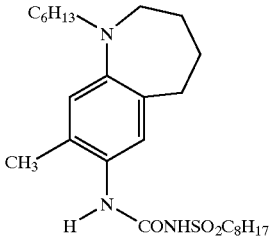
DEVP-18
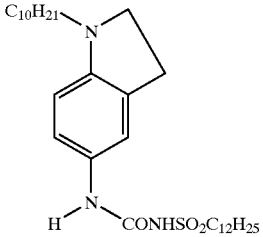
DEVP-19
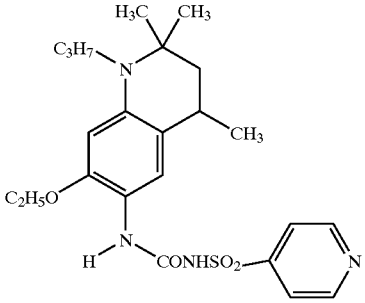

-continued
DEVP-20
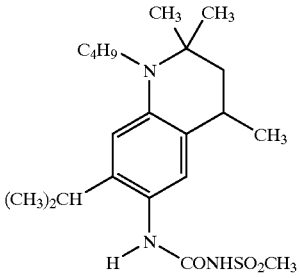
DEVP-21
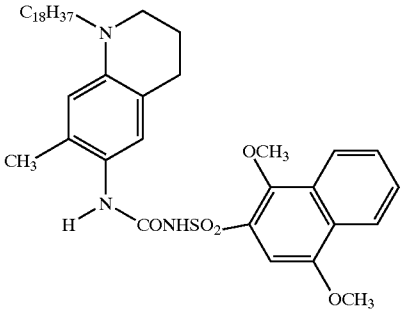
DEVP-22
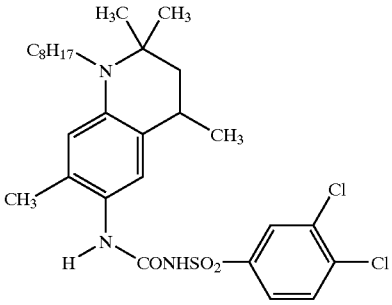
DEVP-23
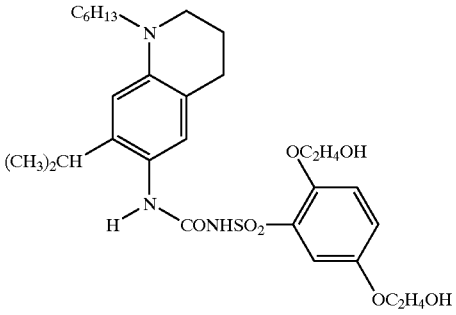
DEVP-24
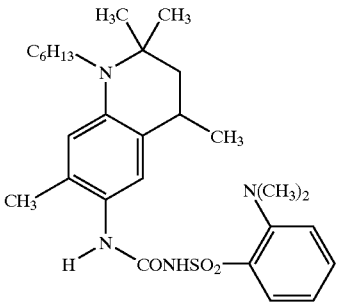
-continued
DEVP-25
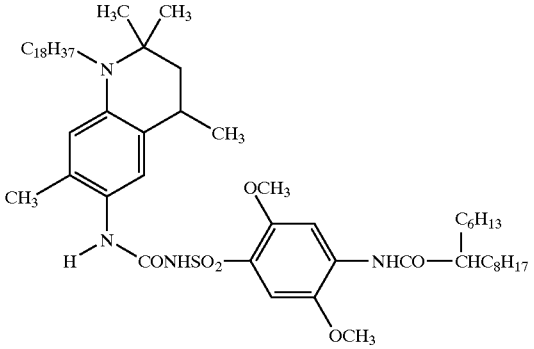
DEVP-26
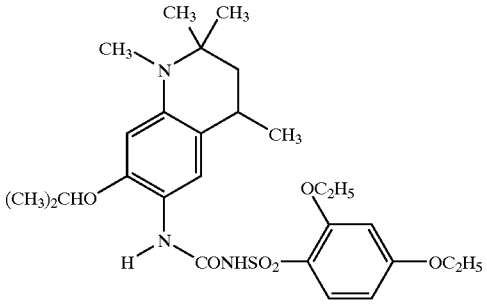
DEVP-27
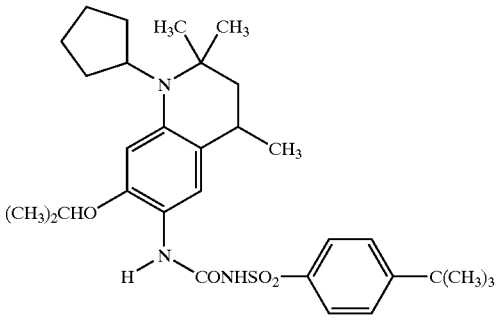
DEVP-28
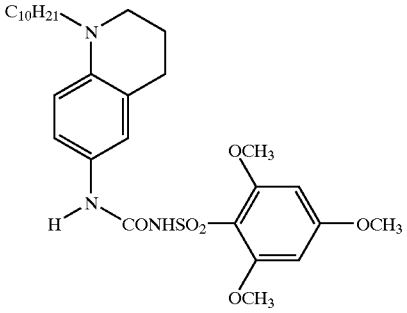

-continued
DEVP-29
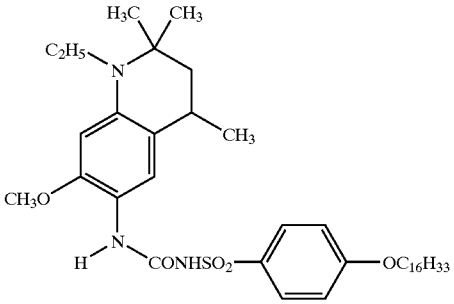
DEVP-30
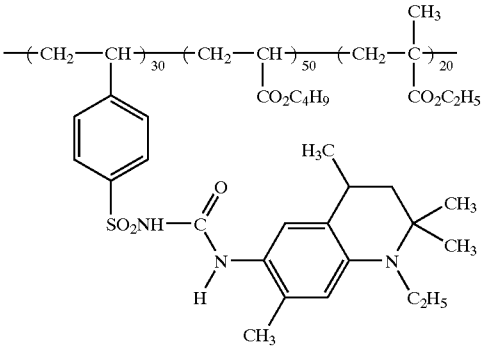
DEVP-31
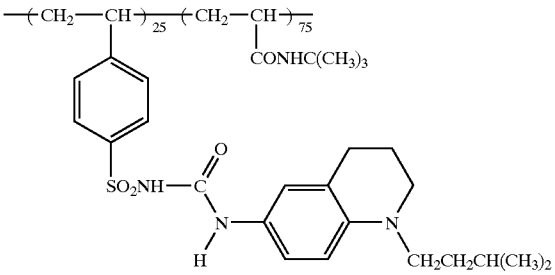
DEVP-32
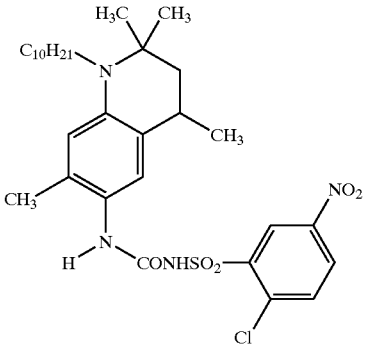
-continued
DEVP-33
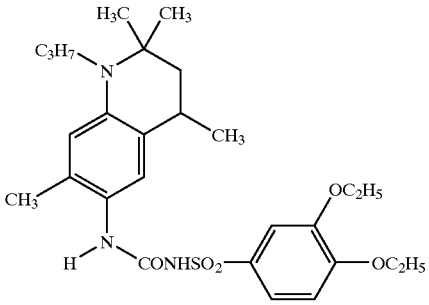
DEVP-34
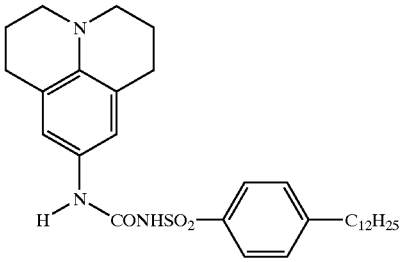
DEVP-35
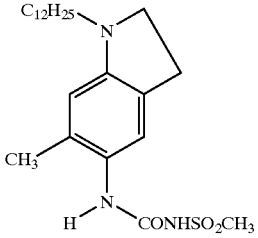
DEVP-36
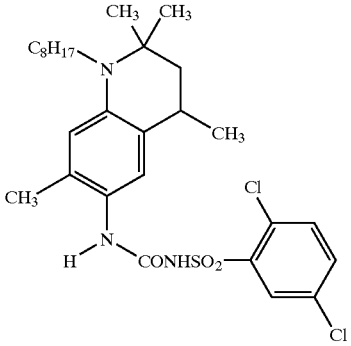
DEVP-37
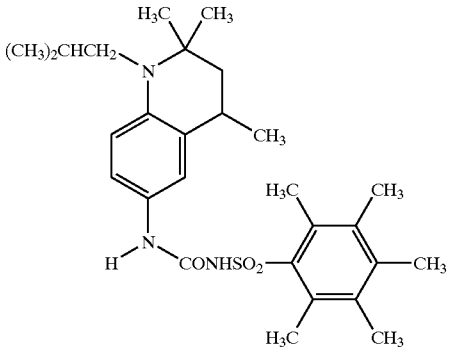

-continued
DEVP-38
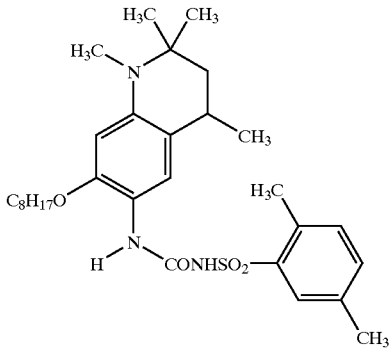
DEVP-39
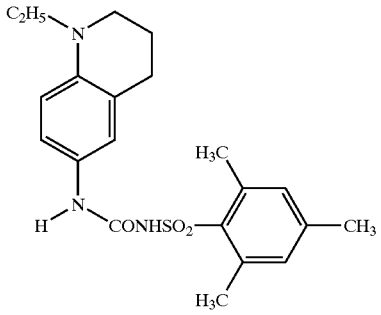
DEVP-40
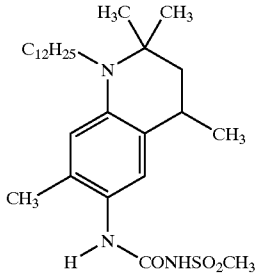
DEVP-41
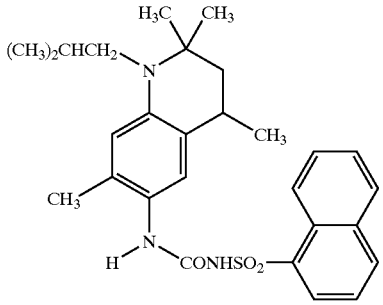
DEVP-42
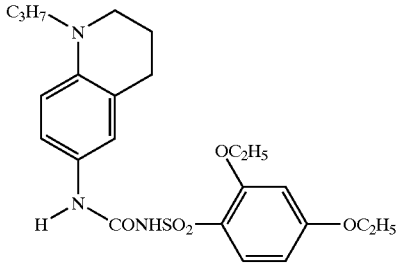
-continued
DEVP-43
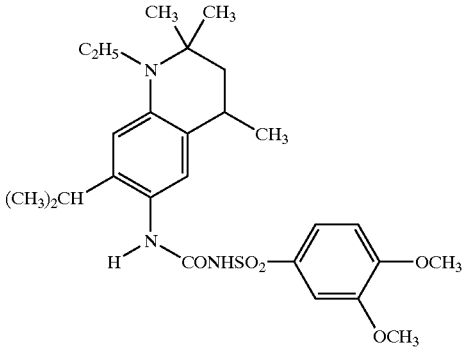
DEVP-44
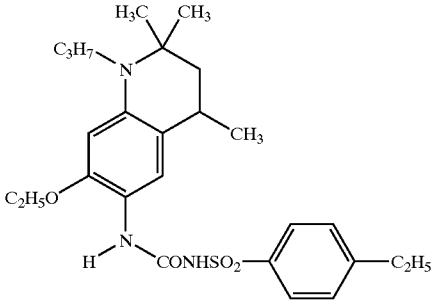
DEVP-45
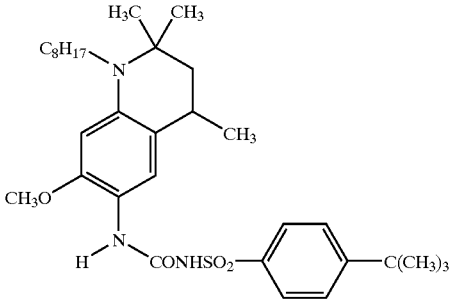
DEVP-46
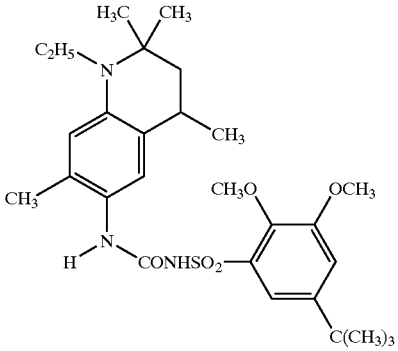

-continued
DEVP-47
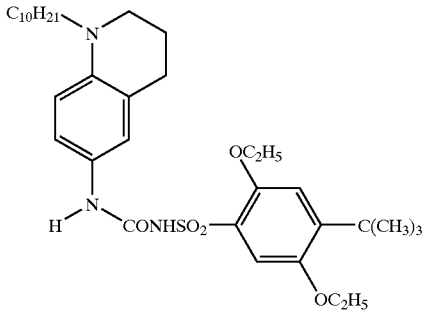
DEVP-48
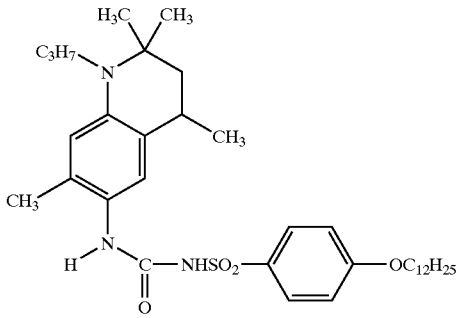
DEVP-49
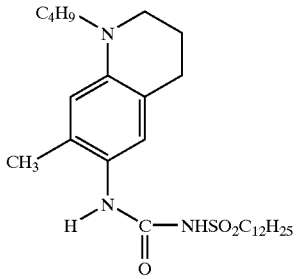
DEVP-50
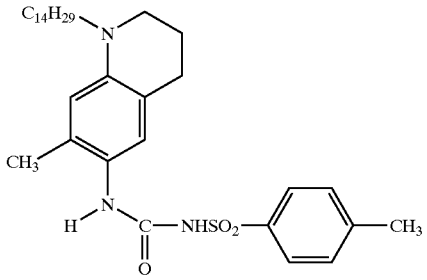
DEVP-51
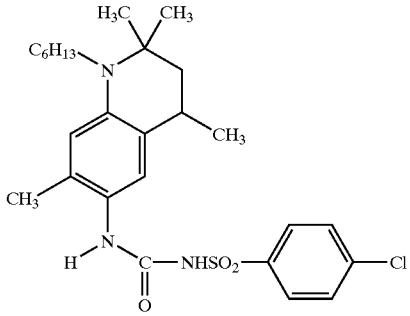
-continued
DEVP-52
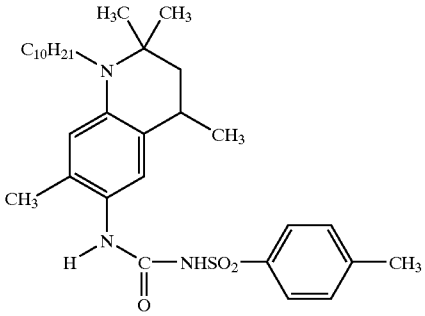
DEVP-53
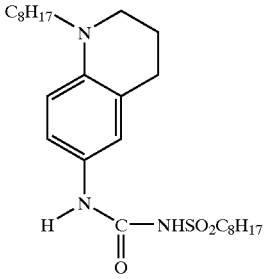
DEVP-54
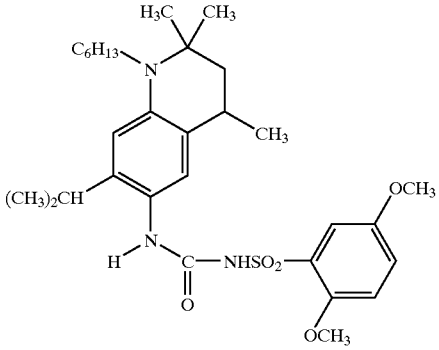
DEVP-55
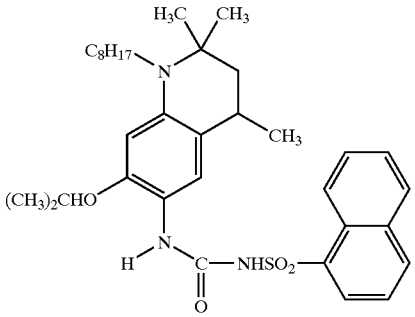
DEVP-56
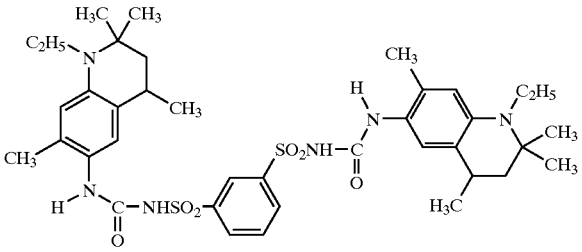

-continued

DEVP-57

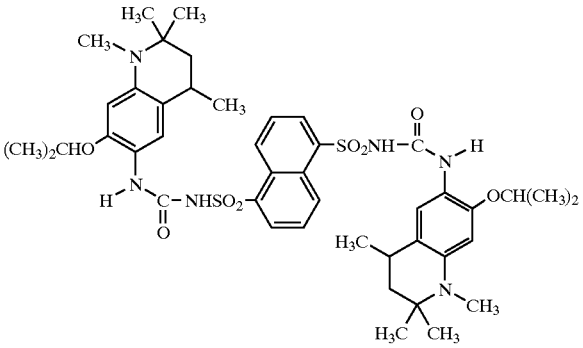

DEVP-58

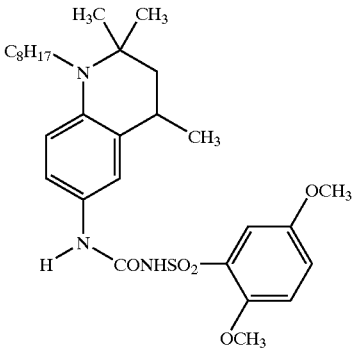

DEVP-59

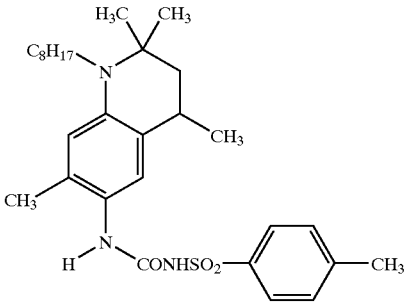

DEVP-60

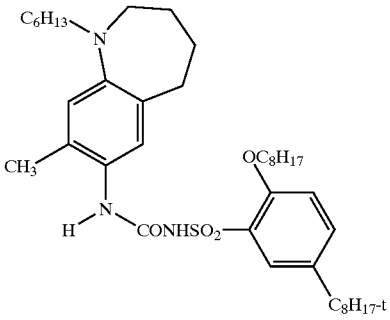

-continued

DEVP-61

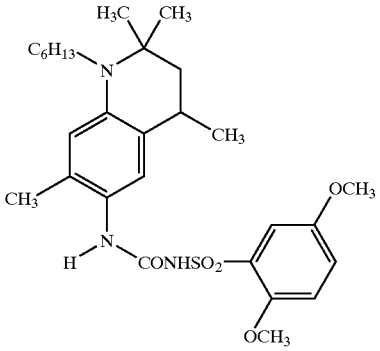

Next, a synthesis method for the compound represented by the formula (1) for use in the present invention will be described. In the formula (1), the part on the right hand side of the nitrogen atom shown in the formula, to which $R_5$—$SO_2$—NH—CO— is bonded, may be a compound called tetrahydroquinoline, and the compound of formula (1) can be synthesized, for example, by the method described in Chem. Ber. Vol. 54, p.1729 (1921).

SYNTHETIC EXAMPLE 1

<Synthesis of Exemplary Compound DEVP-4>

Exemplary compound DEVP-4 was synthesized in accordance with the following scheme.

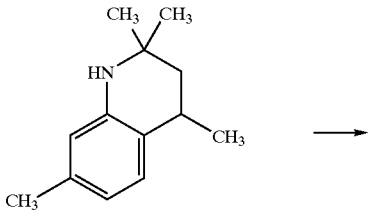

INT-1A

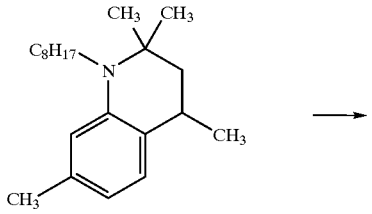

INT-1B

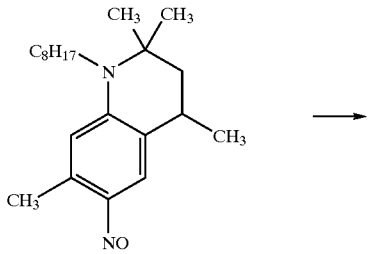

INT-1C

-continued

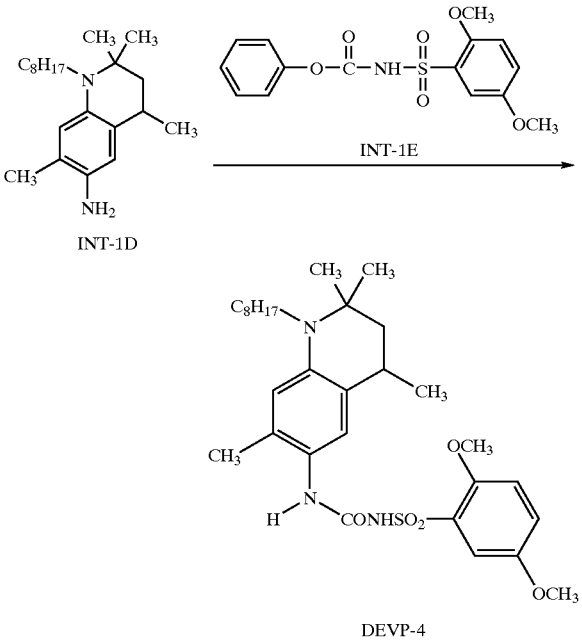

Synthesis of INT-1B 151 g (0.800 mol) of 1,2,3,4-tetrahydro-2,2,4,7-tetramethylquinoline (INT-1A) manufactured by Aldrich Co., 269 g (3.20 mol) of sodium hydrogencarbonate, and 500 ml of N-methylpyrrolidone were heated and stirred on an oil bath at 170° C. 309 g (1.60 mol) of 1-bromooctane was added dropwise over 2 hours, and heated with stirring for additional 8 hours. After standing for one night, 1,500 ml of water and 1,000 ml of hexane were added to effect extraction. After washing the extracted organic layer with brine, the organic layer was dried over anhydrous magnesium sulfate. After concentration was performed under reduced pressure, distillation was performed under reduced pressure at 0.39 kPa and fractions at 185 to 195° C. were collected to obtain 180 g (yield 74.6%) of INT-1B.

Synthesis of INT-1C

To 300 ml of methanol were added 100 g (0.332 mol) of INT-1B and 85.5 ml (0.996 mol) of concentrated hydrochloric acid, and the resultant mixture was cooled with a freezing medium and stirred. To this was dropped a solution of 27.5 g (0.398 mol) sodium nitrite in 60 ml of water over 20 minutes, while keeping the internal temperature at 5° C. or lower. After stirring for 2.5 hours, 800 ml of water, 300 ml of chloroform, and 300 ml of hexane were added to effect extraction. The obtained organic layer was washed with sodium hydrogencarbonate solution two times. Purification was effected by silica gel column chromatography to obtain 92.7 g (yield 84.5%) of INT-1C.

Synthesis of INT-1D

The total amount of INT-1C obtained as described above was dissolved in 200 ml of ethanol, and hydrogenation was performed by using an autoclave apparatus having an inner volume of 1.0 liter in the presence of 1.0 g of 5% palladium-carbon catalyst under the conditions of a hydrogen pressure of 5 MPa and room temperature. The reaction mixture was filtered with Celite, and concentrated under reduced pressure to obtain 84.2 g (yield 99.4%) of INT-ID.

Synthesis of INT-1E

Into 1100 ml of methylene chloride was dissolved 552 g (4.00 mol) of commercially available 1,4-dimethoxybenzene, and then 308 ml (4.63 mol) of chlorosulfonic acid was added dropwise thereto under cooling with ice in such a manner that the internal temperature was not over 5° C. After the addition, the reaction system was put under a condition of room temperature, and the solution was further stirred for 1 hour. Next, 1000 ml of acetonitrile and 600 ml of DMAC (N,N-dimethylacetoamide) were poured into the solution. Next, the reaction system was heated in a warm bath of 35° C. temperature, and thereto was added dropwise 404 ml (4.33 mol) of phosphorous oxychloride at an internal temperature of 30° C. At this time, attention was paid that the internal temperature was not over 40° C. After the addition, the solution was allowed to react at 35° C. for 1 hour. Thereafter, the reaction solution was charged into ice water. The organic phase was extracted with ethyl acetate, washed with water and dried over anhydrous magnesium sulfate. The solvent was then distilled off under reduced pressure, to obtain 2,5-dimethoxybenzenesulfonylchloride.

With ice, 800 ml of a 25% aqueous ammonia and 3000 ml of acetonitrile were cooled, and stirred with keeping the internal temperature thereof to 5° C. or less. The 2,5-dimethoxybenzenesulfonylchloride obtained by the above-mentioned operation was divided into 30 parts, and they were dropwise added, one by one, to the cooled solution. After the addition, the solution was allowed to react for 30 minutes, and then the solution were poured into a mixed solution of 800 ml of concentrated hydrochloric acid and 3500 ml of ice water with stirring. The precipitated crystal was collected by filtration, and washed with water and then with 500 ml of acetonitrile, to obtain 827.3 g of 2,5-dimethoxybenzenesulfonamide as a white crystal (yield: 95.2%).

Under cooling with ice, 827.3 g (3.81 mol) of 2,5-dimethoxybenzenesulfonamide, 3000 ml of acetonitrile, and 1170 ml (8.39 mol) of triethylamine were stirred, and thereto was added dropwise 626 g (4.00 mol) of phenyl chloroformate in such a manner that the internal temperature was not over 20° C. After the addition, the solution was further allowed to react at 20° C. or less for 2 hours. After the reaction, the solution was poured into a mixed solution of 700 ml of concentrated hydrochloric acid and 7000 ml of ice water with stirring. The precipitated crystal was collected by filtration, and washed with water and then with 800 ml of acetonitrile, to obtain 1130 g of INT-1E as a white crystal (yield: 88.0%).

Synthesis of DEVP-4

15.8 g (50.0 mmol) of INT-1D and 16.9 g (50.0 mmol) of INT-1E were added to 100 ml of acetonitrile and stirred at room temperature. 14.0 ml (100 mmol) of triethylamine was added thereto and stirred at room temperature for 2 hours. 200 ml of ethyl acetate and 300 ml of water were added to effect extraction, and the organic layer was washed with brine. After the organic layer is dried over anhydrous magnesium sulfate, concentration was performed under reduced pressure. To the residue was added 80 ml of acetonitrile and the mixture was heated and dissolved, followed by cooling under stirring to effect crystallization. The precipitated crystal was collected by filtration and washed with cold acetonitrile. By drying, 16.3 g (yield 58%) of exemplary compound DEVP-4 was obtained as a white crystal.

SYNTHETIC EXAMPLE 2

<Synthesis Exemplary Compound DEVP-5>

Exemplary compound DEVP-5 was synthesized in accordance with the following scheme.

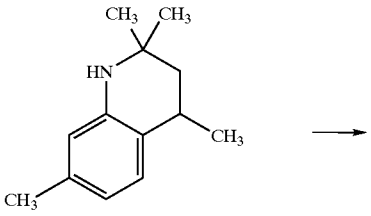

INT-1A

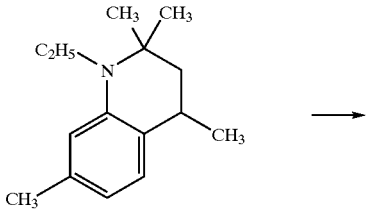

INT-2B

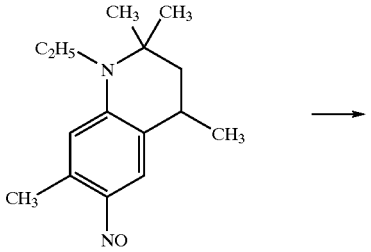

INT-2C

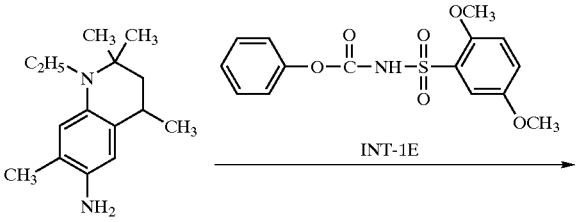

INT-2D

INT-1E

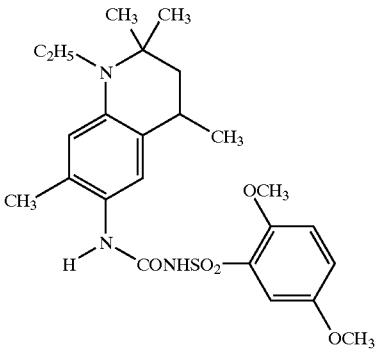

DEVP-5

Synthesis of INT-2B 87.6 g (0.500 mol) of 1,2,3,4-tetrahydro-2,2,4,7-tetramethylquinoline (INT-1A) manufactured by Aldrich Co., 84.0 g (1.00 mol) of sodium hydrogencarbonate, and 300 ml of N-methylpyrrolidone were stirred at room temperature, and 101.4 g (0.650 mol) of ethyl iodide was added. Slowly warming the oil bath to 70° C., stirring was performed at 70° C. for 4 hours. After cooling the solution to room temperature, 800 ml of water and 700 ml of ethyl acetate were added to effect extraction, and the organic layer was washed with 700 ml of water three times. It dried over anhydrous magnesium sulfate, followed by the concentration under reduced pressure and then distillation under reduced pressure, to obtain 67.7 g (yield 62.3%) of INT-2B.

Synthesis of INT-2C

To 250 ml of methanol were added 56.0 g (0.258 mol) of INT-2B and 88.5 ml (1.03 mol) of concentrated hydrochloric acid, and the mixture was cooled with a freezing medium and stirred. To this was added dropwise a solution of 18.7 g (0.271 mol) sodium nitrite in 60 ml of water over 1 hour. At this time, the internal temperature was 7 to 10° C. After stirring for 1 hour, 600 ml of water and 400 ml of chloroform were added to effect extraction, and the extracted organic layer was washed with 400 ml of water two times. To the organic layer was added 300 ml of hexane, and the resultant was allowed to be carried on silica gel packed in a column tube without using solvents, and eluted with a mixed solvent of hexane/ethyl acetate to effect purification, to obtain 51.6 g (yield 81.3%) of INT-2C.

Synthesis of INT-2D

The total amount of INT-2C obtained as described above was dissolved in 250 ml of methanol and 50 ml of tetrahydrofuran, and hydrogenation was performed by using an autoclave apparatus having an inner volume of 1.0 liter in the presence of 1.0 g of 5% palladium-carbon catalyst under the conditions of a hydrogen pressure of 5 MPa and room temperature. The reaction mixture was filtered with Celite and washed with methanol. INT-2D obtained by concentrating the filtrate under reduced pressure was used as it was in the subsequent step.

Synthesis of DEVP-5

The above-mentioned INT-2D and 84.3 g (0.250 mol) of INT-1E were added to 500 ml of acetonitrile and 100 ml of N,N-dimethylacetamide and stirred under ice-cooling, followed by adding dropwise 58.5 ml (0.419 mol) of triethylamine over 2 hours, and thereafter stirring was performed at room temperature for 3 hours. 24 ml of acetic acid was added dropwise in 20 minutes, and 600 ml of acetonitrile and 400 ml of water were added, followed by stirring for 1 hour. The precipitated crystal was collected by filtration, washed with a mixed solution of 200 ml of acetonitrile and 100 ml of water, and dried. The obtained crystal was recrystallized with 400 ml of ethyl acetate, and the precipitated crystal was collected by filtration, and washed with 100 ml of ethyl acetate. By drying, 60.6 g (yield 60.8%) of exemplary compound DEVP-5 was obtained as a white crystal. Melting point: 176 to 179° C.

SYNTHETIC EXAMPLE 3

<Synthesis of Exemplary Compound DEVP-59>

Exemplary compound DEVP-59 was synthesized in accordance with the following scheme.

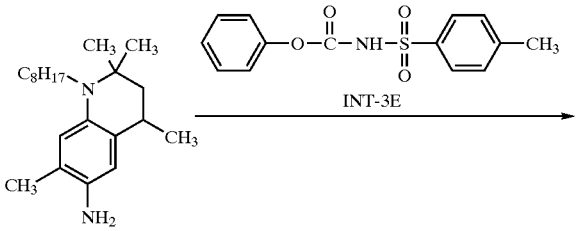

INT-1D

INT-3E

-continued

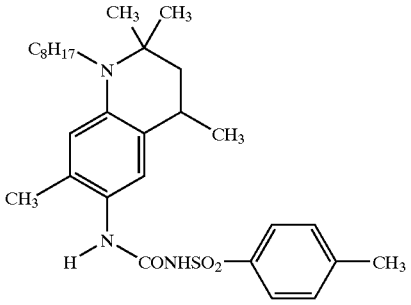

DEVP-59

Synthesis of INT-3E 85.6 g (0.500 mol) of commercially available p-toluenesulfonamide, 425 ml of acetonitrile, and 139.5 ml (1.00 mol) of triethylamine were cooled with ice water and stirred, followed by adding dropwise 82.2 g (0.525 mol) of phenyl chloroformate over 2 hours, and then the obtained mixture was allowed to react for additional 1 hour. After completion of the reaction, the reaction mixture was poured into a mixed solution of 41.7 ml of concentrated hydrochloric acid and 500 ml of ice water under stirring. Extraction was performed with 500 ml of ethyl acetate, and the organic layer was washed with saturated brine and dried over anhydrous magnesium sulfate. Under reduced pressure, this solution was concentrated, the residue was crystallized with hexane, and the precipitated crystal was collected by filtration. After washing with hexane, drying was performed to obtain 101 g of INT-3E as a white crystal (yield 69.3%).

Synthesis of DEVP-59

INT-1D synthesized in the same manner as in Synthesis Example 1, was mixed with 1,5-naphthalenedisulfonic acid (NDS) in acetonitrile, and heated and dissolved, and thereafter cooling and collecting by filtration were performed. In this manner, NDS salt of INT-1D was synthesized in advance, and using this salt, Synthesis Examples 3 and 4 were performed. 60.5 g (0.100 mol) of NDS salt of INT-1D was added into 300 ml of DMAC and stirred under a nitrogen atmosphere, followed by addition of 27.9 ml (0.200 mol) of triethylamine and stirring for 30 minutes. Undissolved matter was filtered off and washed with a small amount of DMAC. The filtrate was stirred at room temperature under a nitrogen atmosphere, and 35.0 g (0.120 mol) of INT-3E and 13.9 ml of triethylamine were added, followed by stirring for 4 hours. To the reaction mixture were added 500 ml of water and 11.4 ml of acetic acid, and extraction was performed with 400 ml of ethyl acetate. The organic layer was washed with water, sodium hydrogencarbonate solution and saturated brine in order, and dried over anhydrous magnesium sulfate. Under reduced pressure, this was concentrated, and the residue was crystallized with 200 ml of acetonitrile, and the precipitated crystal was collected by filtration and washed with cold acetonitrile. By drying, 34.0 g (yield 66.2%) of exemplary compound DEVP-58 was obtained as a white crystal. Melting point: 146 to 148° C.

SYNTHETIC EXAMPLE 4

<Synthesis of Exemplary Compound DEVP-36>

Exemplary compound DEVP-36 was synthesized in accordance with the following scheme.

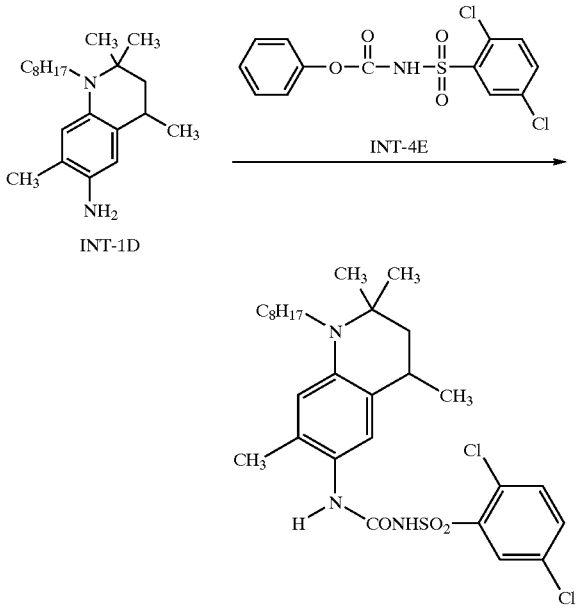

Synthesis of INT-4E 170 ml of aqueous solution of 25% ammonia and 500 ml of acetonitrile were ice-cooled and stirred while maintaining the internal temperature at 5° C. or lower. 126 g (0.513 mol) of commercially available 2,5-dichlorobenzenesulfonyl chloride was added dividedly in five times over 1 hour. After completion of the addition, additional 30 minutes' reaction was performed, and then the reaction mixture was poured in a mixed solution of 100 ml of concentrated hydrochloric acid and 1,000 ml of ice water under stirring. The precipitated crystal was collected by filtration, and washed with water. By drying, 100 g of 2,5-dichlorobenzenesulfonamide was obtained as a white crystal (yield 88%).

45.2 g (0.200 mol) of the 2,5-dichlorobenzenesulfonamide described above, 500 ml of acetonitrile, and 55.8 ml (0.400 mol) of triethylamine were cooled with ice water and stirred, followed by adding dropwise 65.8 g (0.420 mol) of phenyl chloroformate over 1 hour and additional 1 hour's reaction. After completion of the reaction, the reaction mixture was poured in a mixed solution of 5 ml of concentrated hydrochloric acid and 500 ml of ice water under stirring. The precipitated crystal was collected by filtration, washed with water and dried, to obtain 57.2 g of INT-4E as a white crystal (yield 82.6%).

Synthesis of DEVP-36

60.5 g (0.100 mol) of NDS salt of INT-1D was added to 300 ml of DMAC and stirred under a nitrogen atmosphere, and 27.9 ml (0.200 mol) of triethylamine was added, followed by stirring for 30 minutes. Undissolved matter was filtered off and washed with a small amount of DMAC. The filtrate was stirred at room temperature, and 41.5 g (0.120 mol) of INT-4E and 13.9 ml of triethylamine were added, followed by stirring for 3 hours. To the reaction mixture were added 400 ml ethyl acetate and 500 ml of water to effect extraction. The organic layer was washed with water, sodium hydrogencarbonate solution and saturated brine in order, and the concentration was performed under reduced pressure. The residue was purified by silica gel column chromatography (eluant: hexane/ethyl acetate=2/1), and the concentrated residue was crystallized with methanol. The precipitated crystal was collected by filtration and washed with cold methanol. By drying, 31.3 g (yield 55.0%) of exemplary compound DEVP-36 was obtained as a white crystal. Melting point: 121 to 123° C.

The color-developing agent represented by formula (1) according to the present invention may be used as a combination of two or more of them in the same photosensitive layer or in different photosensitive layers, and it may be used in combination with a color-developing agent other than those of the formula (1) for use in the present invention. Examples of color-developing agents other than those of the present invention include compounds described in Publication of European Patent Application Nos. 1113322, 1113323, 1113324, 1113325, 1113326, 1158358, 1158359, 1160621, 1164417, 1164418 and 1168071, U.S. Pat. No. 6,319,640B1, and WO 01/96946, and 01/96954. Specifically, the following developing agents can be mentioned.

DEVP-A1

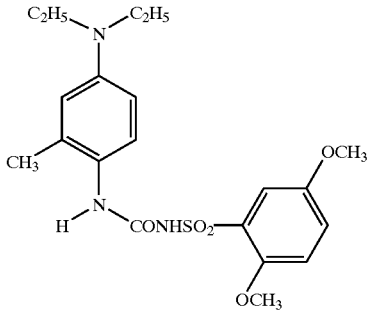

DEVP-A2

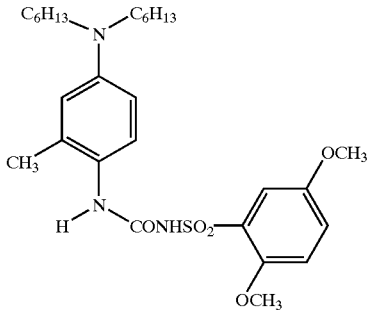

DEVP-A3

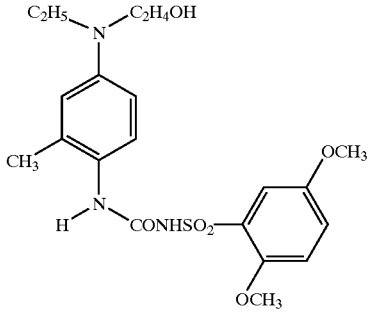

-continued

DEVP-A4

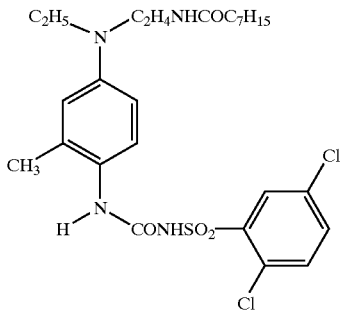

DEVP-A5

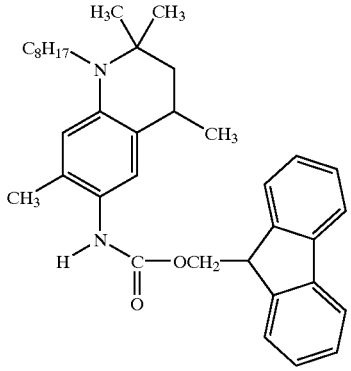

DEVP-A6

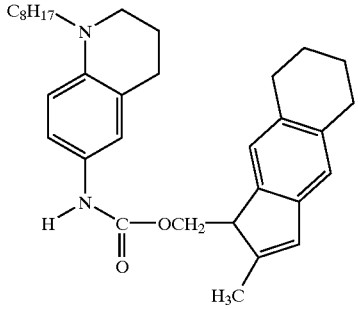

DEVP-A7

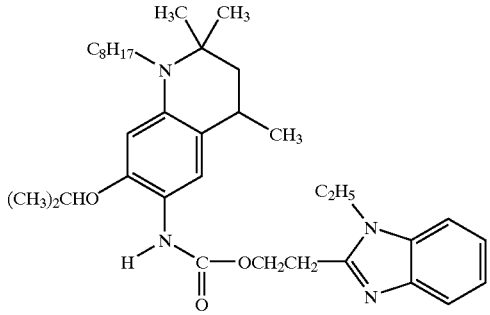

-continued
DEVP-A8
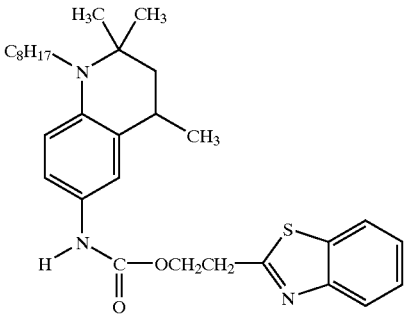
DEVP-A9
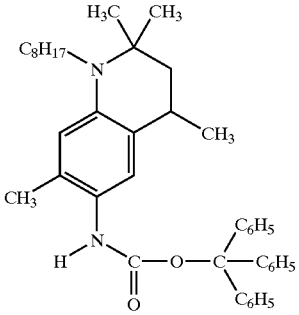
DEVP-A10
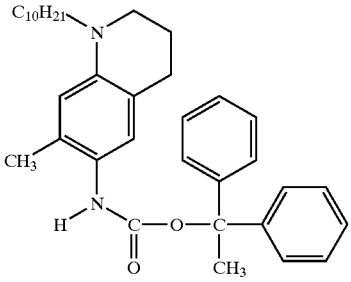
DEVP-A11
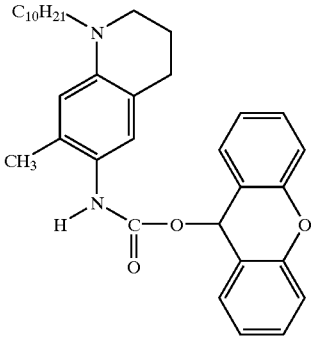
DEVP-A12
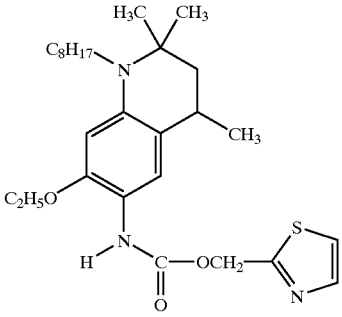
-continued
DEVP-A13
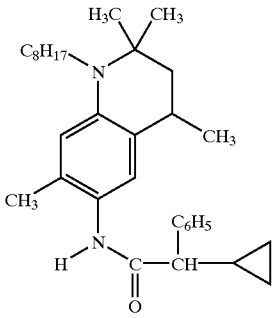
DEVP-A14
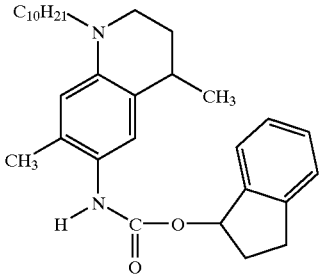
DEVP-A15
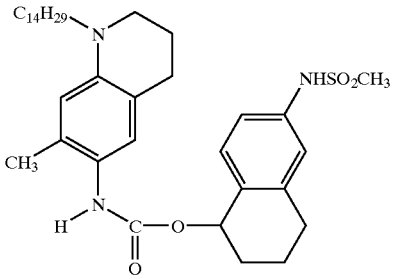
DEVP-A16
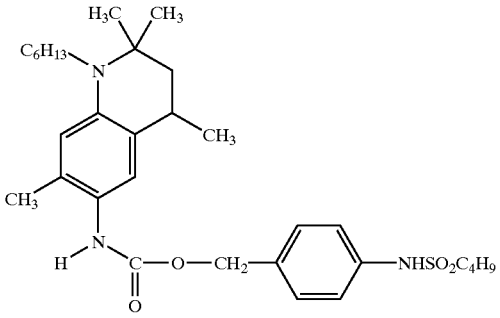
DEVP-A17
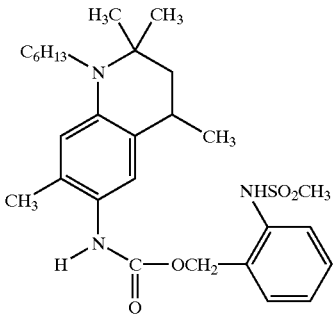

-continued
DEVP-A18
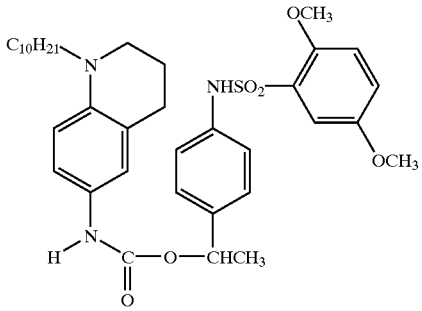
DEVP-A19
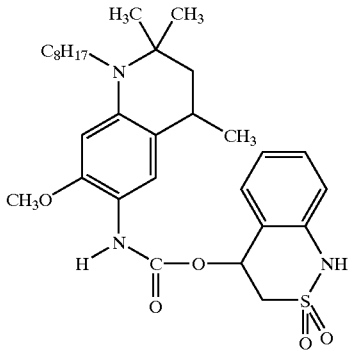
DEVP-A20
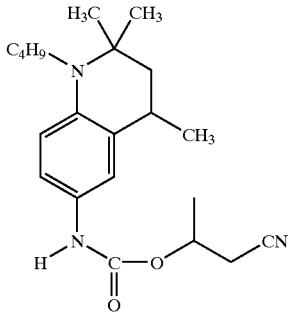
DEVP-A21
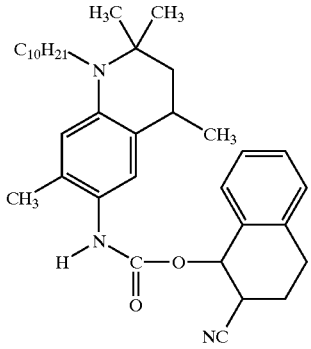
DEVP-A22
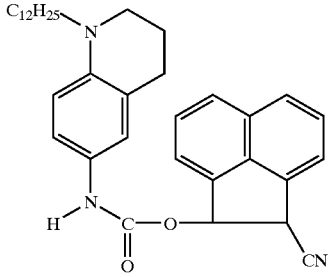
-continued
DEVP-A23
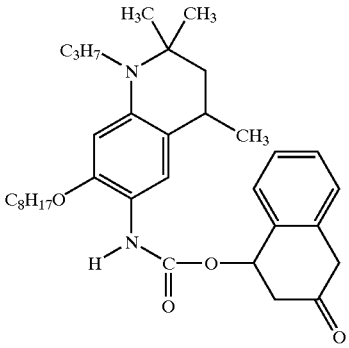
DEVP-A24
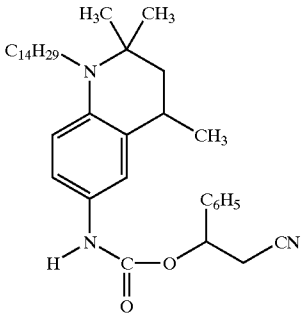
DEVP-A25
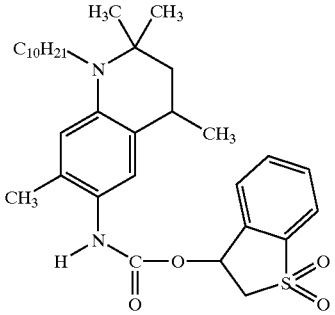
DEVP-A26
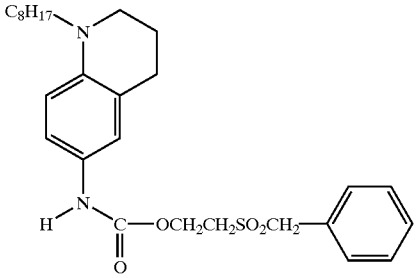
DEVP-A27
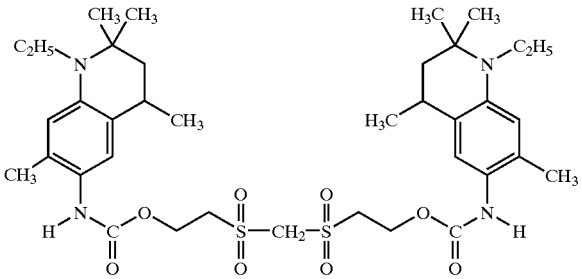

-continued

DEVP-A28

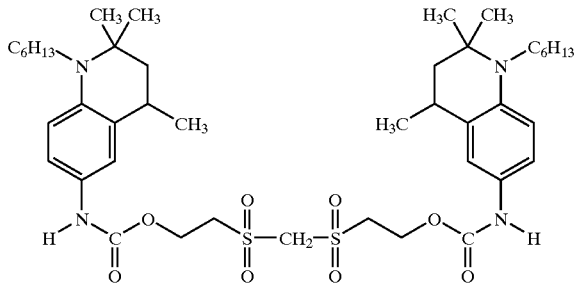

DEVP-A29

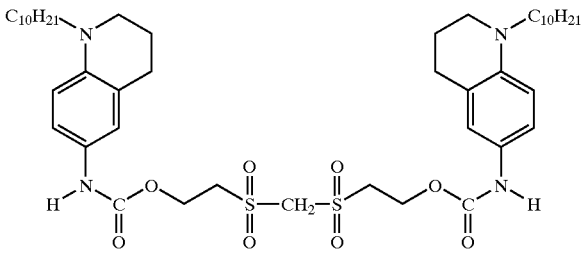

(B) Fine Crystalline Particle Dispersion

In the present invention, the photosensitive material preferably comprises, as a fine crystalline particle dispersion, the color-developing agent, the thermal solvent, and the other additives.

A fine crystalline particle colloid dispersion of these raw materials can be obtained by any method of giving mechanical shearing force, which is well known in the art field. Examples of this method are described in U.S. Pat. No. 2,581,414 and U.S. Pat. No. 2,855,156, and Canadian Patent No. 1,105,761. These descriptions are incorporated herein into the present specification by reference. These methods include various solid particles finely-pulverizing methods such as a ball mill method, a pebble mill method, a roller mill method, a sand mill method, a beads mill method, a Dyno mill method, a Massap mill method and a media mill method, and further include a colloid mill method, a finely-pulverizing method using attritor, a dispersing method by means of ultrasonic energy, and a high-speed stirring method (described in U.S. Pat. No. 4,474,872 by Onishi et al., and which is incorporated herein by reference. Because of good operability, easy washing-operation and good reproducibility, the ball mill, roller mill, media mill methods and the finely-pulverizing method using an attritor are preferred.

As a different method, a dispersion in which the compound is present in the state of an amorphous state can be prepared by a well-known method, examples of which include a colloid mill method, a homogenizing method, a high-speed stirring method and an ultrasonic treating method. Next, the amorphous state of the compound can be converted to a physical state of fine crystals by a method such as a thermal annealing method, a chemical annealing method. Examples of the thermal annealing method include a temperature program method of circulating an amorphous compound to a temperature higher than the glass transition temperature of the amorphous compound. A preferred example of the thermal annealing method comprises the step of circulating the dispersion in the temperature range of 17 to 90° C. This circulating step can include any temperature-change order for promoting the formation of a fine crystalline phase from the remaining amorphous physical state. Typically, a high-temperature interval period is selected in order to activate the formation of the phase and to suppress particle growth due to ripening and collision steps. Examples of the chemical annealing method include an incubation method using a chemical agent, which changes distribution of the compound and a surfactant between the continuous phase and the discontinuous phase of the dispersion. Examples of such a chemical agent include hydrocarbons (such as hexadecane), surfactants, alcohols (such as butanol, pentanol, and undecanol), and high-boiling organic solvents. These chemical agents can be added to the dispersion during or after the formation of particles. Examples of the chemical annealing method include a method of incubating the dispersion at 17 to 90° C. in the presence of the above-described chemical agent, a method of stirring the dispersion in the presence of the above-mentioned chemical agent, and a method of adding the above-described chemical agent and then removing the agent slowly by diafiltration.

In order to form the colloid dispersion in an aqueous medium, the presence of a dispersing auxiliary, such as a surfactant, a surface-activating polymer, and a hydrophilic polymer is usually required. Such a dispersing auxiliary is described in U.S. Pat. No. 5,008,179 (cols. 13 and 14) of Chari et al., and U.S. Pat. No. 5,104,776 (cols. 7 to 13) of Bagchi and Sargeant. These can be appropriately used.

In the present invention, the number-average particle size of the fine crystalline particle dispersion is preferably from 0.001 to 5 $\mu$m, and more preferably from 0.001 to 0.5 $\mu$m.

The heat-developable photosensitive material of the present invention has, on a support, a color-developing agent on the same side on which a photosensitive silver halide and a reducible silver salt are included.

The amount to be added of the developing agent in the present invention may vary within a wide range, and the amount is preferably 0.01 to 100 molar times, more preferably 0.1 to 10 molar times the amount of the coupler compound.

Further, in order to enhance dispersion stability of the dispersion of fine crystals, the water-solubility of the color-developing agent for use in the present invention is preferably 1 g/m$^3$ or less, and more preferably $10^{-3}$ g/m$^3$ or less.

Furthermore, the melting point of the color-developing agent for use in the present invention is preferably in the range of 80 to 300° C.

Preferably, the color-developing agent is compatible with the thermal solvent to be used in combination, in the present invention. Further, the color-developing agent is preferably incompatible with the coupler to be used in combination, in the present invention.

(C) Coupler

The heat-developable light-sensitive material of the present invention has a coupler compound, on the same side as that of a photosensitive silver halide, a binder, and a reducible silver salt, on the support. The coupler compound for use in the present invention is a compound which is called coupler and is known in photographic industries. A 2-equivalent or 4-equivalent coupler can be used. Examples of the coupler for photography that can be used include the functional couplers explained by Nobuo Furutate, in "Organic Compounds for Conventional Color Photography", Journal of The Society of Synthetic Organic Chemistry, Japan, Vol. 41, p. 439, 1983) and the couplers whose details are described in Research Disclosure 37038 (February, 1995), pages 80–85 and pages 87–89.

Examples of the coupler for forming a yellow dye image include pivaloylacetamide-type couplers, benzoylacetamide-type couplers, malonic diester-type couplers, malonic diamide-type couplers, dibenzoylmethane-type couplers, benzothiazolylacetamide-type couplers, malonic ester monoamide-type couplers, benzoxazolylacetamide-type couplers, benzimidazolylacetamide-type couplers, benzothiazolylacetamide-type couplers, cycloalkylcarbonylacetamide-type couplers, indoline-2-ylacetamide-type couplers, quinazoline-4-one-2-ylacetamide-type couplers described in U.S. Pat. No. 5,021,332, benzo-1,2,4-thiadiazine-1,1-dioxide-3-ylacetamide-type couplers described in U.S. Pat. No. 5,021,330, couplers described in EP 421221A, couplers described in U.S. Pat. No. 5,455,149, couplers described in EP 0622673A, and 3-indoloylacetamide-type couplers described in EP 0953871A, 0953872A, and 0953873A.

Examples of the coupler for forming a magenta dye image include 5-pyrazolone-type couplers, 1H-pyrazolo[1,5-a]benzimidazole-type couplers, 1H-pyrazolo[5,1-c][1,2,4]triazole-type couplers, 1H-pyrazolo[1,5-b][1,2,4]triazole-type couplers, 1H-imidazo[1,2-b]pyrazole-type couplers, cyanoacetophenone-type couplers, active propene-type couplers described in WO93/01523, enamine-type couplers described in WO93/075342, 1H-imidazo[1,2-b][1,2,4]triazole-type couplers, and couplers described in U.S. Pat. No. 4,871,652.

Examples of the coupler for forming a cyan dye image include phenol-type couplers, naphthol-type couplers, 2,5-diphenylimidazole-type couplers described in EP 0249453A, 1H-pyrrolo[1,2-b][1,2,4]triazole-type couplers, 1H-pyrrolo[2,1-c][1,2,4]triazole-type couplers, pyrrole-type couples described in JP-A-4-188137 and JP-A-4-190347, 3-hydroxypyridine-type couples described in JP-A-1-315736, pyrrolopyrazole-type couplers described in U.S. Pat. No. 5,164,289, pyrroloimidazole-type couplers described in JP-A-4-174429, pyrazolopyrimidine-type couplers described in U.S. Pat. No. 4,950,585, pyrrolotriazine-type couplers described in JP-A-4-204730, couplers described in U.S. Pat. No. 4,746,602, couplers described in U.S. Pat. No. 5,104,783, couplers described in U.S. Pat. No. 5,162,196, and couplers described in European Patent No. 0556700.

Specific examples of the representative coupler compounds that can be used in the present invention are given below, but it should be understood that the present invention is not restricted to these specific examples.

CP-101

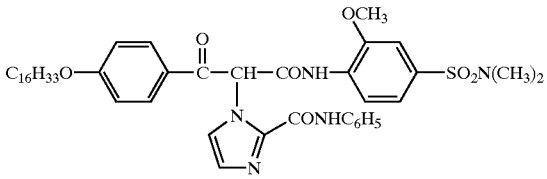

CP-102

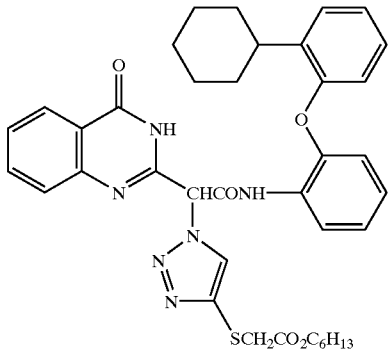

CP-103

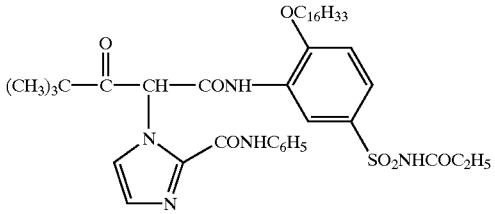

CP-104

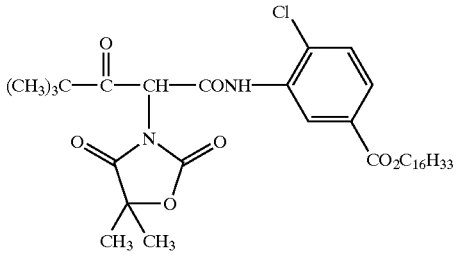

CP-105

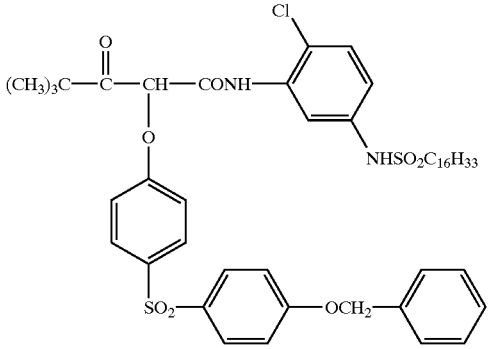

CP-106

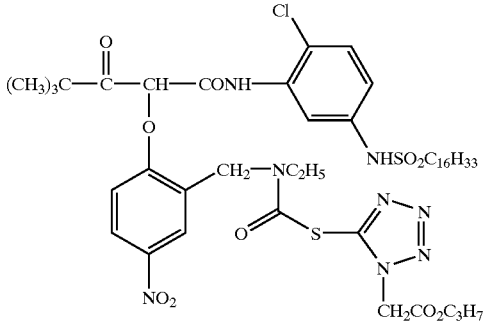

5
-continued
CP-107
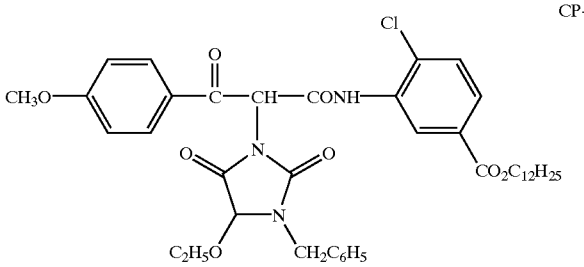
CP-108
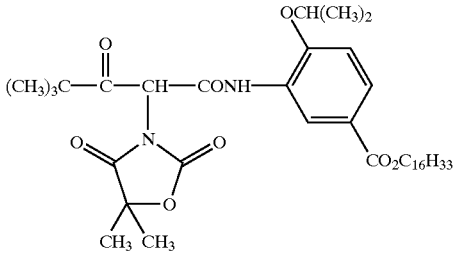
CP-109
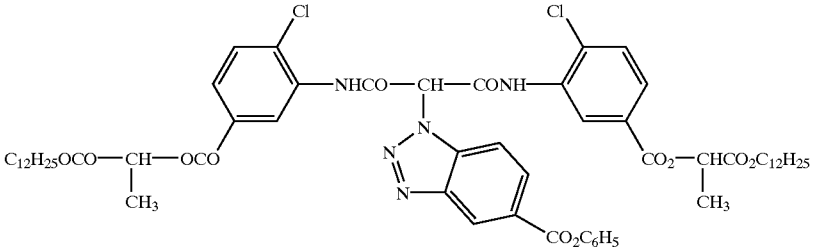
CP-110
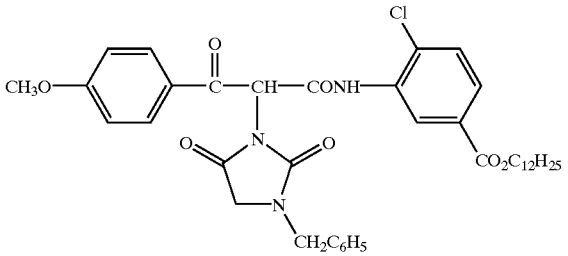
CP-111
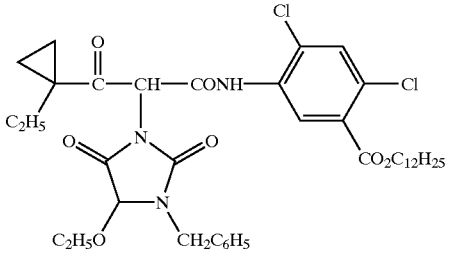
CP-112
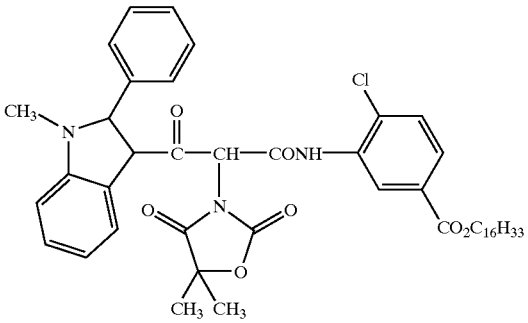
CP-113
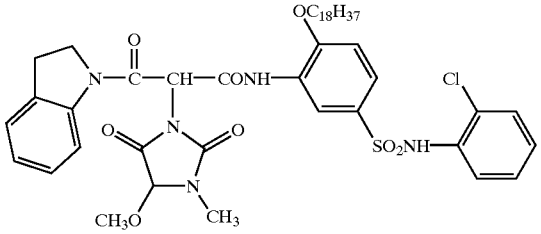
CP-114
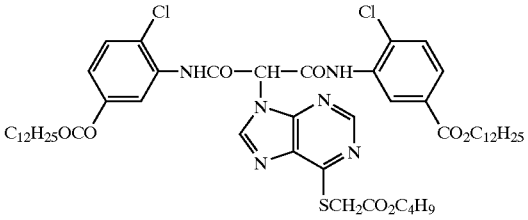
CP-115
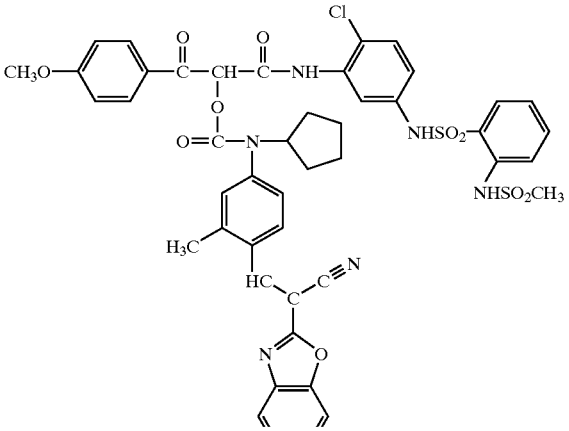

The above-described coupler compounds for use in the present invention can be easily synthesized by methods described in the patents and the like relating to couplers, as listed above, and known in photographic industries.

The coupler compound for use in the present invention can be introduced into a layer of the photosensitive material by well-known methods such as a method described in U.S. Pat. No. 2,322,027. In this case, a high-boiling organic solvent, which is described in U.S. Pat. Nos. 4,555,470, 4,536,466, 4,536,477, 4,587,206, 4,555,476 and 4,599,296, JP-B-3-62,256, and the like, can be used, if necessary, together with a low-boiling organic solvent having a boiling point in the range of 50 to 160° C. Two or more types of each of these dye-providing couplers and high-boiling organic solvents can be used together, respectively.

The amount of the high-boiling organic solvent is generally 10 g or less, preferably 5 g or less, more preferably in the range of 1 g to 0.1 g, per gram of a hydrophobic additive to be dissolved. Further, the amount of the high-boiling organic solvent is preferably 1 ml or less, more preferably 0.5 ml or less, most preferably 0.3 ml or less, per gram of a binder.

A dispersion method that uses a polymer, as described in JP-B-51-39853 and JP-A-51-59943, and a method in which addition of the compound is made after converting into a fine particle dispersion, as described in JP-A-62-30242, and the like, may also be used.

In the case of a compound that is substantially insoluble in water, in addition to the above-mentioned methods, it can be made into fine particles, and contained and dispersed in a binder.

When a hydrophobic compound is dispersed in a hydrophilic colloid, a variety of surface-active agents may be used. Examples of the surface-active agents that can be used include those described in JP-A-59-157636, pages (37) to (38), and in the above-described Research Disclosure. Further, phosphate-type surface-active agents described in JP-A-5-204325 and JP-A-6-19247, and West Germany Patent Publication No. 1,932,299 A, can be used.

Furthermore, a coupler compound can be used by dispersing a powder of it in water by means of a ball mill, a colloid mill, a sand grinder mill, a Manton-Gaulin homogenizer, a microfluidizer or a supersonication, in accordance with a well-known solid dispersion method.

The coupler compound for use in the present invention may be added to any layer only if the layer, to which the coupler compound is added, is on the same side of the support as that of a layer containing a photosensitive silver halide and a layer containing a reducible silver salt. Preferably the coupler compound is added to the layer containing a silver halide or to a layer adjacent thereto.

The amount to be added of the coupler compound for use in the present invention is preferably 0.2 to 200 mmol, more preferably 0.3 to 100 mmol, and further preferably 0.5 to 30 mmol, per mole of silver. The coupler compound may be used singly or in a combination of two or more.

In the case where the photosensitive material of the present invention is used as a photosensitive material for shooting, the amount to be added of the coupler that can be used in the present invention is generally 0.5 to 200 mmol, preferably 2 to 100 mmol, per mol of silver.

The heat-developable photosensitive material of the present invention may comprise at least one coupler comprising a compound which can form a dye having a maximum absorption wavelength in a non-visible range. Such a coupler is preferably a compound represented by any one of the following formulae (3) to (7). Herein, each letter and symbol used to describe the formula is specifically used for each formula.

formula (3)

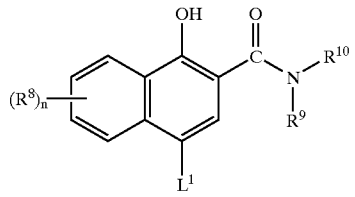

In the formula (3), $R^8$ represents a substituent, n represents an integer of 0 to 5, $R^9$ represents a hydrogen atom, an alkyl group, an aryl group or a heterocyclic group, $R^{10}$ represents an aryl group wherein the total of Hammett σ values of substituents on the aryl group itself is 0.3 or more, or a 5- to 7-membered heterocyclic group, and $L^1$ represents a hydrogen atom or a group capable of being split-off upon reaction with a developing agent oxidized product.

formula (4)

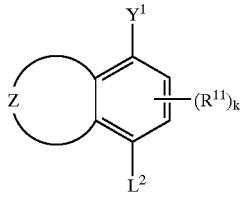

In the formula (4), $R^{11}$ represents a substituent, k represents an integer of 0 to 3, $Y^1$ represents a hydroxyl group or an $(EWG)_2CH$— group, in which EWG represents an electron-withdrawing group, Z represents a group of non-metal atoms which are condensed with the benzene ring to form a 5- to 7-membered nitrogen-containing heterocyclic group, and $L^2$ represents a hydrogen atom or a group capable of being split-off upon reaction with a developing agent oxidized product.

formula (5)

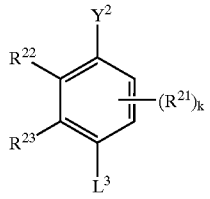

In the formula (5), $R^{22}$ represents a substituent, m is an integer of 0 to 2, $R^{22}$ and $R^{23}$ each independently represent a hydrogen atom or a substituent, $Y^2$ represents a $(EWG)_2CH$— group, $L^3$ represents a hydrogen atom or a group capable of being split-off upon reaction with a developing agent oxidized product. $R^{22}$ and $R^{23}$ may bond to each other to form a carbocycle.

formula (6)

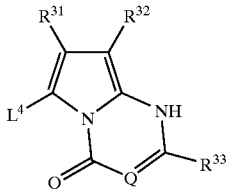

In the formula (6), $R^{31}$ and $R^{32}$ each independently represent an electron-withdrawing group having a Hammett sigma para value of 0.3 or more, an aryl group or a heterocyclic group, $R^{33}$ represents a hydrogen atom or a substituent, Q represents a nitrogen atom or —C($R^{34}$)= in which $R^{34}$ represents a hydrogen atom or a substituent, $L^4$ represents a hydrogen atom or a group capable of being split-off upon reaction with a developing agent oxidized product.

formula (7)

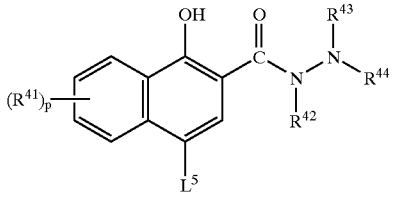

In the formula (7), $R^{41}$ represents a substituent, p represents an integer of 0 to 5, $R^{42}$ represents a hydrogen atom, an alkyl group, an aryl group or a heterocyclic group, $R^{43}$ represents a hydrogen atom, an acyl group, an alkyl group, an aryl group or a heterocyclic group, $R^{44}$ represents an alkylsulfonyl group, an arylsulfonyl group, an acyl group, an aryloxycarbonyl group, an alkoxycarbonyl group or a carbamoyl group, $L^5$ represents a hydrogen atom or a group capable of being split-off upon reaction with a developing agent oxidized product.

Compounds represented by formulas (3) to (7) will be described in detail. In the formula (3), $R^8$ represents a substituent. Specific examples include a halogen atom, an alkyl group (including a cycloalkyl group, a bicycloalkyl group, and the like), an alkenyl group (including a cycloalkenyl group, a bicycloalkenyl group, and the like), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoyl amino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, a silyl group, and the like.

Specific examples of substituents represented by $R^8$ include a halogen atom (e.g., a chlorine atom, a bromine atom, an iodine atom), an alkyl group [which represents a straight-chain, branched-chain or cyclic and substituted or unsubstituted alkyl group, such as an alkyl group (preferably an alkyl group having 1 to 30 carbon atoms, e.g., a methyl group, an ethyl group, a n-propyl group, an isopropyl group, a t-butyl group, a n-octyl group, an eicosyl group, a 2-chloroethyl group, a 2-cyanoethyl group, a 2-ethylhexyl group), a cycloalkyl group (preferably a substituted or unsubstituted cycloalkyl group having 3 to 30 carbon atoms, e.g., a cyclohexyl group, a cyclopentyl group, a 4-n-dodecyl cyclohexyl group), and a bicycloalkyl group (preferably a substituted or unsubstituted bicycloalkyl group having 5 to 30 carbon atoms, that is, a monovalent group obtained by removing one hydrogen atom from a bicycloalkane having 5 to 30 carbon atoms, e.g., a bicyclo[1,2,2]heptane-2-yl group, a bicyclo[2,2,2]octane-3-yl group), in addition, those having a larger number of ring structures such as a tricycloalkyl group are also included; and alkyl groups out of substituents which will be described later (e.g., an alkyl group of an alkylthio group) have the same meaning as described herein]; an alkenyl group [which represents a straight-chain, branched-chain or cyclic and substituted or unsubstituted alkenyl group, such as an alkenyl group (preferably a substituted or unsubstituted alkenyl group having 2 to 30 carbon atoms, e.g., a vinyl group, an allyl group, a prenyl group, a geranyl group, an oleyl group), a cycloalkenyl group (preferably a substituted or unsubstituted cycloalkenyl group having 3 to 30 carbon atoms, that is, a monovalent group obtained by removing one hydrogen atom from a cycloalkene having 3 to 30 carbon atoms, e.g., a 2-cyclopentene-1-yl group, a 2-cyclohexene-1-yl group), a bicycloalkenyl group (a substituted or unsubstituted bicycloalkenyl group, preferably a substituted or unsubstituted bicycloalkenyl group having 5 to 30 carbon atoms, that is, a monovalent group obtained by removing one hydrogen atom from a bicycloalkene having one double bond, e.g., a bicyclo[2,2,1]hepto-2-ene-1-yl group, a bicyclo[2,2,2]octo-2-ene-$^4$-yl group), in addition to these, those having a larger number of ring structures such as a tricycle structure are also included]; an alkynyl group (preferably a substituted or unsubstituted alkynyl group having 2 to 30 carbon atoms, e.g., an ethynyl group, a propargyl group, a trimethylsilylethynyl group); an aryl group (preferably a substituted or unsubstituted aryl group having 6 to 30 carbon atoms, e.g., a phenyl group, a p-tolyl group, a naphthyl group, a m-chlorophenyl group, an o-hexadecanoylaminophenyl group); a heterocyclic group (preferably a 5- or 6-membered and substituted or unsubsituted heterocyclic group, that is a monovalent group obtained by removing one hydrogen atom from an aromatic or non-aromatic heterocyclic compound, more preferably a 5- or 6-membered aromatic heterocyclic group having 3 to 30 carbon atoms, e.g., a 2-furyl group, a 2-thienyl group, a 2-pyrimidinyl group, a 2-benzothiazolyl group); a cyano group; a hydroxyl group; a nitro group; a carboxyl group; an alkoxy group (preferably a substituted or unsubstituted alkoxy group having 1 to 30 carbon atoms, e.g., a methoxy group, an ethoxy group, an isopropoxy group, a t-butoxy group, a n-octyloxy group, a 2-methoxyethoxy group); an aryloxy group (preferably a substituted or unsubstituted aryloxy group having 6 to 30 carbon atoms, e.g., a phenoxy group, a 2-methylphenoxy group, a 4-t-buthylphenoxy group, a 3-nitrophenoxy group, a 2-tetradecanoylaminophenoxy group); a silyloxy group (preferably a silyloxy group having 3 to 20 carbon atoms, e.g., a trimethylsilyloxy group, a t-butyldimethylsilyloxy group); a heterocyclic oxy group (preferably a substituted or unsubstituted heterocyclic oxy group having 2 to 30 carbon atoms, e.g., a 1-phenyltetrazole-5-oxy group, a 2-tetrahydropyranyloxy group); an acyloxy group (preferably a formyloxy group, a substituted or unsubstituted alkylcarbonyloxy group having 2 to 30 carbon atoms, a substituted or unsubstituted arylcarbonyloxy group having 6 to 30 carbon atoms and the like, e.g., a formyloxy group, an acetyloxy group, a pivaloyloxy group, a stealoyloxy group, a benzoyloxy group, a p-methoxyphenylcarbonyloxy group); a carbamoyloxy group (preferably a substituted or unsubstituted carbamoyloxy group having 1 to 30 carbon atoms, e.g., an N,N-dimethylcarbamoyloxy group, an N,N-diethylcarbamoyloxy group, a morpholinocarbonyloxy group, an N,N-di-n-octylaminocarbonyloxy group, an N-n-octylcarbamoyloxy group); an alkoxycarbonyloxy group (preferably a substituted or unsubstituted alkoxycarbonyloxy group having 2 to 30 carbon atoms, e.g., a methoxycarbonyloxy group, an ethoxycarbonyloxy group, a t-butoxycarbonyloxy group, a n-octylcarbonyloxy group); an aryloxycarbonyloxy group (preferably a substituted or unsubstituted aryloxycarbonyloxy group having 7 to 30 carbon atoms, e.g., a phenoxycarbonyloxy group, a p-methoxyphenoxycarbonyloxy group, a p-n-hexadecyloxyphenoxycarbonyloxy group); an amino group (preferably an amino group, a substituted or unsubstituted alkylamino group having 1 to 30 carbon atoms, and a substituted or unsubstituted anilino group having 6 to 30 carbon atoms, e.g., an amino group, a methylamino group, a dimethylamino group, an anilino group, an N-methylanilino group, a diphenylamino group); an acylamino group (preferably a formylamino group, a substituted or unsubstituted alkylcarbonylamino group having 1 to 30 carbon atoms, a substituted or unsubstituted arylcarbonylamino group having 6 to 30 carbon atoms and the like, e.g., a formylamino group, an acetylamino group, a pivaloylamino group, a lauroylamino group, a benzoylamino group, a 3,4,5-tri-n-octyloxyphenylcarbonylamino group); an aminocarbonylamino group (preferably a substituted or unsubstituted aminocarbonylamino group having 1 to 30 carbon atoms, e.g., a carbamoylamino group, an N,N-dimethylaminocarbonylamino group, an N,N-diethylamino carbonylamino group, a morpholinocarbonylamino group); an alkoxycarbonylamino group (preferably a substituted or unsubstituted alkoxycarbonylamino group having 2 to 30 carbon atoms, e.g., a methoxycarbonylamino group, an ethoxycarbonylamino group, a t-butoxycarbonylamino group, a n-octadecyloxycarbonylamino group, an N-methylmethoxycarbonylamino group); an aryloxycarbonylamino group (preferably a substituted or unsubstituted aryloxycarbonylamino group having 7 to 30 carbon atoms, e.g., a phenoxycarbonylamino group, a p-chlorophenoxycarbonylamino group, a m-n-octyloxyphenoxycarbonylamino group); a sulfamoyl amino group (preferably a substituted or unsubstituted sulfamoylamino group having 0 (zero) to 30 carbon atoms, e.g., a sulfamoylamino group, an N,N-dimethylaminosulfonylamino group, an N-n-octyl aminosulfonylamino group); an alkyl- or aryl-sulfonylamino group (preferably a substituted or unsubstituted alkyl sulfonylamino group having 1 to 30 carbon atoms, a substituted or unsubstituted aryl sulfonylamino group having 6 to 30 carbon atoms and the like, e.g., a methyl sulfonylamino group, a butylsulfonylamino group, a phenylsulfonylamino group, a 2,3,5-trichlorophenylsulfonylamino group, a p-methylphenylsulfonylamino group); a mercapto group; an alkylthio group (preferably a substituted or unsubstituted alkylthio group having 1 to 30 carbon atoms, e.g., a methylthio group, an ethylthio group, a n-hexadecyl thio group); an arylthio group (preferably a substituted or unsubstituted arylthio group having 6 to 30 carbon atoms, e.g., a phenylthio group, a p-chlorophenylthio group, a m-methoxyphenylthio group); a heterocyclic thio group (preferably a substituted or unsubstituted heterocyclic thio group having 2 to 30 carbon atoms, e.g., a 2-benzothiazolylthio group, a 1-phenyltetrazol-5-yl thio group); a sulfamoyl group (preferably a substituted or unsubstituted sulfamoyl group having 0 (zero) to 30 carbon atoms, e.g., an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, an N-(N'-phenylcarbamoyl) sulfamoyl group); a sulfo group; an alkyl- or aryl-sulfinyl group (preferably a substituted or unsubstituted alkylsulfinyl group having 1 to 30 carbon atoms, a substituted or unsubstituted arylsulfinyl group having 6 to 30 carbon atoms and the like, e.g., a methylsulfinyl group, an ethylsulfinyl group, a phenylsulfinyl group, a p-methylphenylsulfinyl group); an alkyl- or aryl-sulfonyl group (preferably a substituted or unsubstituted alkylsulfonyl group having 1 to 30 carbon atoms, a substituted or unsubstituted arylsulfonyl group having 6 to 30 carbon atoms and the like, e.g., a methylsulfonyl group, an ethylsulfonyl group, a phenylsulfonyl group, a p-methylphenylsulfonyl group); an acyl group (preferably a formyl group, a substituted or unsubstituted alkylcarbonyl group having 2 to 30 carbon atoms, a substituted or unsubstituted arylcarbonyl group having 7 to 30 carbon atoms and the like, e.g., an acetyl group, a pivaloyl group, a 2-chloroacetyl group, a stearoyl group, a benzoyl group, a p-n-octyloxyphenylcarbonyl group); an aryloxycarbonyl group (preferably a substituted or unsubstituted aryloxycarbonyl group having 7 to 30 carbon atoms, e.g., a phenoxycarbonyl group, an o-chlorophenoxycarbonyl group, a m-nitrophenoxycarbonyl group, a p-t-butylphenoxycarbonyl group); an alkoxycarbonyl group (preferably a substituted or unsubstituted alkoxycarbonyl group having 2 to 30 carbon atoms, e.g., a methoxycarbonyl group, an ethoxycarbonyl group, a t-butoxycarbonyl group, a n-octadecyloxycarbonyl group); a carbamoyl group (preferably a substituted or unsubstituted carbamoyl group having 1 to 30 carbon atoms, e.g., a carbamoyl group, an N-methylcarbamoyl group, an N,N-dimethylcarbamoyl group, an N,N-di-n-octylcarbamoyl group, an N-(methylsulfonyl)carbamoyl group); an aryl- or heterocyclic-azo group (preferably a substituted or unsubstituted aryl azo group having 6 to 30 carbon atoms, a substituted or unsubstituted heterocyclic azo group having 3 to 30 carbon atoms and the like, e.g., a phenylazo group, a p-chlorophenylazo group, a 5-ethylthio-1,3,4-thiadiazole-2-yl azo group); an imido group (preferably an N-succinimido group, an N-phthalimido group); a phosphino group (preferably a substituted or unsubstituted phosphino group having 2 to 30 carbon atoms, e.g., a dimethylphosphino group, a diphenylphosphino group, a methylphenoxyphosphino group); a phosphinyl group (preferably a substituted or unsubstituted phosphinyl group having 2 to 30 carbon atoms, e.g., a phosphinyl group, a dioctyloxyphosphinyl group, a diethoxyphosphinyl group); a phosphinyloxy group (preferably a substituted or unsubstituted phosphinyloxy group having 2 to 30 carbon atoms, e.g., a diphenoxyphosphinyloxy group, a dioctyloxyphosphinyloxy group); a phosphinylamino group (preferably a substituted or unsubstituted phosphinylamino group having 2 to 30 carbon atoms, e.g., a dimethoxyphosphinylamino group, a dimethylaminophosphinylamino group); and a silyl group (preferably a substituted or unsubstituted silyl group having 3 to 30 carbon atoms, e.g., a trimethylsilyl group, a t-butyldimethylsilyl group, a phenyldimethylsilyl group). n represents an integer of 0 (zero) to 5.

$R^9$ represents a hydrogen atom, an alkyl group, an aryl group or a heterocyclic group, which are the same alkyl, aryl or heterocyclic group described as the group represented by $R^8$.

$R^{10}$ represents an aryl group wherein the sum total of Hammett σ values of substituents on the aryl group itself is 0.3 or more, or a 5- to 7-membered heterocyclic group. In the case in which $R^{10}$ represents an aryl group, a sigma para ($\sigma_p$) value is adopted for a substituent at the ortho or para position to the nitrogen atom to which $R^{10}$ is bonded, or at a position corresponding thereto from an electronic viewpoint, and a sigma meta ($\sigma_m$) value is adopted for a substituent at the meta position to the nitrogen atom to which $R^{10}$ is bonded or at a position corresponding thereto. In this case, the value obtained by summing up the a values of the respective substituents is set to 0.3 or more. In the present specification, the σ values described in "A Survey of Hammett Substituent Constants and Resonance and Field Parameters", (Chem. Rev. 1991, 91, pp. 165–195), which is a document written by C. Hansch et al., are employed. In the case in which $R^{10}$ represents a heterocyclic group, $R^{10}$ is the same heterocyclic group as described for the group represented by $R^8$.

$L^1$ represents a hydrogen atom or, a group which can split-off upon reaction with a developing agent oxidized product. Examples of the group capable of split-off upon reaction with a developing agent oxidized product include a halogen atom, an alkoxy group, an aryloxy group, a heterocyclic oxy group, an acyloxy group, an alkoxycarbonyloxy group, a carbamoyloxy group, a sulfonyloxy group, a carbonamido group, a sulfonamido group, a carbamoylamino group, an arylazo group, an alkylthio group, an arylthio group, a heterocyclic thio group, and a nitrogen-containing heterocyclic group which bonds to a coupling activating position through its nitrogen atom. Preferred scopes of the halogen atom and the group which can spilt-off, and specific examples thereof are the same as described for the group represented by $R^8$. The nitrogen-containing heterocyclic group which bonds to a coupling activating position through the nitrogen atom is a 5- or 6-membered aromatic nitrogen-containing heterocyclic group having 3 to 30 carbon atoms. Examples thereof include pyrazole-1-yl, imidazole-1-yl, 1,2,4-triazole-1-yl, 1,2,3-triazole-1-yl or -2-yl, benzotriazole-1-yl or -2-yl, tetrazole-1-yl, and the like. $L^1$ may form a bis-form coupler wherein two molecules of a 4-equivalent coupler are bonded to each other through an aldehyde or a ketone. $L^1$ may be a photographically useful group, such as a development accelerator, a development restrainer, a desilvering accelerator, or a Leuco dye; or a precursor thereof.

In the case in which the group represented by each of $R^8$, $R^9$, $R^{10}$ and $L^1$ can be further substituted, the group represented by each of $R^8$, $R^9$, $R^{10}$ and $L^1$ may have a substituent. In this case, preferred examples of the substituent are the same substituents as described for $R^8$. In the case in which the group represented by each of $R^8$, $R^9$, $R^{10}$, and $L^1$ is substituted with two or more substituents, these substituents may be the same or different.

In the formula (4), $R^{11}$ represents the same group as described as $R^8$. k is an integer of 0 to 3. $Y^1$ represents a hydroxyl group or an $(EWG)_2CH$— group, wherein EWG represents an electron withdrawing group. EWG is preferably a substituent having 0.3 or more of a Hammett sigma para value ($\sigma_p$), and examples thereof include heterocyclic, cyano, nitro, sulfamoyl, alkyl and aryl sulfinyl, alkyl and aryl sulfonyl, acyl, aryloxycarbonyl, alkoxycarbonyl and carbamoyl groups. A preferred scope of these groups and specific examples thereof are the same as described for the group represented by $R^8$. Two EWG groups may be the same or different.

In the formula (4), Z represents a group of non-metal atoms which is condensed with the benzene ring to form a 5- to 7-membered nitrogen-containing heterocyclic group, and $L^2$ represents a hydrogen atom or a group which can spilt-off upon reaction with a developing agent oxidized product, which is the same group as described as $L^1$ in formula (3).

In the case in which the group represented by each of $R^{11}$, an EWG group, and $L^2$ can be further substituted, the group represented by each of $R^{11}$, an EWG group and $L^2$ may have a substituent. In this case, preferred examples of the substituent are the same substituents as described as $R^8$. In the case in which the group represented by each of $R^{11}$, an EWG group, and $L^2$ is substituted with two or more substituents, these substituents may be the same or different.

In the formula (5), $R^{21}$ represents a substituent, and examples thereof are the same as described as $R^8$. m is an integer of 0 to 2. $R^{22}$ and $R^{23}$ each independently represent a hydrogen atom or a substituent, and examples of the substituent are the same group as described as $R^8$. $R^{22}$ and $R^{23}$ may bond to each other to form a carbon ring. $Y^2$ represents an $(EWG)_2CH$— group wherein EWG represents the same group as described as EWG in formula (4). $L^3$ represents a hydrogen atom or a group which can spilt-off upon reaction with a developing agent oxidized product, which is the same group as described as $L^1$ in formula (3). In the case in which the group represented by each of $R^{21}$, an EWG group and $L^3$ can be further substituted, the group represented by each of $R^{21}$, an EWG group and $L^3$ may have a substituent. In this case, preferred examples of the substituent are the same substituents as described for $R^8$. In the case in which the group represented by each of $R^{21}$, EWG, and $L^3$ is substituted with two or more substituents, these substituents may be the same or different.

In the formula (6), $R^{31}$ and $R^{32}$ each independently represent an electron withdrawing group having a Hammett sigma para value of 0.3 or more, an aryl group or a heterocyclic group. In the case in which $R^{31}$ and/or $R^{32}$ represent(s) an electron withdrawing group having a Hammett sigma para value of 0.3 or more, $R^{31}$ and/or $R^{32}$ preferably represent(s) a cyano group, a nitro group, a sulfamoyl group, an alkyl- or aryl-sulfinyl group, an alkyl- or aryl-sulfonyl group, an acyl group, an aryloxycarbonyl group, an alkoxycarbonyl group, or a carbamoyl group. A preferred scope of these groups and specific examples thereof are the same as described as the group represented by $R^8$. The aryl group and heterocyclic group represented by $R^{31}$ and/or $R^{32}$ represent the same aryl and heterocyclic group as described as the group represented by $R^8$.

$R^{33}$ represents a hydrogen atom or a substituent, and examples of the substituent are the same group as described for $R^8$. Q represents a nitrogen atom or —$C(R^{34})$=. $R^{34}$ represents a hydrogen atom or a substituent, and examples of the substituent are the same group as described for $R^8$. $L^4$ represents a hydrogen atom or a group which can spilt-off upon reaction with a developing agent oxidized product, and is the same group as described as $L^1$ in formula (3). In the case in which the group represented by each of $R^{31}$, $R^{32}$, $R^{33}$, $R^{34}$, and $L^4$ can be further substituted, the group represented by each of $R^{31}$, $R^{32}$, $R^{33}$, $R^{34}$, and $L^4$ may have a substituent. In this case, preferred examples of the substituent are the same substituents as described as $R^8$. In the case in which the group represented by each of $R^{31}$, $R^{32}$, $R^{33}$, $R^{34}$, and $L^4$ is substituted with two or more substituents, these substituents may be the same or different.

In the formula (7), $R^{41}$ represents a substituent, and examples of the substituent are the same as described as $R^8$.

p is an integer of 0 to 5. $R^{42}$ represents a hydrogen atom, an alkyl group, an aryl group or a heterocyclic group. $R^{43}$ represents a hydrogen atom, an acyl group, an alkyl group, an aryl group, or a heterocyclic group. $R^{44}$ represents an alkylsulfonyl group, an arylsulfonyl group, an acyl group, an aryloxycarbonyl group, an alkoxycarbonyl group, or a carbamoyl group. A preferred scope of these groups and specific examples thereof are the same as described as the group represented by $R^8$. $L^5$ represents a hydrogen atom or a group which can spilt-off upon reaction with a developing agent oxidized product, which is the same group as described as $L^1$ in formula (3). In the case in which the group represented by each of $R^{41}$, $R^{42}$, $R^{43}$, $R^{44}$, and $L^5$ can be further substituted, the group represented by each of $R^{41}$, $R^{42}$, $R^{43}$, $R^{44}$, and $L^5$ may have a substituent. In this case, preferred examples of the substituent are the same substituents as described as $R^8$. In the case in which the group represented by each of $R^{41}$, $R^{42}$, $R^{43}$, $R^{44}$, and $L^5$ is substituted with two or more substituents, these substituents may be the same or different.

The following will describe preferred scopes of the compounds represented by the formulae (3) to (7). In the formula (3), $R^8$ is preferably a halogen atom, or a cyano, nitro, acylamino, aminocarbonylamino, alkoxycarbonylamino, aryloxycarbonylamino, sulfamoylamino, alkyl- or aryl-sulfonylamino, sulfamoyl, alkyl- or aryl-sulfinyl, alkyl- or aryl-sulfonyl, acyl, aryloxycarbonyl, alkoxycarbonyl, carbamoyl, imido, or phosphinylamino group; and is more preferably a cyano, acylamino, alkyl- or aryl-sulfonylamino, sulfamoyl, alkyl- or aryl-sulfinyl, alkyl- or aryl-sulfonyl, or phosphinylamino group. $R^8$ is particularly preferably a cyano, sulfamoyl, alkylarylsulfinyl, arylsulfinyl, alkylsulfonyl or arylsulfonyl group, when exists at the 6-position and/or 7-position of the naphthol ring or an acylamino, alkylsulfonylamino, arylsulfonylamino or phosphinoylamino group when exists at the 5-position and/or 8-position of the naphthaol.

In the formula (3), $R^9$ is preferably a hydrogen atom or an alkyl group, and is most preferably a hydrogen atom. $R^{10}$ preferably has, as a substituent or substituents, at least one group selected from a halogen atom, an alkyl group, a cyano group, a hydroxyl group, a nitro group, a carboxyl group, an alkoxy group, an aryloxy group, an amino group (including anilino group), an acylamino group, an aminocarbonylamino group, an alkoxycarbonylamino group, an aryloxycarbonylamino group, a sulfamoylamino group, an alkylsulfonylamino group, an arylsulfonylamino group, an alkylthio group, an arylthio group, a heterocyclic thio group, a sulfamoyl group, an alkylsulfinyl group, an arylsulfinyl group, an alkylsulfonyl group, an arylsulfonyl group, an acyl group, an alkoxycarbonyl group, a carbamoyl group, and an imido group. At the same time, $R^{10}$ preferably is a phenyl group, naphthyl group or heterocyclic group, in which the total sum of the sigma values of its substituents is 0.3 or more. A phenyl group or naphthyl group in which the total sum of the sigma values of its substituents is 0.5 or more, a thiazole group which may have a substituent, or a benzothiazole ring which may have a substituent is more preferred. The following will illustrate preferred specific examples of the group represented by $R^{10}$. However, the present invention is never limited by these examples.

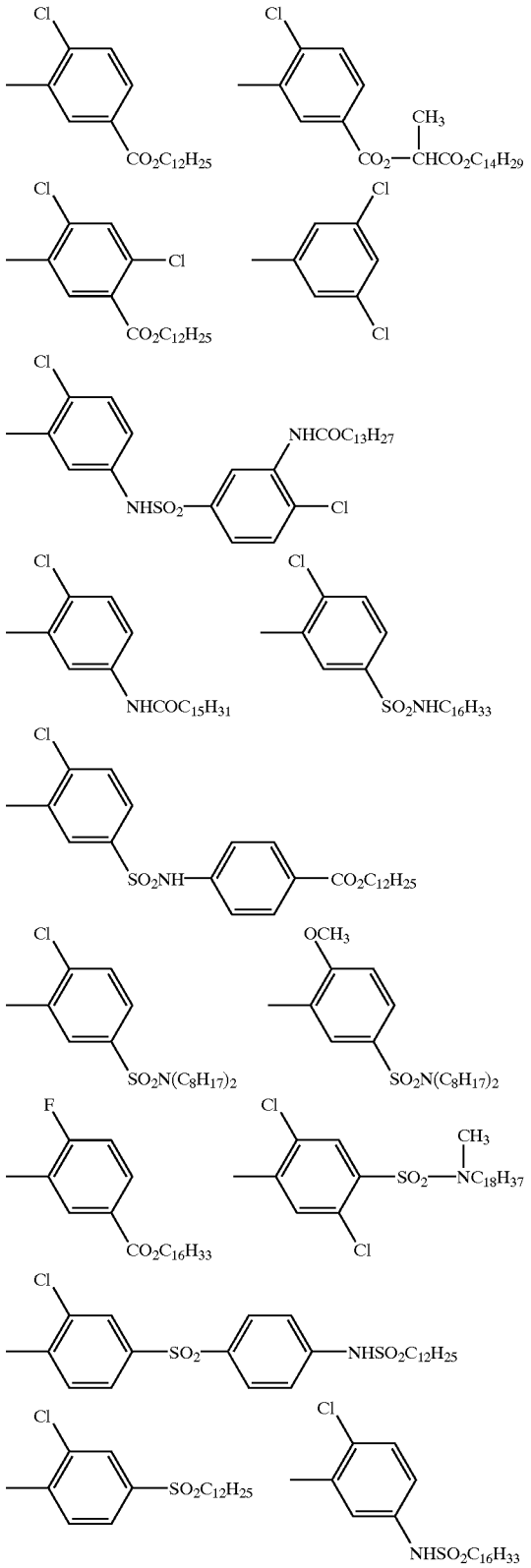

-continued
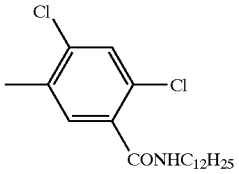
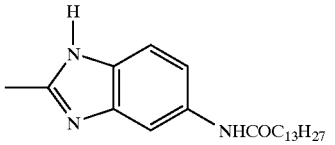
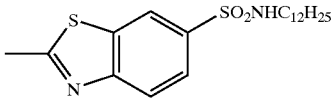
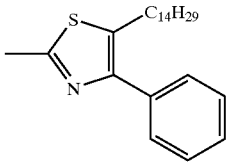
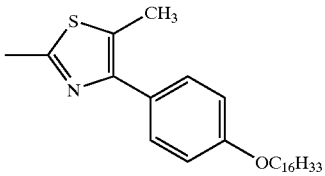
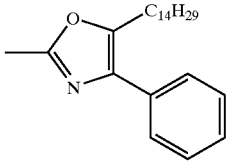
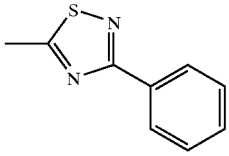
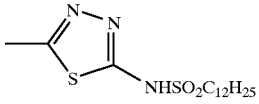
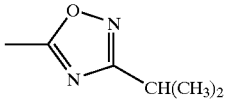
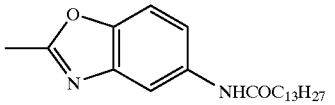
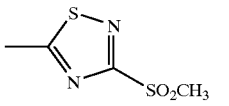
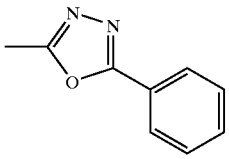
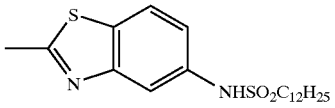
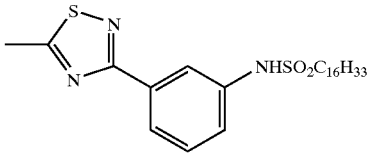
-continued
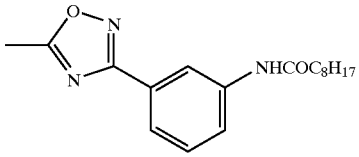
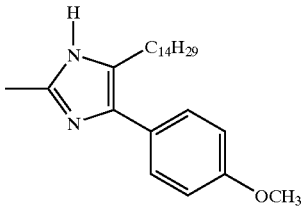
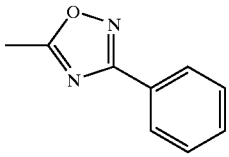
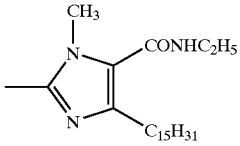
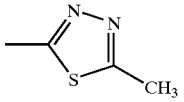
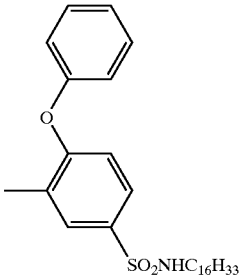
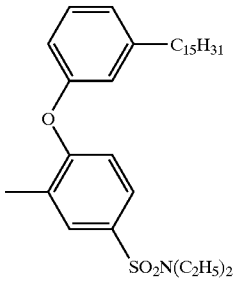
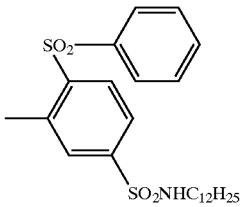
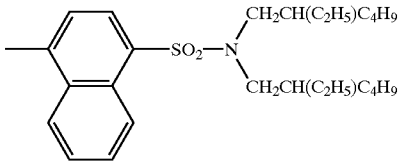
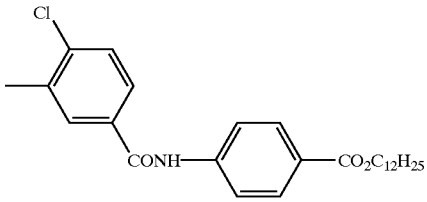
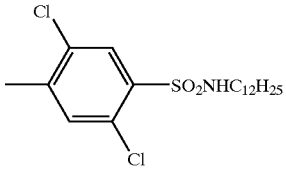

-continued

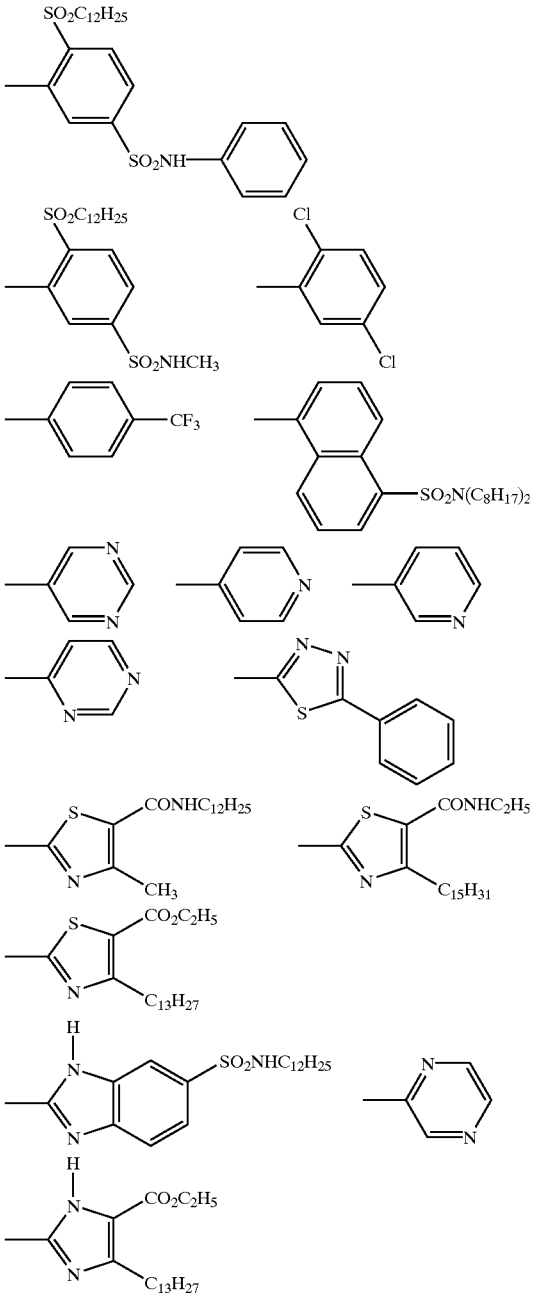

In the formula (3), $L^1$ is preferably a hydrogen atom, a halogen atom, an alkoxy group, an aryloxy group, a heterocyclic oxy group, an acyloxy group, an alkoxycarbonyloxy group, a carbamoyloxy group, an alkylthio group, an arylthio group, and a heterocyclic thio group; and more preferably a hydrogen atom, a halogen atom, an alkoxy group, an aryloxy group, an alkoxycarbonyloxy group, and a carbamoyloxy group.

In the formula (4), $R^{11}$ is preferably a halogen atom, a cyano group, a nitro group, an acylamino group, an aminocarbonylamino group, an alkoxycarbonylamino group, an aryloxycarbonylamino group, a sulfamoylamino group, an alkyl or aryl sulfonylamino group, a sulfamoyl group, an alkyl or aryl sulfinyl group, an alkyl or aryl sulfonyl group, an acyl group, an aryloxycarbonyl group, an alkoxycarbonyl group, a carbamoyl group, an imido group, or a phosphinylamino group; and the case in which $R^{11}$ at the ortho position to $Y^1$ becomes a cyano group, a sulfamoyl group or a carbamoyl group is particularly preferred. $Y^1$ is preferably a hydroxyl group or $(EWG)_2CH$— group, wherein EWG is a cyano group, a nitro group, an alkylsulfinyl group, an arylsulfinyl group, an alkylsulfonyl group, an arylsulfonyl group, an acyl group, an alkoxycarbonyl group or a carbamoyl group. The nitrogen-containing heterocycle formed by condensing Z with the benzene ring is preferably a 6-membered ring, and is particularly preferably a pyridine ring, a pyridazine ring, a pyrimidine ring, or a pyrazine ring. $L^2$ is preferably a hydrogen atom, a halogen atom, an alkoxy group, an aryloxy group, a heterocyclic oxy group, an acyloxy group, an alkoxycarbonyloxy group, a carbamoyloxy group, an alkylthio group, an arylthio group, or a heterocyclic thio group; and is more preferably a hydrogen atom, a halogen atom, an alkoxy group, an aryloxy group, an alkoxycarbonyloxy group, or a carbamoyloxy group.

In the formula (5), $R^{21}$, $R^{22}$ and $R^{23}$ are preferably a halogen atom, a cyano group, a nitro group, an acylamino group, an aminocarbonylamino group, an alkoxycarbonylamino group, an aryloxycarbonylamino group, a sulfamoylamino group, an alkyl or aryl sulfonylamino group, a sulfamoyl group, an alkyl or aryl sulfinyl group, an alkyl or aryl sulfonyl group, an acyl group, an aryloxycarbonyl group, an alkoxycarbonyl group, a carbamoyl group, an imido group, or a phosphinylamino group. $R^{21}$ is particularly preferably a cyano group, sulfamoyl group, or carbamoyl group which positions ortho to $Y^2$. Preferably, $R^{22}$ and $R^{23}$ bond to each other to form a naphthalene ring, together with the benzene ring having $Y^2$. $Y^2$ is preferably a hydroxyl group or $(EWG)_2CH$— group, wherein EWG is a cyano group, a nitro group, an alkylsulfinyl group, an arylsulfinyl group, an alkylsulfonyl group, an arylsulfonyl group, an acyl group, an alkoxycarbonyl group, or a carbamoyl group. $L^3$ is preferably a hydrogen atom, a halogen atom, an alkoxy group, an aryloxy group, a heterocyclic oxy group, an acyloxy group, an alkoxycarbonyloxy group, a carbamoyloxy group, an alkylthio group, an arylthio group, or a heterocyclic thio group, and is more preferably a hydrogen atom, a halogen atom, an alkoxy group, an aryloxy group, an alkoxycarbonyloxy group, or a carbamoyloxy group.

In the formula (6), $R^{31}$ and $R^{32}$ are preferably an aryl group, a heterocyclic group, a cyano group, a sulfamoyl group, an alkylsulfonyl group, an aryl sulfonyl group, an acyl group, an alkoxycarbonyl group, or a carbamoyl group; and more preferably an aryl group, a cyano group, an alkoxycarbonyl group or a carbamoyl group. $R^{33}$ is preferably an alkyl group, an aryl group, a heterocyclic group, an amino group (including anilino group), an acylamino group, an aminocarbonylamino group, an alkoxycarbonylamino group, an alkyl sulfonylamino group, an aryl sulfonylamino group, an alkyl thio group, an aryl thio group, a heterocyclic thio group, and a phosphinylamino group; more preferably an amino group (including anilino group), an acylamino group, an aminocarbonylamino group, an alkoxycarbonylamino group, an alkyl sulfonylamino group, an aryl sulfonylamino group, or an alkyl thio group. Q is preferably a nitrogen atom, or —$C(R^{34})$=wherein $R^{34}$ is an acyl group, an alkoxycarbonyl group or a carbamoyl group. $L^4$ is preferably a hydrogen atom, a halogen atom, an alkoxy group, an aryloxy group, a heterocyclic oxy group, an acyloxy group, an alkoxycarbonyloxy group, a carbamoyloxy group, an alkylthio group, an arylthio group, or a heterocyclic thio group; and more preferably a hydrogen atom or a halogen atom.

In the formula (7), $R^{41}$ is preferably a halogen atom, a cyano group, a nitro group, an acylamino group, an aminocarbonylamino group, an alkoxycarbonylamino group, an aryloxycarbonylamino group, a sulfamoylamino group, an alkyl or aryl sulfonylamino group, a sulfamoyl group, an alkyl or aryl sulfinyl group, an alkyl or aryl sulfonyl group, an acyl group, an aryloxycarbonyl group, an alkoxycarbonyl group, a carbamoyl group, an imido group, or a phosphinylamino group. $R^{41}$ is particularly preferably a cyano, sulfamoyl, alkylarylsulfinyl, arylsulfinyl, alkylsulfonyl or arylsulfonyl group when exists at the 6-position and/or 7-position of the naphthol ring, or an acylamino, alkylsulfonylamino, arylsulfonylamino or phosphinoylamino group when exists at the 5-position and/or 8-position of the naphthaol ring. $R^{42}$ is preferably a hydrogen atom. $R^{43}$ is preferably a hydrogen atom or an acyl group. $R^{44}$ is preferably an acyl group, an alkoxycarbonyloxy group, and a carbamoyl group. Preferably, $R^{43}$ and $R^{44}$ bond to each other to form an imido ring. $L^5$ is preferably a hydrogen atom, a halogen atom, an alkoxy group, an aryloxy group, a heterocyclic oxy group, an acyloxy group, an alkoxycarbonyloxy group, a carbamoyloxy group, an alkylthio group, an arylthio group, and a heterocyclic thio group, and more preferably a hydrogen atom and a halogen atom.

The compounds represented by the formulae (3) to (7) can be synthesized by the method described in JP-A-53-129036, 55-21094, 55-21095, 61-86752, 63-88551, 2000-26465, 2000-38388, 2000-44564, 2000-310841, 2000-310842, 2000-330245, 2000-229970 or the like.

The compound represented by formulas (3) to (7), for use in the present invention, may be added to any layer only if the layer to which the compound is added is on the same side of the support as that of a layer containing a photosensitive silver halide and a layer containing a reducible silver salt. Preferably the compound is added to the layer containing a silver halide or to a layer adjacent thereto.

The amount to be added of the compound represented by formulas (3) to (7), for use in the present invention, is preferably 0.2 to 200 mmol, more preferably 0.3 to 100 mmol, and further preferably 0.5 to 30 mmol, per mole of silver. The coupler compounds may be used singly or in a combination of two or more.

Specific examples of the compounds represented by formulas (3) to (7) are shown below, but it should be understood that the present invention is not restricted to these specific examples.

(1)-1

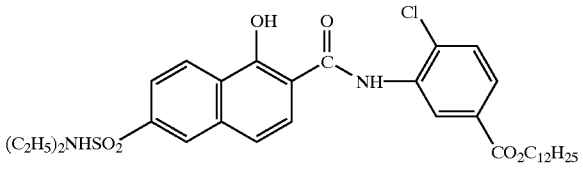

(1)-2

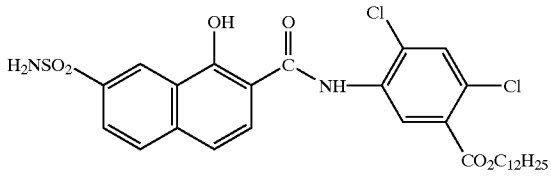

-continued (1)-3

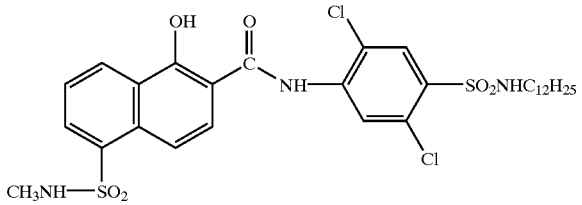

(1)-4

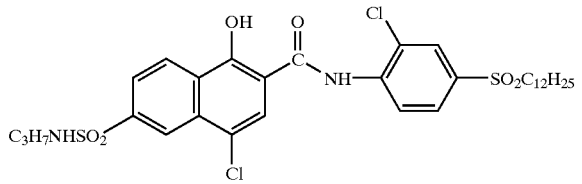

(1)-5

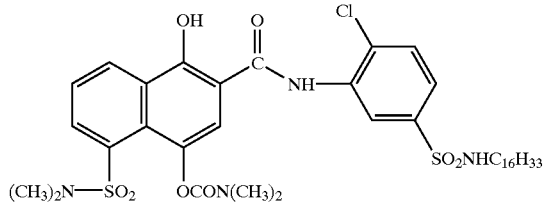

(1)-6

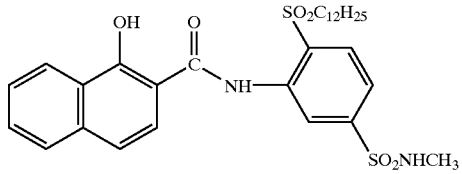

(1)-7

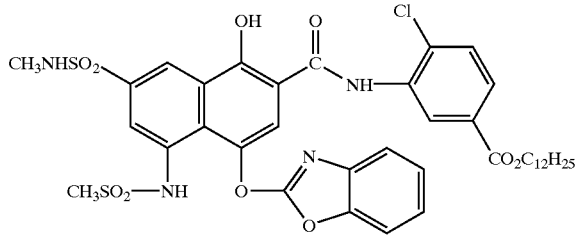

(1)-8

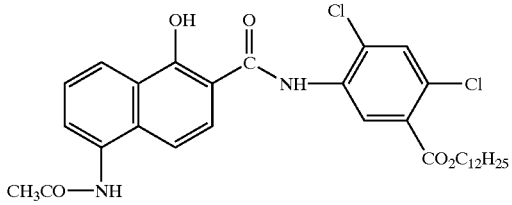

-continued
(1)-9
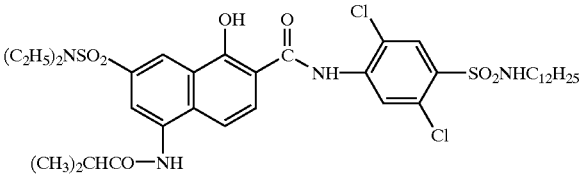
(1)-10
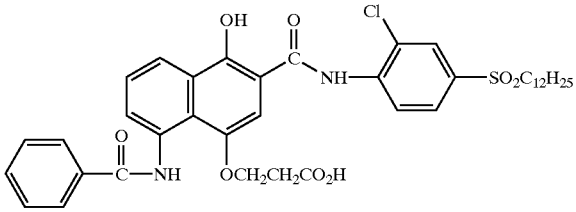
(1)-11
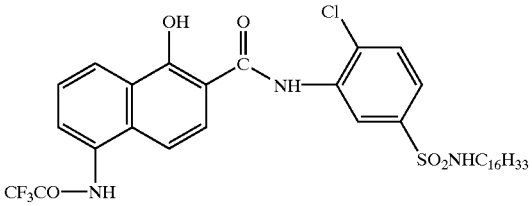
(1)-12
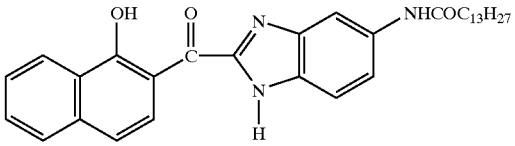
(1)-13
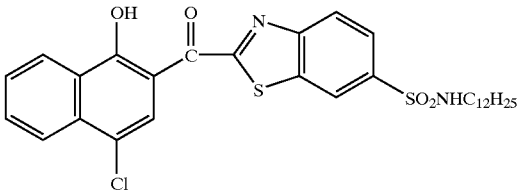
(1)-14
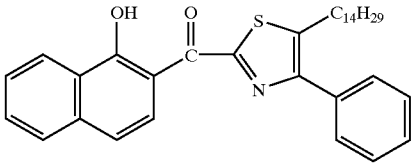
(1)-15
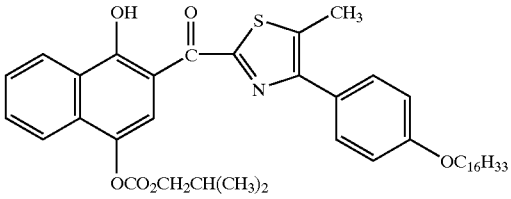
-continued
(1)-16
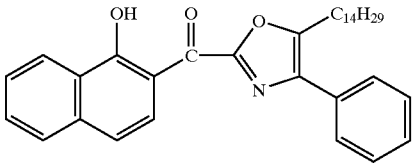
(1)-17
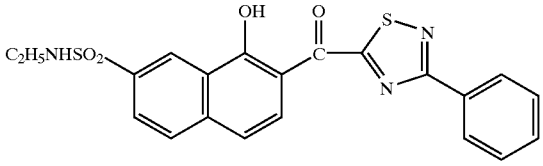
(1)-18
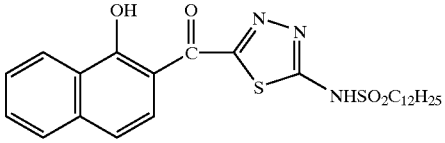
(1)-19
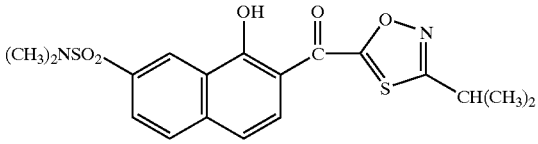
(1)-20
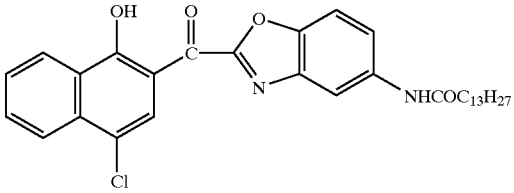
(1)-21
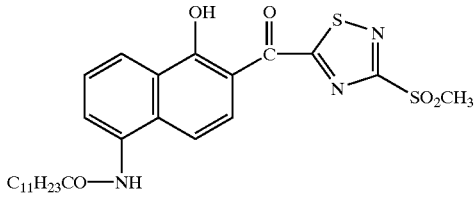
(1)-22
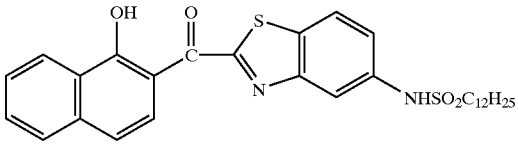
(1)-23
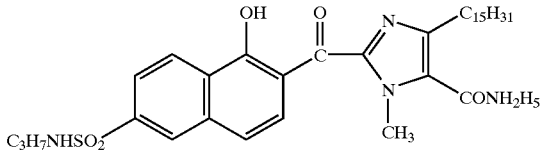

-continued
(1)-24
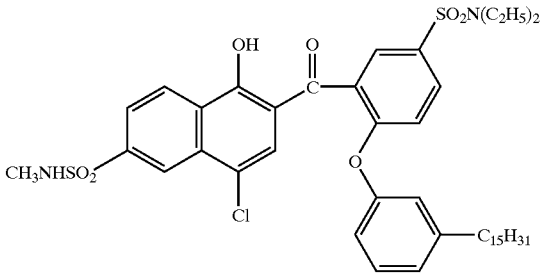
(1)-25
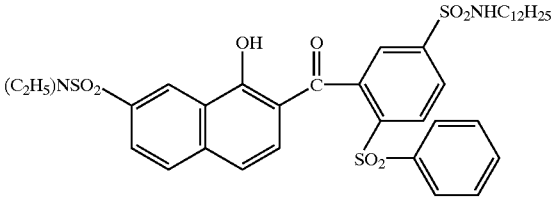
(1)-26
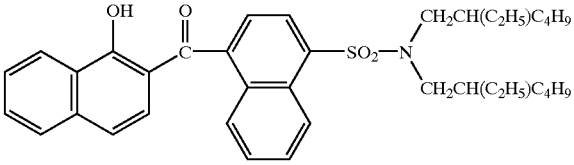
(1)-27
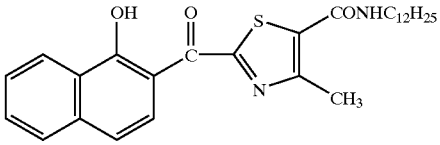
(1)-28
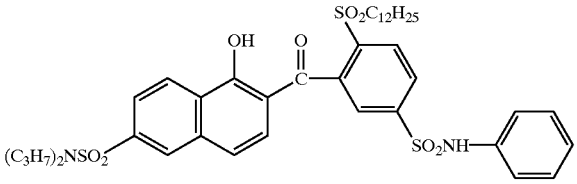
(1)-29
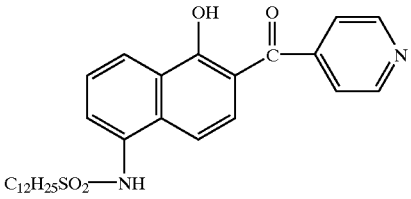
(1)-30
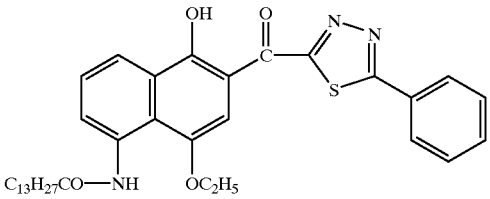
-continued
(1)-31
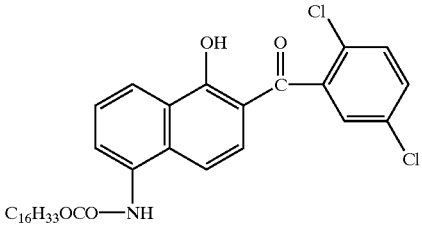
(1)-32
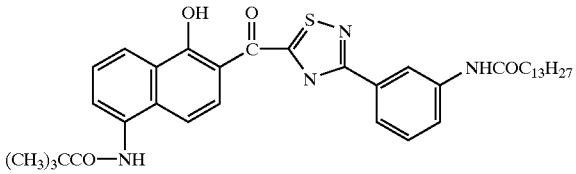
(1)-33
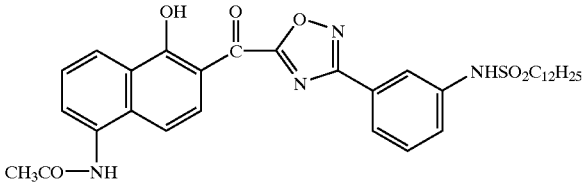
(1)-34
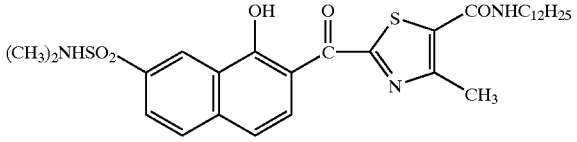
(1)-35
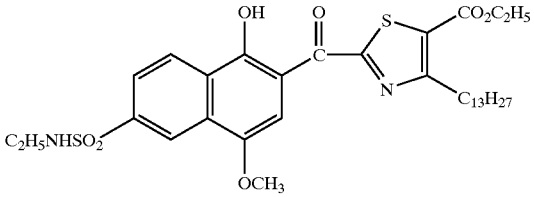
(1)-36
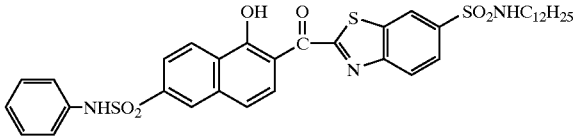
(1)-37
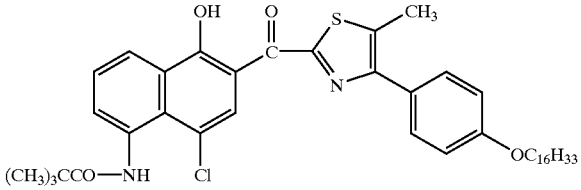

-continued
(1)-38
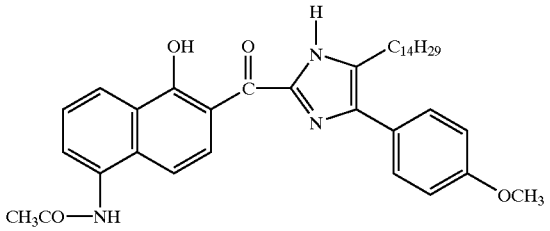
(1)-39
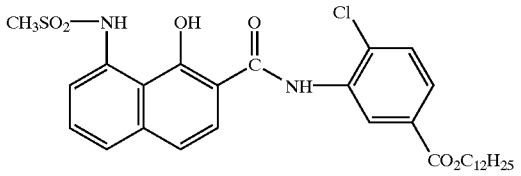
(1)-40
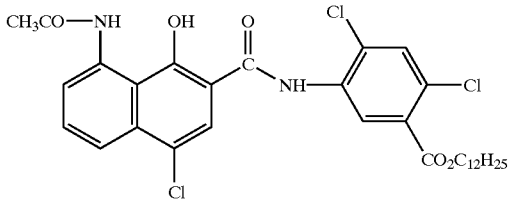
(1)-41
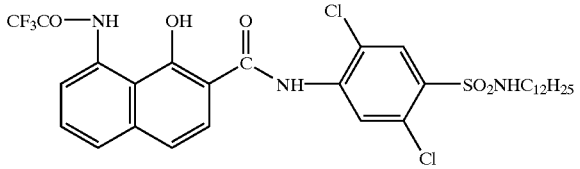
(1)-42
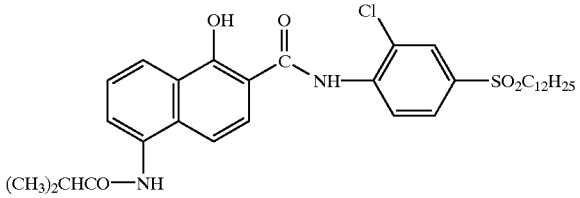
(1)-43
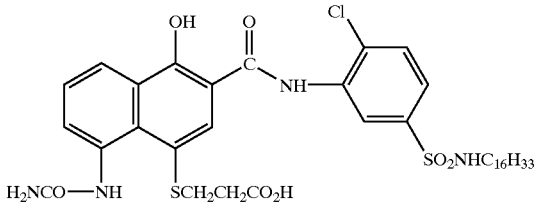
(2)-1
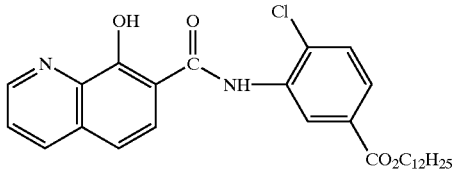
-continued
(2)-2
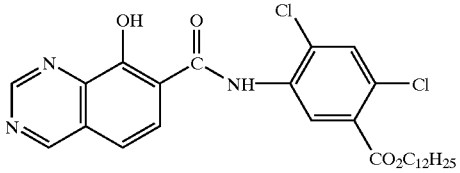
(2)-3
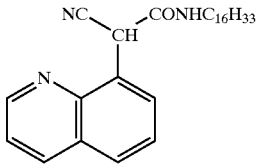
(2)-4
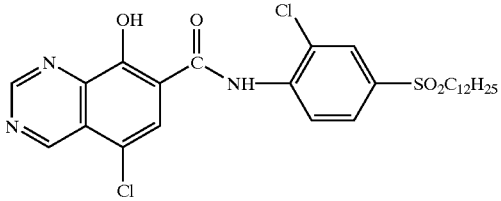
(2)-5
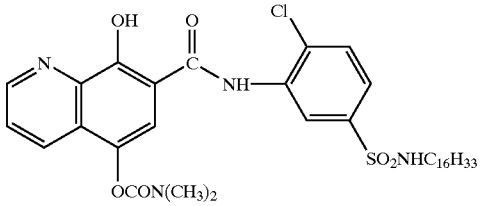
(2)-6
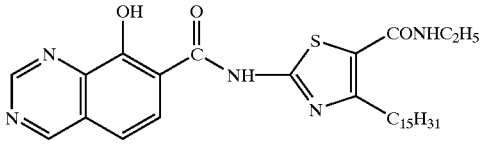
(3)-1
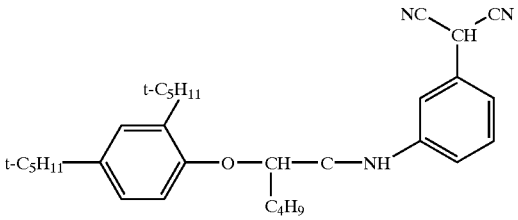
(3)-2
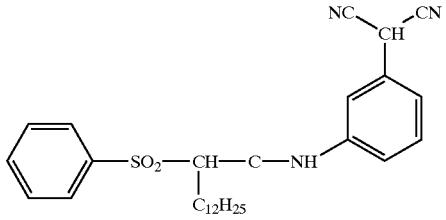

-continued
(3)-3
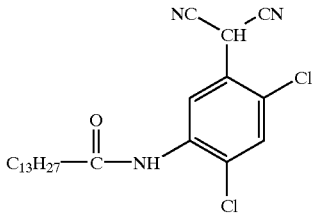
(3)-4
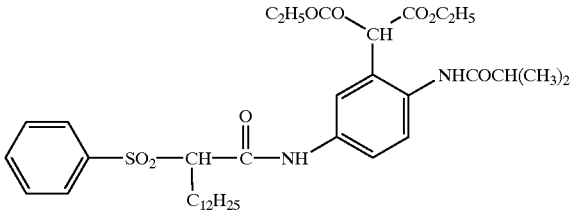
(3)-5
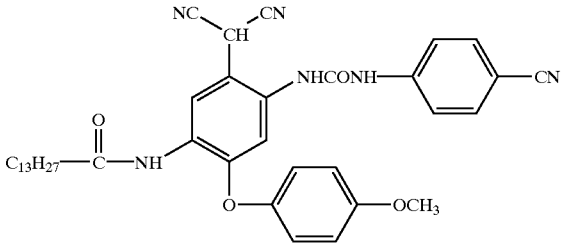
(3)-6
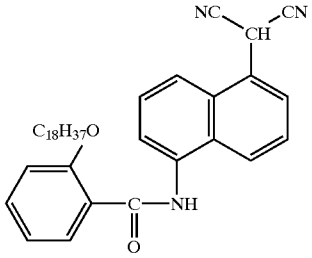
(3)-7
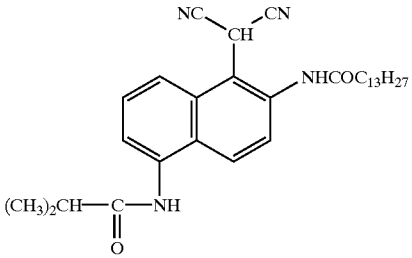
(3)-8
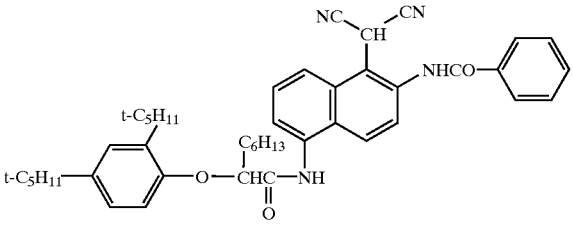
-continued
(3)-9
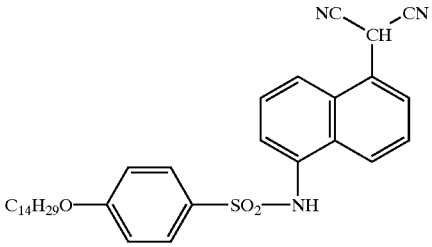
(3)-10
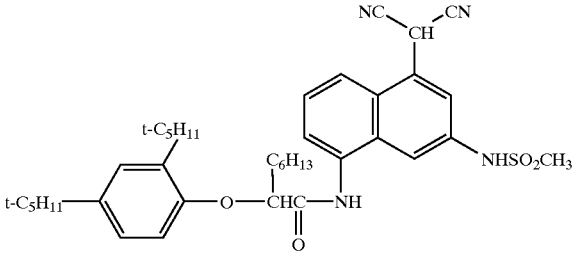
(3)-11
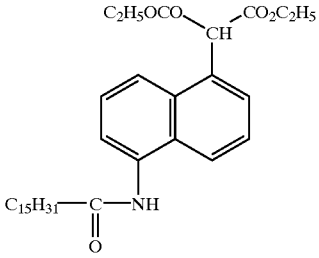
(3)-12
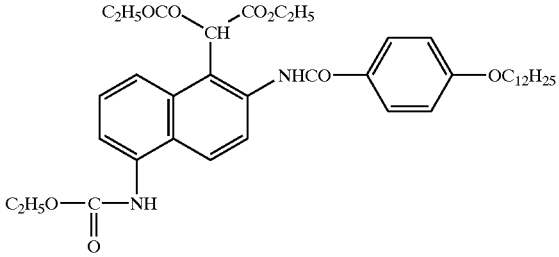
(3)-13
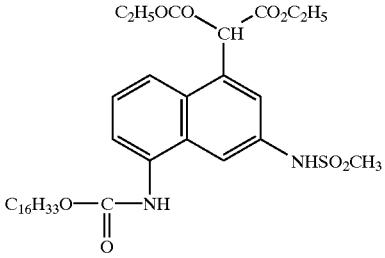
(3)-14
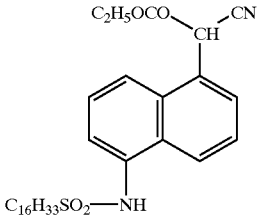

-continued
(3)-15
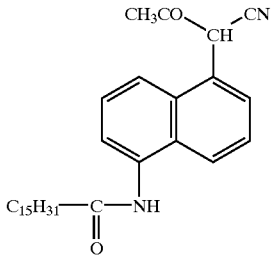
(4)-1
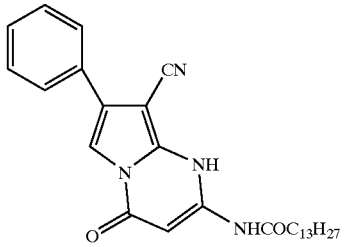
(4)-2
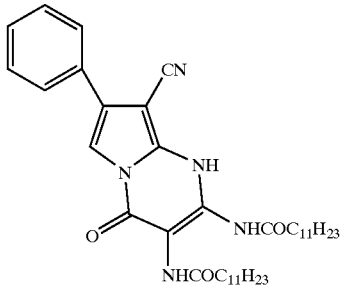
(4)-3
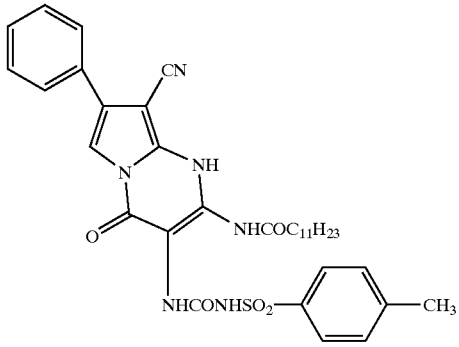
(4)-4
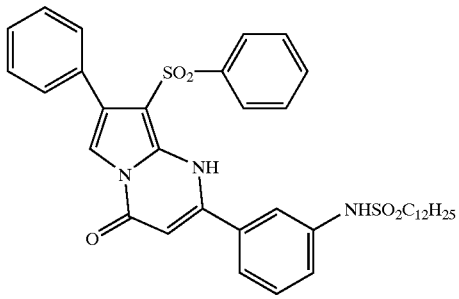
-continued
(4)-5
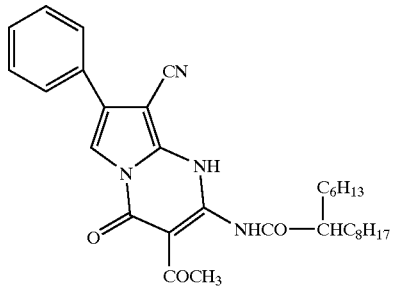
(4)-6
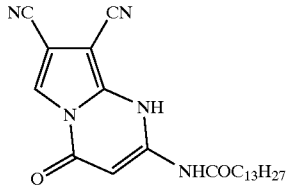
(4)-7
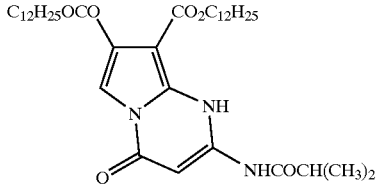
(4)-8
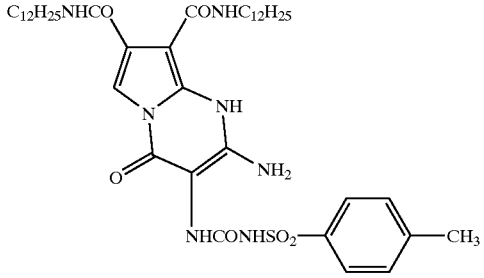
(4)-9
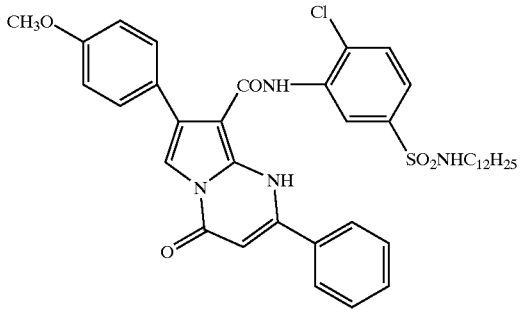
(4)-10
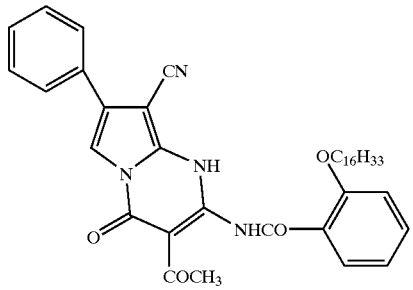

-continued
(4)-11
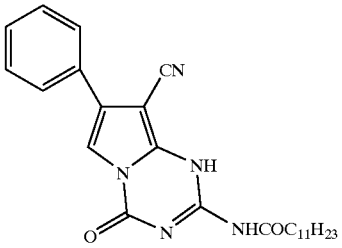
(4)-12
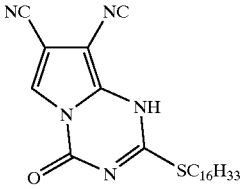
(4)-13
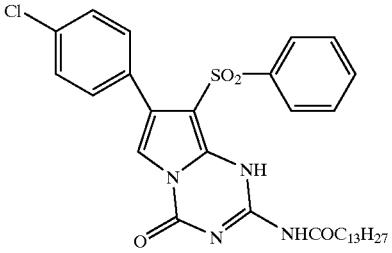
(4)-14
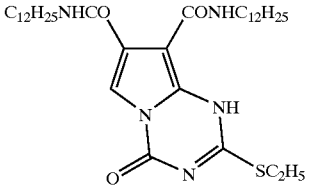
(4)-15
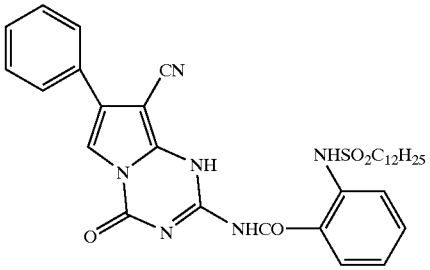
(4)-16
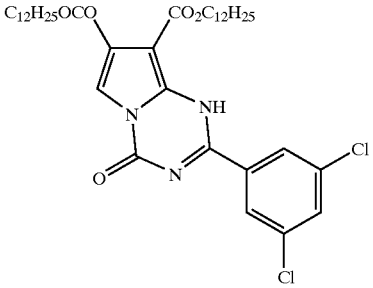
-continued
(4)-17
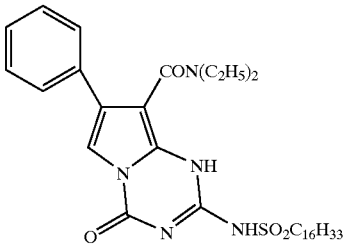
(4)-18
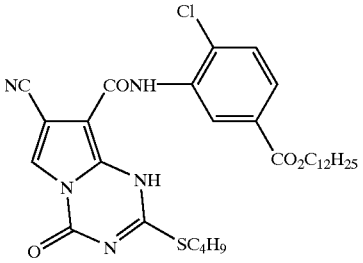
(4)-19
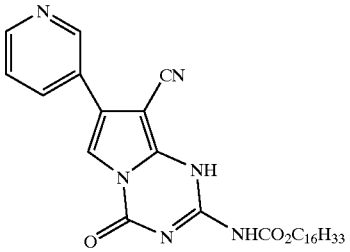
(4)-20
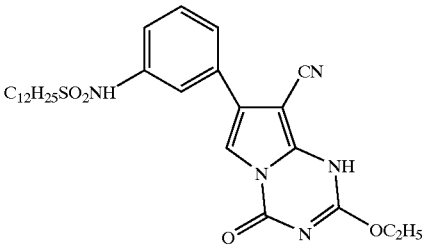
(5)-1
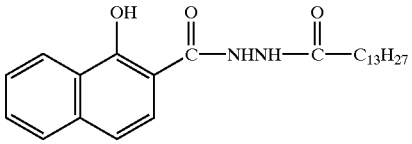
(5)-2
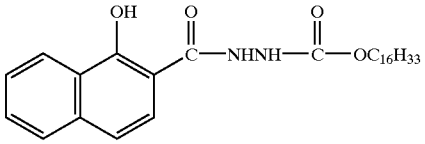
(5)-3
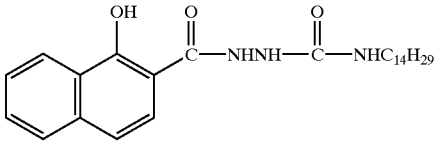

-continued
(5)-4
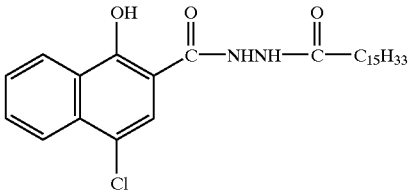
(5)-5
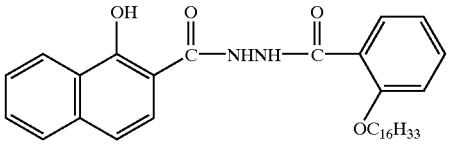
(5)-6
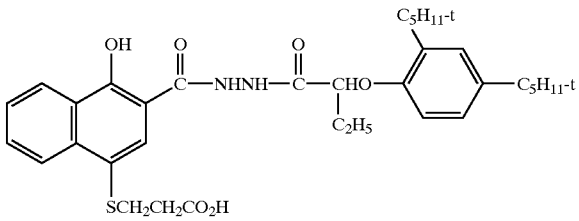
(5)-7
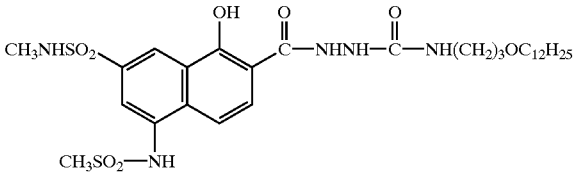
(5)-8
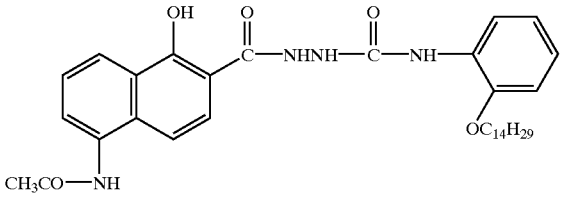
(5)-9
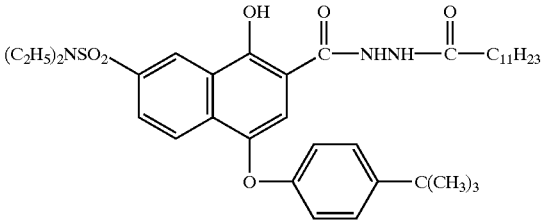
(5)-10
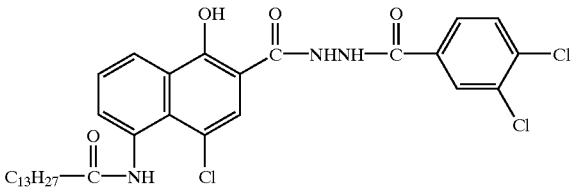
-continued
(5)-11
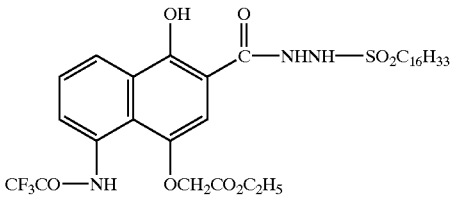
(5)-12
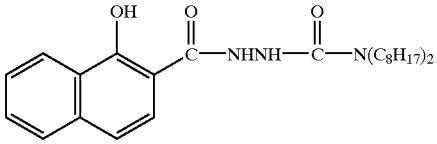
(5)-13
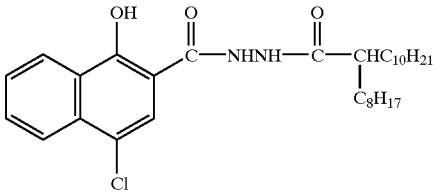
(5)-14
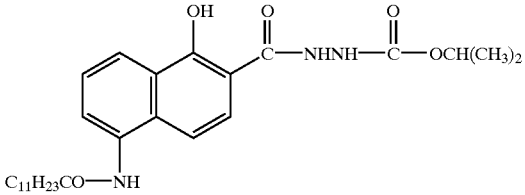
(5)-15
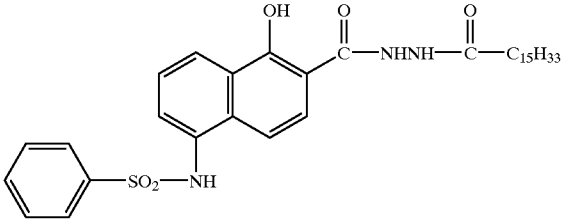
(5)-16
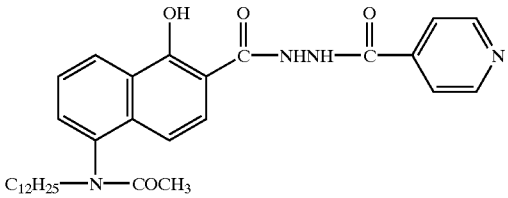
(5)-17
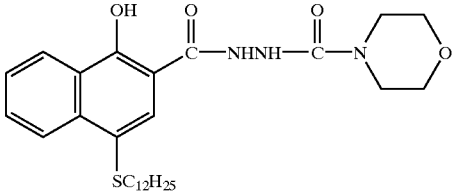

-continued (5)-18

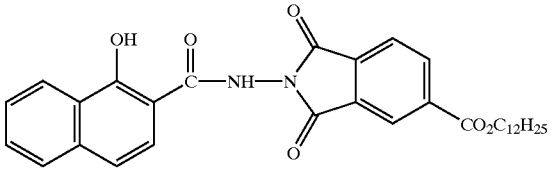

(5)-19

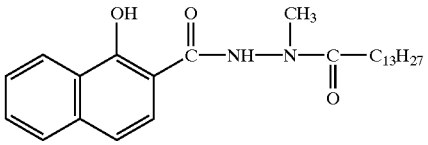

(5)-20

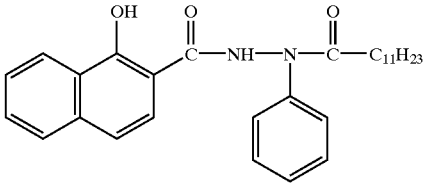

(5)-21

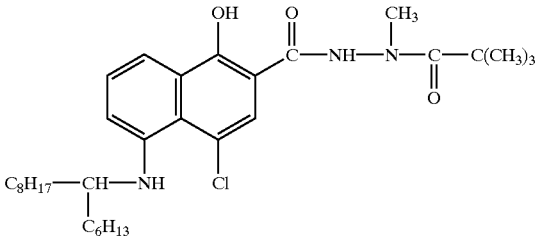

Further, the following functional couplers can also be used in the present invention.

Preferable examples of couplers, which form a color dye having a suitable diffusive property, include those described in U.S. Pat. No. 4,366,237, GB 2,125,570, EP 96,873B, and DE 3,234,533.

Examples of the coupler, which is used for compensating unnecessary absorption of a color dye, include a yellow-colored cyan coupler described in EP 456,257A1, a yellow-colored magenta coupler described in EP 456,257A1, a magenta-colored cyan coupler described in U.S. Pat. No. 4,833,069, and a colorless masking coupler represented by Formula (2) in U.S. Pat. No. 4,837,136 or represented by Formula (A) in claim 1 in WO92/11575 (particularly the exemplified compounds on pages 36 to 45).

Examples of the compound (including a coupler), which reacts with an oxidized product of a developing agent, to release a photographically useful compound's residue, include the followings:

Development inhibitor releasing compounds: compounds represented by any one of Formulae (I) to (IV) described on page 11 in EP 378,236A1, compounds represented by Formula (I) described on page 7 in EP 436,938A2, compounds represented by Formula (1) in EP 568,037A, and compounds represented by Formula (I), (II), or (III) described on pages 5 to 6 in EP440,195A2.

Bleaching accelerator releasing compounds: compounds represented by Formula (I) or (I') described on page 5 in EP 310,125A2, and compounds represented by Formula (I) described in claim 1 of JP-A-6-59411.

Ligand releasing compounds: compounds represented by LIG-X described in claim 1 of U.S. Pat. No. 4,555,478.

Leuco dye releasing compounds: compounds 1 to 6 in U.S. Pat. No. 4,749,641, columns 3 to 8.

Fluorescent dye releasing compounds: compounds represented by COUP-DYE described in claim 1 of U.S. Pat. No. 4,774,181.

Compounds, which release a development accelerator or a fogging agent: compounds represented by Formula (1), (2) or (3) in U.S. Pat. No. 4,656,123, column 3, and compound ExZK-2 described on page 75, lines 36 to 38, in EP 450,637A2.

Compounds which release a group capable of becoming a dye only after being split-off: compounds represented by Formula (I) described in claim 1 of U.S. Pat. No. 4,857,447, compounds represented by Formula (1) in Japanese Patent Application No.4-134523, compounds represented by Formula (I), (II) or (III) on pages 5 to 6 in EP 440,195A2, compound-ligand releasing compounds represented by Formula (I) described in claim 1 in Japanese Patent Application No.4-325564, and compounds represented by LIG-X described in claim 1 of U.S. Pat. No. 4,555,478.

Any of these functional couplers are used in an amount of preferably 0.05 to 10 times, and more preferably 0.1 to 5 times, the molar amount of the above-mentioned coupler contributing to the color formation.

The melting point of the coupler for use in the present invention is preferably 90° C. or higher.

The melting point of the coupler for use in the present invention is preferably higher than the melting point of the thermal solvent, and more preferably higher than the development processing temperature. It is preferable that the coupler for use in the present invention is compatible with the thermal solvent to be used in combination.

(D) Thermal Solvent

The "thermal solvent" for use in the present invention means an organic material, which is a solid at ambient temperature, but exhibits a mixed melting point at or below the temperature employed for thermal treatment together with another component, and liquefies at the time of heat development, so that the heat development or the thermal transfer of a dye are accelerated. Examples of the compound useful as a thermal solvent include a compound capable of becoming a solvent for a developing agent, a compound having a high dielectric constant and known to accelerate the physical development of a silver salt, and a compound compatible with a binder and capable of swelling the binder.

The thermal solvent that can be used in the present invention may be a substance that has a low water-solubility preferable for dispersing fine crystals, and the thermal solvent can be selected from the compounds described in, for example, U.S. Pat. Nos. 3,347,675, 3,667,959, 3,438,776, and 3,666,477, Research Disclosure No.17,643, JP-A-51-19525, JP-A-53-24829, JP-A-53-60223, JP-A-58-118640, JP-A-58-198038, JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-44737, JP-A-63-53548, JP-A-63-161446, JP-A-1-224751, JP-A-2-863, JP-A-2-120739, and JP-A-2-123354. More specifically, these compounds described above include urea derivatives (e.g. phenylmethyl urea), amide derivatives (e.g., acetamide, stearylamide, p-toluamide, and p-propanoyloxyethoxybenzamide), sulfonamide derivatives (e.g., p-toluenesulfonamide), polyhydric alcohols (e.g., polyethylene glycol having a high molecular weight), and the like.

In order to enhance the dispersion stability of the dispersion of fine crystalline particles, the water solubility of the thermal solvent that can be used in the present invention is preferably 1 $g/m^3$ or less, and more preferably $10^{-3}$ $g/m^3$ or less.

It is preferable that the melting point of the thermal solvent for use in the present invention is 90° C. or higher, but equal to or lower than the development processing temperature.

The amount to be used of the thermal solvent for use in the present invention is generally in the range of 1 to 200% by mass, and preferably in the range of 5 to 50% by mass, relative to the coating amount of the binder.

Specific examples and melting points of the representative thermal solvents that can be used in the present invention are shown below, but it should be understood that the present invention is not restricted to these specific examples.

TS-1

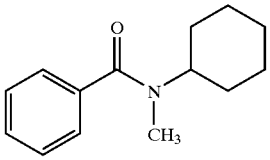

mp. 76° C.

TS-2

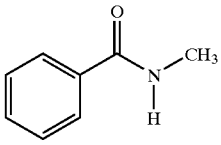

mp. 76° C.

TS-3

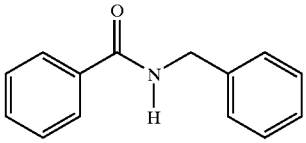

mp. 104° C.

TS-4

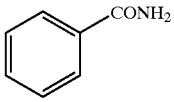

mp. 128° C.

TS-5

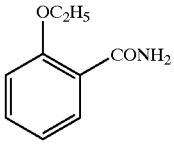

mp. 131° C.

TS-6

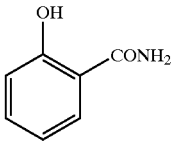

mp. 140° C.

TS-7

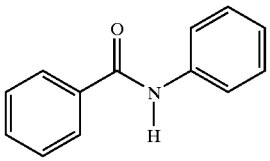

mp. 164° C.

-continued

TS-8

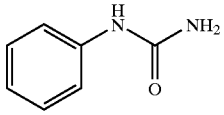

mp. 146° C.

TS-10

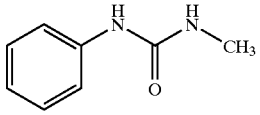

mp. 149° C.

TS-11

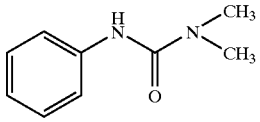

mp. 134° C.

TS-12

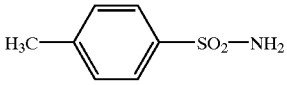

mp. 139° C.

TS-13

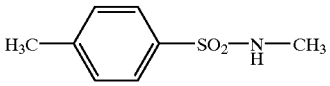

mp. 80° C.

TS-17

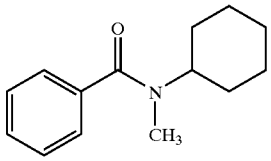

TS-18

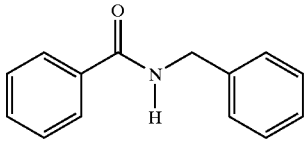

TS-19

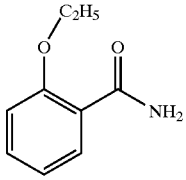

TS-20

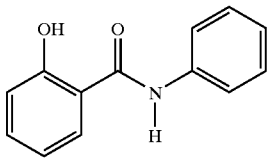

(E) Additive

It is also preferable to add a heterocyclic compound, which is described in EP 1016902A and has a ClogP value sufficient to raise sensitivity, to the light-sensitive material of the present invention. Further, it is also preferable to add a triazole-series compound which is described in JP-A-2001-051383 and has a ClogP value in the range of 4.75 to 9.0; a purine-series compound which is described in JP-A-2001-

051384 and has a ClogP value of 2 or more but less than 7.2; a mercapto-1,2,4-thiadiazole-series or mercapto-1,2,4-oxadiazole-series compound, which is described in JP-A-2001-051385 and has a ClogP value of 1 or more but less than 7.6; or a tetrazole-series compound which is described in JP-A-2001-051386 and has a ClogP value of 2 or more but less than 7.8. Each of these compounds may be added as fine oil droplets to the light-sensitive material, which are prepared by dissolving the compound in a high-boiling-point organic solvent, as in the case of other oil-soluble compounds such as a color-developing agent and a coupler, to be used in the present invention. Alternatively, a solution, which is prepared by dissolving the compound in a water-miscible solvent, may be added to the binder. Further, a silver salt of the compound, which is prepared in advance, may be added to the light-sensitive material. In that case, the silver salt may be added as a dispersion of solid particles, to the light-sensitive material, besides the use of the adding methods listed above. Specific examples of the above-mentioned compounds include the following compound X which is described in EP 1016902A.

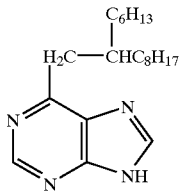

Compound X described in EP 1016902 A

The amount of these compounds to be added may vary within a wide range in order to obtain the intended performances, and the amount is generally in the order of about $1\times10^{-5}$ to 1 mole, per mole of silver halide as emulsion. When the compound is used as a free body or as an alkali metal salt, a preferable amount to be added of the compound is in the order of $10^{-3}$ to $10^{-1}$ mole per mole of silver halide. When the compound is used as a silver salt, a preferable amount thereof is in the order of $10^{-2}$ to 1 mole per mole of silver halide.

(F) Silver Halide

The silver halide that can be used in the heat-developable light-sensitive material of the present invention may be any of silver iodobromide, silver bromide, silver chlorobromide, silver iodochloride, silver chloride, and silver iodochlorobromide. The grain size of the silver halide is preferably 0.1 to 2 $\mu$m, and particularly preferably 0.2 to 1.5 $\mu$m, in terms of the diameter of a sphere having a volume equivalent to an individual grain's volume. Besides the use as photosensitive silver halide grains described above, these silver halides may also be used as non-photosensitive silver halide grains without chemical sensitization or the like.

The shape of the silver halide grain may be selected from a regularly structured crystal such as a cube, octahedron, or tetradecahedron, and a tabular shape such as a hexagon or rectangle. Among these shapes, a tabular shape, which has an aspect ratio, i.e., a value obtained by dividing the diameter of the projected grain (e.g. the diameter of a circle having an area equivalent to that of an individual grain) by the grain thickness, of 2 or more, more preferably 8 or more, and further preferably 20 or more, is preferable. It is preferable to use an emulsion in which these tabular grains account for 50% or more, more preferably 80% or more, and further preferably 90% or more, of the total projected area of all the grains.

The thicknesses of these tabular grains are preferably 0.3 $\mu$m or less, more preferably 0.2 $\mu$m or less, and most preferably 0.1 $\mu$m or less.

In addition, grains, which have thicknesses less than 0.07 $\mu$m and have even higher aspect ratios, as described in U.S. Pat. Nos. 5,494,789, 5,503,970, 5,503,971, 5,536,632, and the like, can also be used preferably. Furthermore, tabular grains, which are rich in silver chloride and have (111) plane as a main (principal) face, as described in U.S. Pat. Nos. 4,400,463, 4,713,323, 5,217,858, and the like; and tabular grains, which are rich in silver chloride and have (100) plane as a main face, as described in U.S. Pat. Nos. 5,264,337, 5,292,632, 5,310,635, and the like, can also be used preferably. Examples in which these silver halide grains are actually used are described in JP-A-9-274295, JP-A-9-319047, JP-A-10-115888, JP-A-10-221827, and the like. The silver halide grains that can be used in the present invention are preferably so-called monodispersed grains having a uniform grain size distribution. As an indicator of the monodispersity, a variation coefficient, which is obtained by dividing the standard deviation of the grain size distribution by an average grain diameter, is preferably 25% or less and more preferably 20% or less. It is also preferable that the halogen composition among grains is homogeneous.

The halogen composition inside the silver halide grain for use in the present invention may be homogeneous. Alternatively, a site having a different halogen composition may be intentionally introduced into the grain. In particular, for the purpose of obtaining a high sensitivity, a grain having a laminate structure, which is comprised of a core and a shell each having a different halogen composition, is preferably used. It is also preferable to further grow the grain after a region having a different halogen composition is introduced so that a dislocation line is intentionally introduced. Further, it is also preferable to epitaxially join a guest crystal, which has a different halogen composition, to an apex or side of a host grain formed.

It is also preferable that the inside of the silver halide grain for use in the present invention is doped with a multivalent transition metal ion or a multivalent anion, as an impurity. In particular, in the case of the former, preferred examples that are employed include complexes having, as a central metal, an element of iron group, such as a halogeno complex, a cyano complex, a complex having an organic ligand.

As a method for preparing the silver halide grains for use in the present invention, known method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating of Photographic Emulsion," Focal Press, 1964, can be referred to. That is, any of pH regions among the acid process, the neutral process, the ammonia process, and the like can be used to prepare silver halide grains. Further, to supply a water-soluble silver salt solution and a water-soluble halogen salt solution that are reaction solutions, any of the single-jet method, the double-jet method, a combination thereof, and the like can be used. The controlled double-jet method, can also be used preferably, wherein the addition of reaction solutions are controlled, to keep the pAg during the reaction constant to a targeted value. A method in which the pH of the reaction liquid during the reaction is kept constant can also be used. In the step for forming grains, a method in which the solubility of the silver halide is controlled by changing the temperature, pH, or pAg of the system, can be used; and a thioether, a thiourea, a rhodanate, and the like can be used as a silver halide solvent. Examples of these are described, for example, in JP-B-47-11386, and JP-A-53-144319.

Generally, the preparation of the silver halide grains for use in the present invention is carried out by feeding a solution of a water-soluble silver salt, such as silver nitrate, and a solution of a water-soluble halogen salt, such as an alkali halide, into an aqueous solution containing a water-soluble binder dissolved therein, such as gelatin, under controlled conditions. After the formation of the silver halide grains, the excess water-soluble salts are preferably removed. For example, the noodle water-washing method, in which a gelatin solution containing silver halide grains are made into a gel, and the gel is cut into a string-shape, then the water-soluble salts are washed away using a cold water; and the sedimentation method, in which inorganic salts comprising polyvalent anions (e.g. sodium sulfate), an anionic surfactant, an anionic polymer (e.g. sodium polystyrenesulfonate), or a gelatin derivative (e.g. an aliphatic-acylated gelatin, an aromatic-acylated gelatin, and an aromatic-carbamoylated gelatin) is added, to allow the gelatin to aggregate, thereby removing the excess salts, can be used. The sedimentation method is preferably used because removal of the excess salts can be carried out rapidly.

(G) Chemical Sensitization and Spectral Sensitization

Generally, it is preferred that chemical sensitization and spectral sensitization is subjected to the photosensitive emulsion for use in the present invention.

As the chemical sensitization method, use can be made of the chalcogen sensitization method, wherein a sulfur, selenium, or tellurium compound is used; the noble metal sensitization method, wherein gold, platinum, iridium, or the like is used; and the so-called reduction sensitization method, wherein a compound having a suitable reducing ability is used during the grain formation to introduce reducing silver nuclei, to obtain high sensitivity. The above chemical sensitization methods may be used singly or in combination.

As the spectral sensitization method, use is made of a so-called spectrally sensitizing dye providing grains of silver halide with light absorbance in its wavelength range, by adsorbing onto the grains of silver halide. Examples of such a dye include cyanine dyes, merocyanine dyes, composite cyanine dyes, composite merocyanine dyes, holopolar dyes, hemicyanine dyes, styryl dyes, and hemioxonol dyes. These spectrally sensitizing dyes may be used singly or in combination; and also, it is preferred that these are used in combination with a supersensitizer.

The coating amount of the light-sensitive silver halide (emulsion) used in the present invention is generally in the range of 0.05 to 15 g/m$^2$, preferably 0.1 to 8 g/m$^2$, in terms of silver.

In the silver halide emulsion for use in the present invention, various stabilizers can be incorporated for the purpose of preventing fogging, or for the purpose of improving stability at storage. As a preferable stabilizer, nitrogen-containing heterocyclic compounds, such as azaindenes, triazoles, tetrazoles, and purines; mercapto compounds, such as mercaptotetrazoles, mercaptotriazoles, mercaptoimidazoles, and mercaptothiadiazoles, can be mentioned. Particularly, among these, triazoles or mercaptoazoles that have an alkyl group having 5 or more carbon atoms, or have an aromatic group as a substituent(s), prevent fogging at the time of the heat development, and in a certain case, improve developability of an exposed area, so that these compounds exhibit remarkable effects on providing high-discrimination.

Specifically, antifogging agents each substituted by a hydrophobic substituent, as described in U.S. Pat. No. 5,773,560, JP-A-11-109539 and JP-A-11-119397, can be used.

The timing when the antifoggant or the stabilizer is added to the silver halide emulsion, may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

In addition, a divalent metal ion described in JP-A-2000-89409 is preferably used together.

The antifogging agent may be added to any layer as long as, on the support, the layer is provided on the same side of the support, to which side the layer containing the light-sensitive silver halide and the layer containing the reducible silver salt are provided. It is preferred that the antifogging agent is added to a layer containing the reducible silver salt or a layer adjacent to the layer. The antifogging agent can be used by dissolving in water or a suitable organic solvent, or by preparing an emulsified dispersion in accordance with the well-known emulsifying and dispersing method. Alternatively, the antifogging agent can be used, by dispersing powder of the antifogging agent in water according to the well-known dispersing method of fine crystalline grains.

The amount of these antifogging agents or stabilizers to be added varies widely in accordance with the halogen composition of the silver halide emulsion and the purpose, and it is preferably in the range of about $10^{-6}$ to $10^{-1}$ mol, and more preferably $10^{-5}$ to $10^{-2}$ mol, per mol of the silver halide.

The above-mentioned additives for photography that can be used in the heat-developable light-sensitive material of the present invention are described in more detail in Research Disclosures (hereinafter abbreviated to as RD) No. 17643 (December 1978), RD No. 18716 (November 1979), RD No. 307105 (November 1989), and RD No. 38957 (September 1996) and the particular parts are shown below.

| Kind of Additive | RD 17643 | RD 18716 | RD 307105 |
|---|---|---|---|
| Chemical sensitizers | p. 23 | p. 648 (right column) | p. 866 |
| Sensitivity-enhancing agents | — | p. 648 (right column) | — |
| Spectral sensitizers and Supersensitizers | pp. 23–24 | pp. 648 (right column)–649 (right column) | pp. 866–868 |
| Brightening agents | p. 24 | pp. 648 (right column) | p. 868 |
| Antifogging agents and Stabilizers | pp. 24–26 | p. 649 (right column) | pp. 868–870 |
| Light absorbers, Filter dyes, and UV Absorbers | pp. 25–26 | pp. 649 (right column)–650 (left column) | p. 873 |
| Dye image stabilizers | p. 25 | p. 650 (left column) | p. 872 |
| Hardeners | p. 26 | p. 651 (left column) | pp. 874–875 |
| Binders | p. 26 | p. 651 (left column) | pp. 873–874 |
| Plasticizers and Lubricants | p. 27 | p. 650 (right column) | p. 876 |
| Coating aids and Surfactants | pp. 26–27 | p. 650 (right column) | pp. 875–876 |

-continued

| Kind of Additive | RD 17643 | RD 18716 | RD 307105 |
|---|---|---|---|
| Antistatic agents | p. 27 | p. 650 (right column) | pp. 876–877 |
| Matting agents | — | — | pp. 878–879 |

(H) Reducible Silver Salt

The reducible silver salt that can be used in the present invention is relatively stable to light, but it provides a silver ion when heated to a temperature of 80° C. or above, in the presence of a photocatalyst (e.g., latent image of a photosensitive silver halide) exposed to light and of a reducing agent. Such silver salt is preferably a complex of an organic or inorganic silver salt in which the gross stability constant of the ligand to silver ion, indicative of the complex stability, is within the range of 4.0 to 10.0.

Preferable organosilver salts include a silver salt of an organic compound having a carboxyl group. Preferable examples thereof include a silver salt of an aliphatic carboxylic acid and a silver salt of an aromatic carboxylic acid. A halogen- or hydroxyl-substitutable silver salt can also be effectively used. Preferable examples of the silver salt of an aliphatic carboxylic acid include silver behenate, silver stearate, silver oleate, silver laurate, silver caprate, silver myristate, silver palmitate, silver maleate, silver fumarate, silver tartrate, silver furoate, silver linoleate, silver butyrate, silver camphorate, and mixtures thereof. Preferable examples of the silver salt of an aromatic carboxylic acid or another carboxyl group-containing compound include silver benzoate, silver salts of a substituted benzoic acid (e.g., silver 3,5-dihydroxybenzoate, silver o-methylbenzoate, silver m-methylbenzoate, silver p-methylbenzoate, silver 2,4-dichlorobenzoate, silver acetamidobenzoate, and silver p-phenylbenzoate), silver gallate, silver tannate, silver phthalate, silver terephthalate, silver salicylate, silver phenylacetate, silver pyromellitate, a silver salt of 3-carboxymethyl-4-methyl-4-thiazoline-2-thione, silver salts such as those described in U.S. Pat. No. 3,785,830; and silver salts of an aliphatic carboxylic acid having a thioether group, as described in U.S. Pat. No. 3,330,663.

Also use can be made preferably of a silver salt of a mercapto- or thione-substituted compound having a heterocyclic skeleton (nucleus), which has 5 or 6 ring atoms such that at least one thereof is nitrogen and other ring atoms include carbon and 2 or less hetero atoms selected from oxygen, sulfur, and nitrogen. Typical preferable heterocyclic nuclei include triazole, tetrazole, oxazole, thiazole, thiazoline, thiadiazole, imidazoline, imidazole, diazole, pyridine, and triazine. Preferred examples of these heterocyclic compounds include silver salt of 3-mercapto-4-phenyl-1,2,4-triazole; silver salt of 2-mercaptobenzimidazole; silver salt of 2-mercapto-5-aminothiadiazole; silver salt of 2-(2-ethylglycolamido) benzothiazole; silver salt of 5-carboxyl-1-methyl-2-phenyl-4-thiopyridine; silver salt of mercaptotriazine; silver salt of 2-mercaptobenzoxazole; silver salt of 1-mercapto-5-alkyl-substituted tetrazole; silver salt of 1-mercapto-5-phenyltetrazole, as described in JP-A-1-100177; silver salts described in U.S. Pat. No. 4,123,274 (for example, silver salts of 1,2,4-mercaptothiazole derivatives such as silver salt of 3-amino-5-benzylthio-1,2,4-triazole); silver salts of a thione compound such as silver salt of 3-(2-carboxyethyl)-4-methyl-4-thiazoline-2-thione, as described in U.S. Pat. No. 3,201,678; silver salts of 3-amino-1,2,4-triazoles described in JP-A-53-116144; silver salts of substituted or unsubstituted benzotriazoles; and silver salts of benzotriazoles, fatty acids, and other compounds described in U.S. Pat. No. 4,500,626, columns 52-53. Further, examples of useful mercapto- or thione-substituted compounds having no heterocyclic nucleus include silver salts of thioglycolic acid such as silver salt of S-alkylthioglycolic acid (said alkyl group contains 12 to 22 carbon atoms), as described in JP-A-49-116275; silver salts of dithiocarboxylic acid such as silver salt of dithioacetic acid; and silver salts of thioamides.

Furthermore, silver salts of imino group-containing compounds can be used. Preferable examples of these compounds include silver salts of benzothiazole and derivatives thereof, as described in JP-B-47-23993 and JP-B-53-6491; silver salts of benzotriazoles such as silver salt of methylbenzotriazole; silver salts of halogen-substituted benzotriazoles such as silver salt of 5-chlorobenzotriazole; silver salt of 1,2,4-triazole; silver salts of 1H-tetrazole, as described in U.S. Pat. No. 4,220,709; silver salts of imidazole and silver salts of imidazole derivatives. Silver acetylide described in U.S. Pat. No. 4,775,613 is also useful.

Organosilver salts may be used in combinations of two or more thereof. The above-mentioned organosilver salt may be used in an amount of preferably 0.01 to 10 moles, more preferably 0.01 to 1 mole, per mole of photosensitive silver halide.

The total coating amounts of the photosensitive silver halide (emulsion) and the organosilver salt are preferably 0.1 to 20 $g/m^2$, more preferably 1 to 10 $g/m^2$, in terms of the amount of silver. The silver-providing substance may constitute preferably about 5 to 70% by mass of the image-forming layer.

The organosilver salt that is preferably used in the present invention is prepared by carrying out a reaction between a solution or suspension of the above-mentioned organic compound or an alkali metal salt thereof (e.g., Na-salt, K-salt, Li-salt, or the like) and silver nitrate, in a tightly closed means designed to mix liquids. Specifically, the methods, which are described in JP-A-2001-33907 and JP-A-2000-292882, paragraphs 0019-0021, can be used.

A method, in which a solution of the organic compound and a solution of silver nitrate are added simultaneously, into a solution of a dispersant, may also be employed.

In the present invention, when the organosilver salt is prepared, a water-soluble dispersant may be added to the aqueous solution of silver nitrate and the solution of the organic compound or an alkali metal salt thereof, or to the reaction solution. Specific examples of the kinds and amounts of the dispersant to be used are described in JP-A-2000-305214, paragraph 0052.

The method for forming the silver salt of organic compound that can be preferably used in the present invention, is the method in which the silver salt of the organic compound is formed while controlling pH, as described in JP-A-1-100177.

The organosilver salt for use in the present invention is preferably a desalted one. The desalting method is not particularly limited and any known method can be employed. As the desalting method, a known filtration method, such as centrifugal filtration, suction filtration, ultrafiltration, flock-forming water-washing by a flocculation method, can be preferably employed. As to the ultrafiltration method, the method described in JP-A-2000-305214 can be used.

In the present invention, in order to obtain a dispersion of solid organosilver salt particles free of flocculation and small in particle size, it is preferable to employ a dispersing method in which an aqueous dispersion of an organosilver salt is transformed into a high-speed stream and thereafter the pressure is dropped. As to such dispersing methods, the methods described in JP-A-2000-292882, paragraphs 0027–0038, can be employed.

The shape and size of the organosilver salt that can be used in the present invention are not particularly limited, and a dispersion of solid fine-particles having an average particle size of 0.001 to 5.0 μm is preferable. A more preferable average particle size is 0.005 to 1.0 μm.

The particle size distribution of the dispersion of solid organosilver salt fine-particles for use in the present invention is preferably monodispersed. More specifically, the percentage of the value (variation coefficient), which is obtained by dividing the standard deviation of the volume-weighted average diameter by the volume-weighted average diameter, is preferably 80% or less, more preferably 50% or less, and further preferably 30% or less.

The dispersion of solid organosilver salt fine-particles for use in the present invention, at least comprises an organosilver salt and water. Although the proportion between the organosilver salt and water is not particularly limited, it is preferable that the proportion of the organosilver salt accounts for 5 to 50% by mass of the total. In particular, the range of 10 to 30% by mass is preferable. Although the use of the above-mentioned dispersing aid is preferable, it is preferable to use the dispersing aid in a minimum amount within a range suitable for minimizing the particle size. The amount of the dispersing aid is preferably in the range of 0.5 to 30% by mass, in particular in the range of 1 to 15% by mass, relative to the organosilver salt.

In the present invention, a metal ion, which is selected from Ca, Mg, and Zn, may be added to the non-photosensitive organosilver salt, for such purposes as prevention of fogging.

The photosensitive silver halide and/or reducible silver salt in the present invention, can be further protected by a known anti-fogging agent, stabilizer, and a precursor thereof, against the formation of additional fogging, so that the decrease in sensitivity during storage can be more efficiently prevented to stabilize the resultant photographic material. Preferable examples of the anti-fogging agent, stabilizer, and stabilizer precursor that can be used singly or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urasols described in U.S. Pat. No. 3,287,135; sulfocatechols described in U.S. Pat. No. 3,235,652; oximes, nitrons, and nitroindazoles described in U.K. Patent No. 623,448; salts of multivalent metals, as described in U.S. Pat. No. 2,839,405; thiuronium salts described in U.S. Pat. No. 3,220,839; salts of palladium, platinum, and gold, as described in U.S. Pat. Nos. 2,566,263 and 2,597,915; halogen-substituted organic compounds described in U.S. Pat. Nos. 4,108,665 and 4,442,202; triazines described in U.S. Pat. Nos. 4,128,557, 4,137,079, 4,138,365, and 4,459,350; phosphorus compounds described in U.S. Pat. No. 4,411,985; and organohalogeno compounds as disclosed in JP-A-50-119624, JP-A-54-58022, JP-A-56-70543, JP-A-56-99335, JP-A-61-129642, JP-A-62-129845, JP-A-6-208191, JP-A-7-5621, and JP-A-8-15809, and U.S. Pat. Nos. 5,340,712, 5,369,000, and 5,464,737.

The heat-developable light-sensitive material of the present invention may contain a reducing agent, besides the color-developing agent. Besides conventional photographic developers such as phenidone, hydroquinone, catechol, and the like, a hindered phenol reducing agent can also be mentioned as a preferred example of the reducing agent. The amount of the reducing agent to be incorporated is preferably in the range of 5 to 50 mol %, more preferably in the range of 10 to 40 mol %, per mole of silver on the side of the support having thereon an image-forming layer. The layer to which the reducing agent is added may be any layer on the image-forming layer side of the support. In the case where the reducing agent is added to a layer that is not an image-forming layer, it is preferable that the amount of the reducing agent to be used is a little larger and is 10 to 50 mol % per mole of silver. The reducing agent may be a so-called precursor which is designed to function effectively only at the time of development processing.

In the heat-developable light-sensitive material utilizing an organosilver salt, a wide variety of reducing agents can be used. Examples of the reducing agent that can be used include those disclosed, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, and JP-A-6-3793, U.S. Pat. Nos. 3,667,9586, 3,679,426, 3,751,252, 3,751,255, 3,761,270, 3,782,949, 3,839,048, 3,928,686, and 5,464,738, DE 2,321,328B, EP 629,732A.

(I) Precursor

Generally, the processing of photographic light-sensitive materials requires a base, but the light-sensitive material of the present invention does not necessarily require a base. However, for such purposes as acceleration of development, acceleration of the reaction between an oxidized product of the color-developing agent and the coupler, as described below, and acceleration of color development of the dye formed, a base may be used. In the light-sensitive material of the present invention, various methods of supplying a base may be employed. For example, in the case where a base-generating function is provided to the light-sensitive material, a base precursor can be introduced into the light-sensitive material. Examples of such a base precursor include a salt of a base and an organic acid designed to be decarboxylated by heat, and a compound designed to release an amine by an intramolecular nucleophilic substitution reaction, Lossen rearrangement, or Beckmann rearrangement. These examples are described in U.S. Pat. Nos. 4,514,493 and 4,657,848, and the like.

The light-sensitive material of the present invention may contain a nucleophilic agent (nucleophile) or a nucleophile precursor, in order to accelerate the reaction between an oxidized product of the color-developing agent and the coupler. Although various nucleophile precursors are known, it is advantageous to use a precursor that forms (or releases) a base by heating, because the use of such a precursor releases a nucleophile at the time of heat development. A thermal decomposition-type (decarboxylation-type) base precursor, which is composed of a salt of a carboxylic acid and a base, is representative, as the base precursor that forms a base by heating. When the decarboxylation-type base precursor is heated, the carboxyl group of the carboxylic acid undergoes a decarboxylation reaction, and a base is released. Sulfonylacetic acid or propiolic acid, which easily causes a decarboxylation reaction, is used as the carboxylic acid. It is preferable that the sulfonylacetic acid or propiolic acid has a group (i.e., an aryl group or unsaturated heterocyclic group), which has aromaticity capable of accelerating the decarboxylation, as a substitutent. The base precursors of a salt of sulfonylacetic acid are described in JP-A-59-168441. The base precursors of a salt of propiolic acid are described in JP-A-59-180537. The base-constituting component of the decarboxylation-type base precursor is preferably an organic base, and more preferably amidine, guanidine, or a derivative thereof. The organic base is preferably a diacidic base, triacidic base, or tetraacidic base, more preferably a diacidic base, and most preferably a diacidic base of an amidine derivative or guanidine derivative.

The precursors of the diacidic base, triacidic base, or tetraacidic base of an amidine derivative are described in JP-B-7-59545. The precursors of the diacidic base, triacidic base, or tetraacidic base of a guanidine derivative are described in JP-B-8-10321. The diacidic base of an amidine derivative or guanidine derivative comprises: (A) two amidine or guanidine moieties; (B) a substituent of the amidine or guanidine moiety; and (C) a divalent linking group linking the two amidine or guanidine moieties. Examples of the substituent (B) include an alkyl group (including a cycloalkyl group), an alkenyl group, an alkynyl group, an aralkyl group, and a heterocyclic residue. Two or more of the substituents may join together to form a nitrogen-containing heterocycle. The linking group (C) is preferably an alkylene group or a phenylene group. Examples of the diacidic base precursor of an amidine or guanidine derivative that is preferably used in the present invention, are BP-1 to BP-41 described in JP-A-11-231457, pages 19–26. Among these precursors, salts of p-(phenylsulfonyl)-phenylsulfonylacetic acid, such as BP-9, BP-32, BP-35, BP-40, and BP-41, are particularly preferable.

The amount (in moles) of the base precursor to be used is preferably 0.1 to 10 times, more preferably 0.3 to 3 times, the amount (in moles) of the color-developing agent to be used. It is preferable that the base precursor is dispersed in the state of solid fine-particles.

(J) Binder

In the heat-developable light-sensitive material of the present invention, a binder is used in light-sensitive layers, and in non-light sensitive layers such as a colored layer, a protective layer, and an intermediate layer. The binder may be arbitrarily selected from well-known natural or synthetic resins, such as gelatin, polyvinyl acetal, polyvinyl chloride, polyvinyl acetate, cellulose acetate, polyolefin, polyester, polystyrene, polyacrylonitrile, polycarbonate, and an SBR latex purified by ultrafiltration (UF). Needless to say, examples of the binder also include a copolymer and a terpolymer. If necessary, combinations of two or more of these polymers can be employed. These polymers are used in an amount sufficient for holding therein the components. That is, these polymers are used in an amount falling in the range effective in functioning as a binder. Persons skilled in the art can determine the effective range properly.

The binder of the light-sensitive material is preferably a hydrophilic one. Examples of the binder include the binders described in the above-mentioned Research Disclosures and in JP-A-64-13546, pages 71–75. Among these binders, gelatin and combinations of gelatin with another water-soluble binder, such as polyvinyl alcohol, modified polyvinyl alcohol, cellulose derivative, or acrylamide polymer, are preferable. The total coating amounts of the binder is generally 1 to 25 g/m$^2$, preferably 3 to 20 g/m$^2$, and more preferably 5 to 15 g/m$^2$. Gelatin is used in proportions of generally 50 to 100% by mass, preferably 70 to 100% by mass, in the combination.

(II) Layer Constitution of a Heat-developable Light-sensitive Material

Generally, a heat-developable light-sensitive material comprises 3 or more light-sensitive layers each having a different light-sensitivity, wherein each light-sensitive layer contains at least one silver halide emulsion layer. As a typical example, each set of the silver halide emulsion layer is composed of a plurality of silver halide emulsion layers which have substantially the same color sensitivity but have different levels of sensitivity. In this case, it is preferable to use silver halide grains such that a silver halide grain having a larger projected grain diameter has a larger value of so-called aspect ratio, i.e., a value obtained by dividing the projected grain diameter by the grain thickness. The light-sensitive layer is a unit light-sensitive layer having sensitivity to any one of blue light, green light, and red light. In the case of a multilayer silver halide color photographic light-sensitive material, a generally adopted order of the unit light-sensitive layers from the support side is a red-sensitive layer, a green-sensitive layer, and a blue-sensitive layer. However, depending on purposes, this order of layers may be reversed, or an order, in which light-sensitive layers sensitive to the same color sandwich a light-sensitive layer sensitive to a different color, is also possible. The total film thickness of the light-sensitive layer is generally 2 to 40 $\mu$m and preferably 5 to 25 $\mu$m.

Each of the silver halide emulsion layers constituting unit photosensitive layers respectively can preferably take a two-layer constitution composed of a high-sensitive emulsion layer and a low-sensitive emulsion layer, as described in DE 1 121 470 or GB Patent No.923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932, an order of a blue-sensitive layer/GH/RH/GL/RL stated from the side most away from the support is also possible. Further as described in JP-A-56-25738 and JP-A-62-63936, an order of a blue-sensitive layer/GL/RL/GH/RH stated from the side most away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer stated from the side away from support can be taken. In the case of four layers or more layers, the arrangement can be varied as above.

In order to improve color reproduction, as described in U.S. Pat. Nos. 4,663,271, 4,705,744, and 4,707,436, and JP-A-62-160448 and JP-A-63-89850, it is preferable to form a donor layer (CL), which has a spectral sensitivity distribution different from those of a principal (main) light-sensitive layer, such as BL, GL and RL, and which has an inter-layer effect, in a position adjacent or in close proximity to the principal light-sensitive layer.

In the present invention, although a silver halide, a dye-providing coupler, and a color-developing agent (or its precursor) may be contained in the same layer, these substances may be contained in different layers if these substances are present in a reactive state. For example, if the layer containing a color-developing agent and the layer containing a silver halide are different, the raw stock storability of light-sensitive materials can be improved.

Although the relationship between the spectral sensitivity and the hue resulting from the coupler is arbitrary in each layer, direct projection exposure onto a conventional color paper and the like is possible if a cyan coupler is used in the red-sensitive layer, a magenta coupler is used in the green-sensitive layer, and a yellow coupler is used in the blue-sensitive layer.

The coupler which can form a dye having a maximum wavelength in a non-visible range can be used in any photosensitive layer. In the image-forming method of the present invention, an image data may be read by CCD or the like in the state that silver halide remains in the photosensitive material after heat-development. In this case, by using the coupler having a maximum wavelength in an infrared ray range instead of the yellow coupler in the blue photosensitive layer, an effect of reading-load based on the remaining silver halide is small so that an image data having a good image quality can be obtained.

Various non-light-sensitive layers, such as a protective layer, an undercoat (primer) layer, an intermediate layer, a yellow-filter layer, or an antihalation layer, may be provided between the silver halide emulsion layers, or as a top (overmost) layer or a bottom (undermost) layer. Further, various auxiliary (supplementary) layers, such as a backing layer, may be provided on the opposite side of the support. These layers may contain, for example, the above-described couplers, developing agents, DIR compounds, color-mixing inhibitor, and dyes. Specifically, the arrangement of layers as described in the above publication, the primer layer as described in U.S. Pat. No. 5,051,335, the intermediate layer containing a solid pigment, as described in JP-A-1-167838 and JP-A-61-20943, the intermediate layer containing a reducing agent or DIR compound, as described in JP-A-1-120553, JP-A-5-34884 and JP-A-2-64634, the intermediate layer containing an electron transfer agent, as described in U.S. Pat. Nos. 5,017,454 and 5,139,919 and JP-A-2-235044, the protective layer containing a reducing agent, as described in JP-A-4-249245, and combinations of these layers, may be provided.

In the present invention, a yellow filter layer, a magenta filer layer, and an antihalation layer can be used, as a colored layer. Accordingly, if the order of light-sensitive layers from the nearest side of the support is a red-sensitive layer, a green sensitive layer and a blue-sensitive layer, it is possible to provide a yellow-colored filter layer between the blue-sensitive layer and the green-sensitive layer, to provide a magenta-colored filter layer between the green-sensitive layer and the red-sensitive layer, and to provide a cyan-colored filter layer (antihalation layer) between the red-sensitive layer and the support. These colored layers may be in contact with an emulsion layer either directly or via an interlayer such as gelatin. Alternatively, these colored layers may be provided on the opposite side of the support relative to the emulsion layer. The amount of the dyes to be used is such that the transmission densities of the layers are generally 0.03 to 3.0, preferably 0.1 to 1.0, for blue light, green light and red light, respectively. More specifically, the amount is preferably 0.005 to 2.0 mmol/$m^2$ and more preferably 0.05 to 1.0 mmol/$m^2$, although the amount depends on $\epsilon$ and molecular weights of the dye to be used.

In the present invention, it is preferable to use colored layers which use dyes that can be decolorized by processing. That "the dye, which is present in a yellow filter layer or in the antihalation layer, is decolorized or eliminated at the time of development" means that the amount of the dye remaining after the development processing is generally one third or less, preferably one tenth or less, of the amount of the dye present immediately before the coating.

The light-sensitive material of the present invention may contain a mixture of two or more dyes in one colored layer. For example, the antihalation layer described above may contain a mixture of three dyes, i.e., a yellow dye, a magenta dye, and a cyan dye.

Specifically, dyes described in EP 549,489A, and dyes ExF 2 to 6 described in JP-A-7-152129, can be mentioned. A dye in the state in which fine-crystalline particles of the dye are dispersed, as described in JP-A-8-101487 can also be used.

The dye may also be mordanted with a mordant and a binder. In this case, as the mordant and the dye, those known in the field of photography can be used, and examples include mordants described, for example, in U.S. Pat. No. 4,500,626, columns 58 to 59, and JP-A-61-88256, pages 32 to 41, JP-A-62-244043, and JP-A-62-244036.

Leuco dyes or the like that lose their color can be used, and specifically, a silver halide light-sensitive material containing a leuco dye that has been color-formed previously with a developer of an organic acid metal salt, is disclosed in JP-A-1-150132. The leuco dye and a color developer complex are decolorized by heat or reacting with an alkali agent.

Known leuco dyes can be used, examples of which are described in Moriga and Yoshida, "Dyes and Chemicals", Vol.9, p.84, Association of Chemical Products; "New Handbook of Dyes", p.242, Maruzen Co., Ltd. (1970); R. Garner, "Reports on the Progress of Applied Chemistry", Vol.56, p.199 (1971); "Dyes and Chemicals", Vol.19, p.230, Association of Chemical Products (1974); "Color Materials", Vol.62, p.288 (1989); "Dye Industry", Vol.32, p.208; and the like.

Color developers that are preferably used are acid clay-based color developers, phenol/formaldehyde resins, and metal salts of organic acids. Among the metal salts of organic acids, metal salts of salicylic acid, metal salts of a phenol/salicylic acid/formaldehyde resin, rhodanates, and metal salts of xanthogenic acid are useful. Zinc is particularly preferable as a metal. Among these color developers, as to oil-soluble zinc salicylates, those described in U.S. Pat. Nos. 3,864,146 and 4,046,941, and JP-B-52-1327 can be used.

Besides, various additives indicated below can also be used additionally in the present invention.

It is also possible to use a dye which can be decolorized in the presence of a decolorizer at the time of processing. Examples of the dye that can be used include cyclic ketomethylene compounds described in JP-A-11-207027 and JP-A-2000-89414, cyanine dyes described in EP 911693A1, polymethine dyes described in U.S. Pat. No. 5,324,627, and merocyanine dyes described in JP-A-2000-112058.

It is preferable that these decolorizable dyes are dispersed in the state of a dispersion of fine crystalline particles described above, and the dispersion is added to the light-sensitive material. Alternatively, these decolorizable dyes may be used in the state of a dispersion prepared by dispersing in a hydrophilic binder the oil droplets which are prepared by dissolving the dye in an oil and/or an oil-soluble polymer. As a method for preparing the dispersion, preferable is an emulsification dispersion method which is described in, for example, U.S. Pat. No. 2,322,027. In this case, an oil having a high boiling point, which is described in U.S. Pat. Nos. 4,555,470, 4,536,466, 4,587,206, 4,555,476 and 4,599,296, JP-B-3-62256, and the like can be used, if necessary, together with an organic solvent having a low boiling point in the range of 50 to 160° C. Two or more of the oils having a high boiling point can be used together. Besides, an oil-soluble polymer may be used in place of or together with the oil, as described in the specification of WO88/00723. The amount to be used of the oil having a high boiling point and/or the polymer is generally 0.01 to 10 g, preferably 0.1 to 5 g, per gram of the dye to be used.

The method for dissolving the dye in the polymer may be carried out by a latex-dispersing method, and specific examples of the step as well as of the latex for impregnation are described in, for example, U.S. Pat. No. 4,199,363, DE 2,541,274 and DE 2,541,230, JP-B-53-41091 and EP 029104A.

When the dyes are dispersed in a hydrophilic binder, a variety of surface-active agents may be used. Examples of the surface-active agents that can be used include those described in JP-A-59-157636, pages (37) to (38), and in "Known Technologies (Kochi-Gijutsu)", No. 5, pages 136 to 138 (issued on Mar. 22, 1991, ASTECH Inc.). Further, phosphate-series surface-active agents described in JP-A-7-56267 and JP-A-7-228589, and DE 932299A, can be used.

As a hydrophilic binder into which a dye is dispersed, a water soluble polymer is preferable, and examples thereof include proteins, such as gelatin and gelatin derivatives; such natural compounds as polysaccharides, including cellulose derivatives, starches, acacia, dextrans, and pullulan; and such synthetic polymer compounds as polyvinyl alcohols, polyvinyl pyrrolidones, and acrylamide polymers. These water soluble polymers may be used in combination with two or more type of them. Particularly, the combination of gelatin and another polymer(s) of the above is preferable. Further, the gelatin can be selected from lime-processed gelatin, acid-processed gelatin, and so-called de-ashed gelatin from which the calcium content, and the like, have been reduced, in accordance with various purposes, and combinations thereof are also preferable.

The above-mentioned dyes are decolorized in the presence of a decolorizer when processed.

Examples of the decolorizer include alcohols or phenols, amines or anilines, sulfinic acids or salts thereof, sulfurous acid or salts thereof, thiosulfuric acid or salts thereof, carboxylic acids or salts thereof, hydrazines, guanidines, aminoguanidines, amidines, thiols, cyclic or chain-like active methylene compounds, cyclic or chain-like active methine compounds, and anion species derived from these compounds.

Among these compounds, hydroxylamines, sulfinic acids, sulfurous acid, guanidines, aminoguanidines, heterocyclic thiols, cyclic or chain-like active methylene compounds, and cyclic or chain-like active methine compounds are preferably used. Guanidines and aminoguanidines are particularly preferable. The base precursors described above can also be preferably used.

The decolorizer is thought to contact with a dye and add nucleophilically to the dye molecule so that the dye is decolorized at the time of processing. As a preferable procedure, a dye-containing silver halide light-sensitive material after image-wise exposure or at the time of image-wise exposure thereof is put together with a processing material, which contains a decolorizer or a decolorizer precursor, face to face each other in the presence of water, and then these materials are heated. After that, when these materials are separated from each other, a colored image is obtained on the silver halide light-sensitive material and the dye is decolorized. In this case, the density of the dye after the decolorization is generally one third or less and preferably one fifth or less of the original density. The molar amount of the decolorizer to be used is in the range of generally 0.1 to 200 times and preferably 0.5 to 100 times that of the dye.

Also usable is a method using a decolorizable dye in a reversible manner that the dye has a color at a temperature below a decolorization starting temperature (T) but at least part of the dye is decolorized at the temperature T or above and the change can be reversed, wherein readout is made at the decolorization temperature (T° C.) or above so that the deterioration of S/N due to the density of the dye at the time of readout can be prevented. The dye having such a reversible property can be prepared by a combination of a leuco dye described in JP-B-51-44706, a phenolic color developer, and a higher alcohol.

For various purposes, in the light-sensitive material may be used a hardener, a surfactant, a photographic stabilizer, an antistatic agent, a slipping (sliding) agent, a matting agent, a latex, a formalin scavenger, a dye, a UV absorber, and the like. Specific examples thereof are described in the Research Disclosures, JP-A-9-204031, and the like. Examples of particularly preferred antistatic agent are fine particles of metal oxides such as ZnO, $TiO_2$, $SnO_2$, $Al_2O_3$, $In_2O_3$, $SiO_2$, MgO, BaO, $MoO_3$ and $V_2O_5$.

As the base (support) of the light-sensitive material in the present invention, those that are transparent and can withstand the processing temperature, are used. Generally, photographic bases, such as papers or synthetic polymers (films) described in "Shashin Kogaku no Kiso —Ginen Shashinhen—," edited by Nihon Shashin-gakkai and published by Corona-sha, 1979, pages (223) to (240), can be mentioned. Specifically, mention can be made of polyethylene terephthalates, polyethylene naphthalates, polycarbonates, polyvinyl chlorides, polystyrenes, polypropylenes, polyimides, celluloses (e.g., triacetylcellulose), and the like.

Among the supports, a polyester composed mainly of polyethylene naphthalate is particularly preferable. The term "a polyester composed mainly of polyethylene naphthalate" as used herein means a polyester whose naphthalenedicarboxylic acid-component content in total dicarboxylic acid residues is preferably 50 mol % or more, more preferably 60 mol % or more, and further preferably 70 mol % or more. This may be a copolymer or a polymer blend.

In the case of a copolymer, a copolymer, which has a unit of terephthalic acid, bisphenol A, cyclohexanedimethanol or the like, copolymerized therein, besides naphthalenedicarboxylic acid units and ethylene glycol units, is also preferable. Among these copolymers, a copolymer, in which terephthalic acid units are copolymerized, is most preferable from the standpoint of mechanical strength and costs.

Preferred examples of the counterpart for forming the polymer blend may be polyesters, such as polyethylene terephthalate (PET), polyarylate (PAr), polycarbonate (PC), and polycyclohexanedimethanol terephthalate (PCT), from the standpoint of compatibility. Among these polymer blends, a polymer blend with PET is preferable, from the standpoint of mechanical strength and costs.

Particularly when heat resistance and anti-curling properties are severely demanded, bases that are described, as bases for light-sensitive materials, for example, in JP-A-6-41281, JP-A-6-43581, JP-A-6-51426, JP-A-6-51437, JP-A-6-51442, JP-A-6-82961, JP-A-6-82960, Japanese Patent Applications No. 4-253545, JP-A-6-82959, JP-A-6-67346, Japanese Patent application No. 4-221538, No. 5-21625, JP-A-6-202277, JP-A-6-175282, JP-A-6-118561, JP-A-7-219129 and JP-A-7-219144, can be preferably used.

Further, a base of a styrene-series polymer having mainly a syndiotactic structure can be preferably used. The thickness of the base is preferably 5 to 200 $\mu$m, more preferably 40 to 120 $\mu$m.

These supports are preferably subjected to a surface treatment, in order to achieve strong adhesion between the support and a photographic constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a grow treatment are preferable.

With respect to the undercoating, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, gelatins, polyvinyl alcohols, and modified polymers thereof, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 $\mu$m) may be included as a matting agent.

As for the color tone (hue) of the dye to be used for dyeing films, dyeing in gray is preferable in view of general characteristics of light-sensitive materials. A dye, which has excellent resistance to heat within the film-forming temperature range, and excellent compatibility with polyester, is preferable. In this regard, the purpose can be achieved by blending dyes, such as Diaresin (trade name) manufactured by Mitsubishi Chemicals Industries Ltd. or Kayaset (trade name) manufactured by Nippon Kayaku Co., Ltd., which are commercially available as dyes for polyesters. From the standpoint of heat stability in resistance, particularly, an anthraquinone-series dye can be mentioned. For example, the dye described in JP-A-8-122970 is preferable for use.

Further, as the base, bases having a magnetic recording layer, as described, for example, in JP-A-4-124645, JP-A-5-40321, JP-A-6-35092, and JP-A-6-317875, is preferably used, to record photographing information or the like.

The magnetic recording layer refers to a layer provided by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape of the magnetic particles may be any of a needle shape, a rice grain shape, a spherical shape, a cubic shape, a tabular shape, and the like. The specific surface area of the magnetic particles is preferably 20 $m^2/g$ or more, and particularly preferably 30 $m^2/g$ or more, in terms of $S_{BET}$. The saturation magnetization ($\sigma s$) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or organic material, as described in JP-A-4-259911 and JP-A-5-81652, can be used.

The polyester base is heat-treated at a heat treatment temperature of generally 40° C. or over, but less than the Tg, and preferably at a heat treatment temperature of the Tg−20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine-particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the support means that, when a support is wound on a core, on its second and further windings, the support follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

Film magazines (patrones), into which the light-sensitive material can be housed, are described.

The major material of the magazine to be used in the present invention may be metal or synthetic plastic.

Further, the magazine may be one in which a spool is rotated to deliver a film. Also the structure may be such that the forward end of film is housed in the magazine body, and by rotating a spool shaft in the delivering direction, the forward end of the film is delivered out from a port of the magazine. These magazines are disclosed in U.S. Pat. No. 4,834,306, and U.S. Pat. No. 5,226,613.

The light-sensitive material as shown above can also be preferably used for a film unit with a lens, as described in, for example, JP-B-2-32615 and JU-B-3-39784 (the term "JU-B" used herein means an "examined Japanese utility model publication).

The film unit with a lens is one obtained by pre-loading, in a light-proofing manner, an unexposed color or monochrome photographic light-sensitive material, in a production process of a unit main body having, for example, an injection-molded plastic body, equipped with a photographing lens and shutter. The unit after photographing by a user, is transported, as such the unit, to a developing laboratory for development. In the laboratory, the photographed film is taken out of this unit, and development processing and photographic printing are carried out.

[III] Image-forming Method

Any method may be employed for development-processing the heat-developable light-sensitive material of the present invention, and generally the development-processing is performed by heating the light-sensitive material after image-wise exposure. Preferred embodiments of the apparatus for heat development to be used include to make the light-sensitive material contact with such an object as a heated block or plate, a hot plate, a hot presser, a heating roller, a heating drum, a halogen lamp heater, and an infrared or a far infrared lamp heater, and to passage the light-sensitive material through an atmosphere of a high temperature.

As a heat source, a heater such as a heated liquid, a dielectric substance, a microwave, or the like can be used, besides a conventional electric heater or lamp heater.

A preferred embodiment of the thermally-developing apparatus to be used is an apparatus of a type based on the contact of the heat-developable light-sensitive material with a heat source such as a heating roller or heating drum. As this type of thermally-developing apparatus, the developing apparatus for heat development described in JP-B-5-56499, Japanese Patent No. 684453, JP-A-9-292695, JP-A-9-297385, and WO95/30934 can be used. As a non-contact-type, the apparatus described in JP-A-7-13294 and WO97/28489, WO97/28488, and WO97/28487 can be used.

A preferable temperature for development is in the range of 100 to 350° C. and a more preferable temperature for development is in the range of 130 to 200° C. A preferable time for development is in the range of 1 to 60 seconds and a more preferable time for development is in the range of 3 to 30 seconds.

The light-sensitive material and/or the processing element for use in the present invention may be in the form that has an electroconductive heat-generating material layer as a heating means for heat development. In this case, as the heat-generating element, one described, for example, in JP-A-61-145544 can be employed.

The heating mode is as follows. The light-sensitive material in a state of a film after photographing is normally separated from a magazine or cartridge and the heat development processing is carried out using the film in a naked state. For example, a method disclosed in JP-A-2000-171961, in which heat development is carried out while the film is being pulled out of a thrust cartridge and, at the time point when the development of the final part is over, the film after the development is again enclosed in the thrust cartridge, is also preferable. Alternatively, a light-sensitive material, which is enclosed in a magazine or cartridge by being rolled, may undergo heat development by heating the entire container from outside.

In the present invention, after the colored image is formed by heat development, the remaining silver halide and/or developed silver may or may not be removed. The method for outputting on another material based on image information may be a method based on ordinary projection exposure, or a method in which the image information is photoelectrically read out by measuring the density of transmitted light and output is made in accordance with the signals obtained. The material on which the output is made does not need to be a light-sensitive material. For example, the material may be a sublimation-type heat-sensitive recording material, a material for ink-jet, an electrophotographic material, or a full-color direct heat-sensitive recording material.

As another preferable embodiment of the present invention, mention can be made of the following method:

An image-forming method, comprising the steps of:

subjecting a light-sensitive material to exposure to light;

subjecting the light-sensitive material to heat-development, thereby giving an image data on the light-sensitive material; and forming, based on the image data, a color image on a recording material that is different from the light-sensitive material, wherein the light-sensitive material contains, on a support, a silver halide, a binder, and the color-developing agent represented by formula (1), and wherein the light-sensitive material comprises at least three photosensitive layers each of which has spectral sensitivity different from each other and which can form a dye image having the maximum absorption wavelength in a wavelength range different from each other.

In the above-mentioned image-forming method, an image data in a visible range and an image data in a non-visible range are read from the image date formed on the light-sensitive material, thereby a color image can be formed on another recording material on the basis of both the image data. By using the light-sensitive material further comprising at least one compound which can form a dye having a maximum absorption wavelength in a non-visible absorption wavelength range, the light-sensitive material is subjected to exposure to light and heat-development, thereby giving an image data on the light-sensitive material, and on the basis of this image data a color image can be preferably formed on another recording material.

In the present invention, an example of preferred embodiments is as follows. Image information is photoelectrically read by means of transmission density measurement using diffused light and a CCD image sensor after the formation of a colored image by heat development, without performing an additional treatment for removal of the remaining silver halide and developed silver. The image information is then converted into digital signals which, after image treatment, are outputted by means of a heat development color printer, for example, Pictrography 3000 (trade name) manufactured by Fuji Photo Film Co., Ltd. In this case, it is also possible to obtain an excellent print in a rapid way, without using any processing solution that is used in conventional color photography. Further, in this case, since the digital signals can be processed and edited arbitrarily, the correction, modification, and processing of the photographed image can be freely made before output of the image.

In the present invention, a separate bleach-fixing step, for further removal of silver halide and developed silver remaining in the light-sensitive material after development, is not essential. However, for the purposes of lessening the load required for reading the image information and enhancing the image storability, a fixing step and/or bleaching step may be provided. In that case, although a conventional processing using a liquid is possible, a processing step described in JP-A-9-258402, in which the light-sensitive material is put together with another sheet coated with a processing agent and heated together, is preferable. In this case, the heating temperature is preferably a temperature (e.g. 50° C.) the same level as in the development processing. It is particularly preferable to set the heating temperature to the same temperature as that of the development processing.

In the present invention, after an image is obtained on the light-sensitive material, a color image is obtained on another recording material based on the image information. As an example of this method, image information is photoelectrically read by means of density measurement of transmitted light, and the image information is then converted into digital signals which, after image treatment, are outputted onto the another recording material. The material on which the output is made may be a sublimation-type heat-sensitive recording material, a full-color direct heat-sensitive recording material, a material for ink-jet, or an electrophotographic material, besides a light-sensitive material using a silver halide.

In the present invention, it is necessary to read out the image formed on the light-sensitive material after heat development, and to convert the information into digital signals. As the apparatus for reading out the image, an image input device that is generally known can be used. Details of the image input device are described, for example, by Takao Andoh, et al., in "Principles of Digital Image Input", pages 58–98, Corona Publishing Co., Ltd. (1998).

The image input device is required to take in a vast amount of image information in an efficient way. The image input device is roughly divided into a linear sensor and an area sensor, in terms of the arrangement of fine point sensors. The former comprises a large number of point sensors arranged on a line. When it is used for taking in a planar image, either the light-sensitive material side or the sensor side needs to be scanned. Therefore, although the readout requires a little longer time, the manufacturing cost of the former sensor is inexpensive, which is one of merits. As for the area sensor, since readout can be made basically without scanning of the light-sensitive material or the sensor, a large-sized sensor needs to be used although the readout speed is high. Therefore, the cost becomes higher. These sensors can be used selectively according to the purposes and both of them can be used preferably in the present invention.

The kinds of the sensors include an electronic tube-type, such as a photographic tube or an image tube, and a solid-state photographing system, such as CCD-type or MOS-type. In view of costs and ease in handling, a solid-state photographing system, in particular a CCD-type, is preferable.

As for the apparatus installed with such image input device, although commercially obtainable digital still cameras, drum scanners, flat bed scanners, film scanners, and the like can be used, the use of a film scanner is preferable in order to read out a high-quality image in an easy and simple manner.

Typical commercialized film scanners include those using a linear CCD, such as Film Scanner LS-1000 (trade name) manufactured by Nikon, Duoscan HiD (trade name) manufactured by Agfa, Flextightphoto (trade name) manufactured by Imacon, and the like. In addition, RFS3570 (trade name) manufactured by Kodak, and the like, which uses an area CCD, can be preferably used.

Further, the image input device by using an area CCD, which is installed in Digital Print System Frontier (trade name) manufactured by Fuji Photo Film Co., Ltd., can also be preferably used. Furthermore, the image input device of Digital Print System Frontier F350 (trade name), which realizes high-quality image readout in a high speed, even by using a liner CCD sensor, as described by Yoshio Ozawa, et al. in Fuji Film Research Report No.45, pages 35–41, is particularly suitable to the readout of the heat-developable light-sensitive material of the present invention.

In the case in which an image data on the photosensitive material is read out by an image sensor such as a CMOS or a CCD, a wavelength range of an image to be read out can be set by combining a light source to be used for the reading-out, a color filter for the light source and color sensitive property of the image sensor. Examples of the light source for the reading-out include lamps such as xenon, halogen and tungsten lamps, an LED and a laser.

In order to reproduce a good color image, it is preferred to read out an image data within ±50 nm from each of three maximum absorption wavelength ranges of the dyes which are formed in the respective color sensitive layers and have the maximum absorption wavelengths in different ranges, and then make an appropriate operation. The photosensitive material containing a yellow-developing coupler, a magenta-developing coupler and a cyan-developing coupler, each of which has a maximum absorption wavelength in a visible wavelength range, is usually used to read out respective dye image data through blue, green and red light rays. By replacing at least one of the couplers which can form the dyes having the maximum absorption wavelengths in the visible wavelength range by a coupler which can form a dye having a maximum absorption wavelength in a non-visible wavelength range, an image data in the non-visible wavelength range may be read out. Two or more compounds which can form dyes having maximum absorption wavelengths in different non-visible wavelength ranges may be used. As the light source having a non-visible wavelength used for reading-out, a high-brightness LED is easily available. As the image sensor, a CCD is preferred since it has a high sensitivity in an infrared wavelength range.

Examples of image-processing methods that can be preferably employed in the image-forming method of the present invention include the following methods.

JP-A-6-139323 describes an image-processing system and an image-processing method, capable of faithfully reproducing the color of a subject from a negative film, comprising the steps of: forming the image of a subject on a color negative, converting the image into corresponding image data by means of a scanner or the like, and outputting the same color as that of the subject based on the restored color information. This method may be employed in the present invention.

Further, as to the image-processing method for controlling the granularity or noise of the digitized image and emphasizing the sharpness, a method described in JP-A-10-243238, in which weighting, granulation, and the like of edge and noise are carried out based on sharpness-emphasizing image data, smoothening image date, and edge detection data, and a method described in JP-A-10-243239, in which weighting, granulation, and the like are carried out by obtaining edge components based on sharpness-emphasizing image data and smoothening image data, may be used.

Further, in order to compensate the fluctuation on color reproductivity of the final print, which fluctuation is caused by the difference of storing conditions, developing conditions, and the like, of photographic materials for shooting, in a digital color print system, a method described in JP-A-10-255037, which comprises the steps of: subjecting the unexposed portions of the photographic material to a patch-wise exposure of 4 or more steps or colors, measuring the patch densities after development, getting a lookup table and color transformation matrix necessary for compensating, and carrying out color correction of a photographic image by using lookup table transformation or matrix calculation, can be used.

As to a method for transforming the color reproduction regions of image data, for example, a method described in JP-A-10-229502, in which, when values for components are obtained, based on the image data that are expressed in color signals constituting colors visually recognizable as neutral colors, the color signals are decomposed into a chromatic component and an achromatic component so that these components are separately processed, can be used.

Further, as to an image-processing method for eliminating image defects, such as aberration due to camera lens and drop in peripheral light amount, in an image photographed using a camera, an image-processing method and an apparatus therefor described in JP-A-11-69277, which comprises the steps of: recording in a film, in advance, a lattice-like compensating pattern for making data to correct image deterioration, reading out the image and compensating pattern by means of a film scanner or the like after photographing, making data for correcting the deterioration factors due to lens of camera, and correcting the digital image data by using the data intended to correct the image deterioration, may be used.

Furthermore, if sharpness is emphasized excessively, the skin color and blue sky give an unpleasant impression because granularity (noise) is emphasized excessively. Therefore, it is desired to control the degree of sharpness emphasis on the skin color and blue sky. As an example of this method, as described, for example, in JP-A-11-103393, a sharpness emphasizing processing using unsharp masking (USM), in which the USM coefficient is made into a function of (B-A)(R-A), may be used.

Skin color, grass green color, and blue sky color are called important colors in terms of color reproduction, and selective color reproduction processing are required. As to reproduction of lightness, the reproduction, in which the skin color is made bright and the blue sky is made dark, is said to be visually pleasant. As to a method for reproducing the important colors with visually pleasant brightness, for example, a method described in JP-A-11-177835, in which the color signal of each pixel is transformed by using a coefficient that takes a small value if the corresponding hue is yellowish red such as (R-G) or (R-B), and that takes a large value if the corresponding hue is cyan blue, may be adopted.

As to a method for compacting color signals, a method described, for example in JP-A-11-113023, which comprises the steps of: separating the color signal of each pixel into a lightness component and a chromaticity component, and encoding the color hue information by selecting, to the chromaticity component, a template whose numeral pattern is the most suitable from plural hue templates prepared in advance, may be used.

In addition, at the time of processing for raising chroma or sharpness, in order to carry out natural emphasis with inhibiting imperfections, such as color blindness, washing out highlight tone, and leaving high-density portions flat, and data generation outside the defined region, an image-processing method and an apparatus therefor, as described in JP-A-11-177832, which comprises the steps of: making each color density data of a color image data into exposure density data by using a characteristic curve, and making the resulting data into density data by the characteristic curve after carrying out image processing including color emphasis, can be used.

Furthermore, it is also preferred to read out an image data in a range in which all absorptions of the dyes formed in the respective color sensitive layers are smallest, preferably an image data in an infrared wavelength range, together with the image data in the maximum absorption ranges of the dyes, and then make an operation by the use of all the data together, whereby eliminating unnecessary image data, such as data on injuries on the photosensitive material, noises, and remaining developed silver. Image data in two or more different non-visible wavelength ranges may be read out by replacing the coupler which can form a dye having a maximum absorption wavelength in a visible wavelength range by the couplers which can form dyes having maximum wavelength ranges in non-visible wavelengths. The unnecessary image data, such as data on injuries on the photosensitive material, noises, and remaining developed silver may be removed, using data in the visible wavelength range.

The novel silver halide color photographic light-sensitive material of the present invention, preferably a heat-developable light-sensitive material, is good in photographic performances such as sensitivity and prevention of fogging, by using a coupling system utilizing an incorporated color-developing agent.

The silver halide color photographic light-sensitive material of the present invention, preferably a heat-developable light-sensitive material, is good in photographic performances such as sensitivity, by using a specific color-developing agent having high developing activity and color-forming property. Further, according to the silver halide color photographic light-sensitive material of the present invention, an image-forming method making rapid processing possible and giving a good image quality can be provided.

By using a specific color-developing agent, the silver halide color photographic light-sensitive material of the present invention can realize a high developed color density without an increase in fog, particularly in a heat-developing manner, and it can form a color image high in sensitivity and color chroma and less in color mixing. Therefore, the light-sensitive material of the present invention is very useful for photosensitive materials for silver halide color photography.

The present invention is described in more detail based on the following examples, but the present invention is not limited thereto.

EXAMPLES

Example 1

Preparation of a Silver Halide Emulsion Having High Sensitivity 0.37 g of gelatin having an average molecular weight of 15,000, 0.37 g of oxidation-treated gelatin, and 930 ml of distilled water containing 0.7 g of potassium bromide were placed in a reaction vessel, and the temperature was elevated to 38° C. 30 ml of an aqueous solution containing 0.34 g of silver nitrate and 30 ml of an aqueous solution containing 0.24 g of potassium bromide were added to the resulting solution, over 20 sec, with vigorous stirring. After the completion of the addition, the temperature was kept at 40° C. for 1 min, and then, the temperature of the reaction liquid was raised to 75° C. After 27.0 g of gelatin whose amino group was modified with trimellitic acid, was added together with 200 ml of distilled water, then 100 ml of an aqueous solution containing 23.36 g of silver nitrate and 80 ml of an aqueous solution containing 16.37 g of potassium bromide were added, over 36 min, with the flow rate of the addition being accelerated. Then, 250 ml of an aqueous solution containing 83.2 g of silver nitrate, and an aqueous solution containing potassium iodide and potassium bromide in a molar ratio of 3:97 (the concentration of potassium bromide: 26% by mass), were added, over 60 min, with the flow rate of the addition being accelerated, so that the silver electric potential of the reaction liquid would become −50 mV to a saturated calomel electrode. Further, 75 ml of an aqueous solution containing 18.7 g of silver nitrate, and a 21.9% by mass aqueous solution of potassium bromide, were added, over 10 min, so that the silver electric potential of the reaction liquid would become 0 (zero) mV to the saturated calomel electrode. After the completion of the addition, the temperature was kept at 75° C. for 1 min, and then the temperature of the reaction liquid was dropped to 40° C. Then, 100 ml of an aqueous solution containing 10.5 g of sodium p-iodoacetamidobenzenesulfonate (monohydrate) was added thereto, and the pH of the reaction liquid was adjusted to 9.0. Further, 50 ml of an aqueous solution containing 4.3 g of sodium sulfite was added thereto. After the completion of the addition, the temperature was kept 40° C. for 3 min, and the temperature of the reaction liquid was raised to 55° C. After adjusting the pH of the reaction liquid to 5.8, 0.8 mg of sodium benzenethiosulfinate, 0.04 mg of potassium hexachloro iridate (IV) and 5.5 g of potassium bromide were added, kept at 55° C. for 1 min, and further, 180 ml of an aqueous solution containing 44.3 g of silver nitrate, and 160 ml of an aqueous solution containing 34.0 g of potassium bromide and 8.9 mg of potassium hexacyano ferrate (II) were added over 30 min. The temperature was then dropped, and then desalting was carried out by a usual manner. After the completion of the desalting, a gelatin was added so that the total gelatin content would be 7% by mass, and pH was adjusted to 6.2.

The resulting emulsion was an emulsion containing hexagonal tabular grains, wherein the average grain size represented by a sphere-equivalent diameter (the diameter of a sphere having a volume equivalent to that of an individual grain) was 1.15 μm, the average grain thickness was 0.12 μm, and the average aspect ratio was 24.0. This emulsion was designated as Emulsion A-1.

By changing the amounts of silver nitrate and potassium bromide that were added at the first of the formation of grains, the number of nuclei to be formed was changed from those adopted in the case of Emulsion A-1, to prepare Emulsion A-2, comprising hexagonal tabular grains having an average grain size of 0.75 μm in terms of a sphere-equivalent diameter, an average grain thickness of 0.11 μm, and an average aspect ratio of 14.0; and Emulsion A-3, comprising hexagonal tabular grains having an average grain size of 0.52 μm in terms of a sphere-equivalent diameter, an average grain thickness of 0.09 μm, and an average aspect ratio of 11.3. In these cases, the amounts to be added of potassium hexachloroiridate (IV) and potassium hexacyanoferrate (II) were changed in inverse proportion to the volume of grains, and the amount of sodium p-iodoacetoamidobenzenesulfonate monohydrate to be added was changed in proportion to the circumferential length of an individual grain. 5.6 ml of an aqueous solution containing 1 mass % of potassium iodide was added to the Emulsion A-1 at a temperature of 40° C., to which were then added $8.2\times10^{-4}$ mol/mol Ag of the spectrally-sensitizing dye shown below, Compound 1, potassium thiocyanate, chloroauric acid, sodium thiosulfate, and mono (pentafluorophenyl)diphenylphosphineselenide, to carry out spectral sensitization and chemical sensitization. After the chemical sensitization was completed, the stabilizer S was added. At this time, the amount of the chemical sensitizer was adjusted so as to make the level of chemical sensitization for the emulsion optimal. The structure of Spectrally-sensitizing dye, Compound 1 and stabilizer S will be illustrated below.

Sensitizing Dye for Blue-sensitive Emulsion I $2.5\times10^{-4}$ mol/molAg to Emulsion A-1

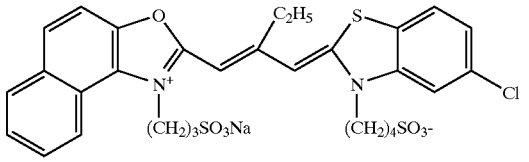

Compound 1

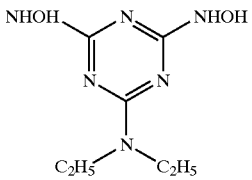

Stabilizer S (A Mixture of the Followings)

$2\times10^{-4}$ mol/molAg to Emulsion A-1 $8\times10^{-5}$ mol/molAg to Emulsion A-1

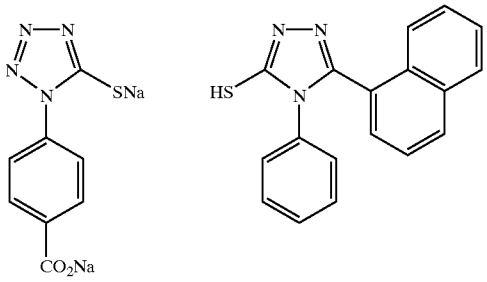

The resulting blue-sensitive emulsion was designated to as Emulsion A-1b. Similarly, by subjecting spectral sensitization and chemical sensitization to each emulsion, Emulsions A-2b and A-3b were prepared, respectively. The amount of the spectrally-sensitizing dye to be added was changed in accordance with the surface area of an individual grain of the silver halide in each emulsion. Further, the amount of each chemical used for the chemical sensitization was controlled so that the degree of the chemical sensitization to each emulsion was optimal in each emulsion.

Similarly, by changing the spectrally-sensitizing dye to the following dyes, respectively, Green-sensitive emulsions A-1g, A-2g, and A-3g, and Red-sensitive emulsions A-1r, A-2r and A-3r, were prepared.

Sensitizing Dye for Green-sensitive Emulsion I $5.5\times10^{-4}$ mol/molAg to Emulsion A-1

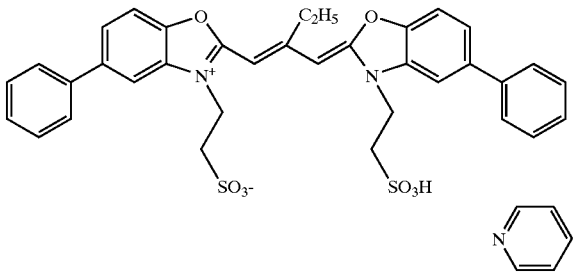

Sensitizing Dye for Green-sensitive Emulsion II $1.3\times10^{-4}$ mol/molAg to Emulsion A-1

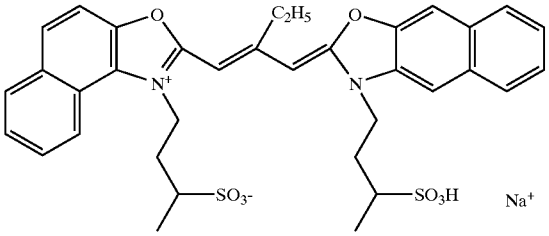

Sensitizing Dye for Green-sensitive Emulsion III $4.8\times10^{-5}$ mol/molAg to Emulsion A-1

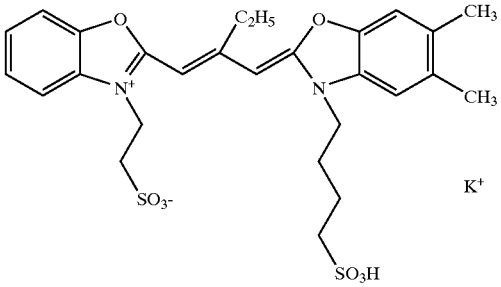

Sensitizing Dye for Red-sensitive Emulsion I $2.5\times10^{-4}$ mol/molAg to Emulsion A-1

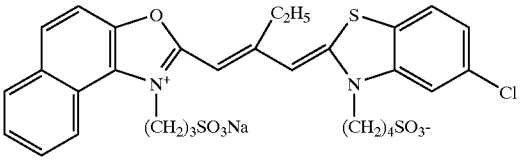

Sensitizing Dye for Red-sensitive Emulsion II $6.3\times10^{-5}$ mol/molAg to Emulsion A-1

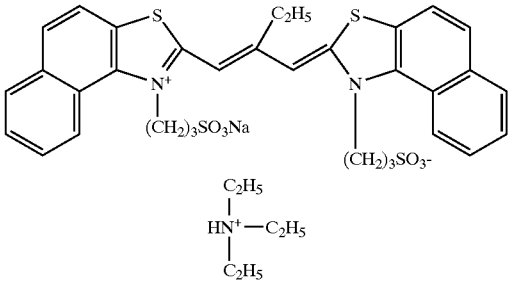

Sensitizing Dye for Red-sensitive Emulsion III $3.1\times10^{-4}$ mol/molAg to Emulsion A-1

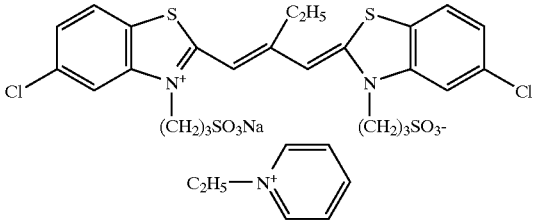

<Method for Preparing Silver 1-Phenyl-5-mercaptotetrazole>

431 g of lime-processed gelatin and 6569 ml of distilled water were placed in a reaction vessel. Then, solution B was prepared by mixing 320 g of 1-phenyl-5-mercaptotetrazole in 2044 ml of distilled water and 790 g of 2.5M sodium hydroxide aqueous solution. The solution B and, if necessary, nitric acid or sodium hydroxide, were added to the reaction mixture in the reaction vessel, so that the pAg and the pH were adjusted to 7.25 and 8.00, respectively.

To the above-mentioned reaction vessel was added 3200 ml of 0.54M silver nitrate aqueous solution, at the rate of 250 ml/min, with vigorous stirring, and simultaneously, the solution B was added to the reaction solution near the stirrer, while controlling so as to maintain 7.25 of the pAg of the reaction solution. After the completion of the addition, the mixture was condensed by subjecting to ultrafiltration, so that a dispersion containing fine particles of the silver salt of 1-phenyl-5-mercaptotetrazole was obtained.

<Method for Preparing Silver Benzotriazole>

0.34 g of benzotriazole, 0.24 g of sodium hydroxide, and 25 g of phthalated gelatin were dissolved in 700 mL of water. The solution was kept at 60° C. and stirred. Then, to the solution, were added a solution prepared by dissolving 3.4 g of benzotriazole and 1.2 g of sodium hydroxide in 150 mL of water, and a solution prepared by dissolving 5 g of silver nitrate in 150 mL of water, simultaneously, near a stirrer, over a period of time of 4 minutes. The resulting solution was stirred for 5 minutes. After that, to the solution were added a solution prepared by dissolving 3.4 g of benzotriazole and 1.2 g of sodium hydroxide in 150 mL of water, and a solution prepared by dissolving 5 g of silver nitrate in 150 mL of water, simultaneously, near the stirrer, over a period of time of 6 minutes. The pH of the resulting emulsion was adjusted so as to cause sedimentation, and excess salt was removed. After that, the pH was adjusted to 6.0, and a silver benzotriazole emulsion in an yield of 470 g was obtained.

<Preparation of Dispersion (a) of Solid Fine-particles of a Base Precursor>

64 g of a base precursor compound BP-35, 28 g of a diphenylsulfone, and 10 g of a surfactant Demol N ((trade name) manufactured by Kao Corp.) were mixed with 220 ml of distilled water, and the mixed solution was subjected to beads dispersion using a sand mill (¼ Gallon sand grinder mill, manufactured by Imex Co.), to obtain Dispersion (a) of solid fine-particles of the base precursor compound, having an average particle diameter of 0.2 μm.

<Preparation of Dispersion of Solid Fine-particles of a Dye>

9.6 g of a cyanine dye compound and 5.8 g of sodium p-dodecylbenzenesulfonate were mixed with 305 ml of distilled water, and the mixed solution was subjected to beads dispersion using a sand mill (¼ Gallon sand grinder mill, manufactured by Imex Co.), to obtain a dispersion of solid fine-particles of the dye having an average particle diameter of 0.2 μm. The structures of base precursor compound BP-35 and cyanine dye compound will be illustrated below.

Base Precursor Compound BP-35

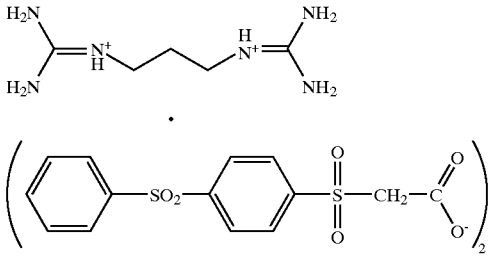

Cyanine Dye Compound (Dye-1)

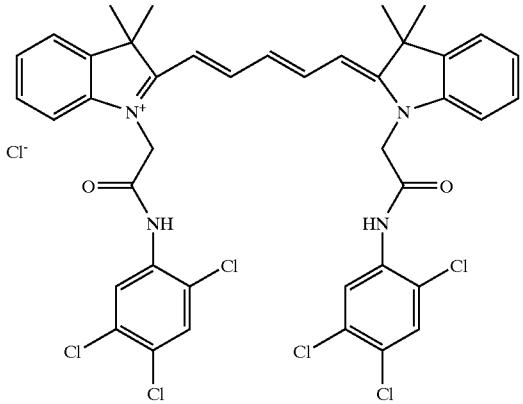

<Preparation of Support>

In preparation of light-sensitive materials, preparation of a support, and coating of an undercoat layer, an antistatic layer (1st backing layer), a magnetic recording layer (2nd backing layer), and the 3rd backing layer, were carried out as follows.

(1) Preparation of Support

The support used in this example was prepared by the following method. 100 parts by mass of polyethylene-2,6-naphthalanedicarboxyrate (PEN), and 2 parts by mass of Tinuvin P.326 (trade name, manufactured by Ciba-Geigy AG) as a ultraviolet absorber, were mixed uniformly, and then the resultant mixture was melted at 300° C. The melted mixture was extruded from a T-die and stretched 3.3 times in a lengthwise direction at 140° C., and 4.0 times in a width direction. The resulting product was thermally fixed at 250° C. for 6 seconds, to obtain a PEN film with a thickness of 90 μm. To this PEN film were added a blue dye, a magenta dye, and a yellow dye (I-1, I-4, I-6, I-24, I-26, I-27 and II-5, as described in Kokai Giho: Kogi No. 94-6023) in appropriate amounts. Moreover, the PEN film was wound around a stainless core (spool) having a diameter of 30 cm, and thermal history was imparted thereto at 110° C. for 48 hours, to obtain a support having suppressed core set curl.

(2) Coating of an Undercoat Layer

Both surfaces of the PEN support were subjected to glow treatment according to the following procedure. Four rod-like electrodes, each having a diameter of 2 cm and a length of 40 cm, were fixed onto an insulator plate, at an interval of 10 cm, in a vacuum tank. In this case, an arrangement was made such that the film traveled at a distance of 15 cm from the electrodes. Further, a heating roller, which had a diameter of 50 cm and was equipped with a temperature controller, was positioned immediately before the electrodes such that the film would contact ¾ periphery of the heating roll. A biaxially stretched film, which had a thickness of 90 μm and a width of 30 cm, was caused to travel, and the film was heated by use of the heating roller so that the temperature of the film face between the heating roller and the electrode zone would be 115° C. Then, the film was transferred at a speed of 15 cm/second, and glow treatment was carried out.

The pressure inside the vacuum tank was 26.5 Pa and the $H_2O$ partial pressure of the atmospheric gas was 75%. The discharge frequency was 30 kHz, the output power was 2500W, and the processing intensity was 0.5 kV·A·min/m$^2$. The electrode for vacuum glow discharge was in accordance with the method described in JP-A-7-3056.

One surface (i.e., emulsion side) of the PEN support after the glow treatment was coated with the undercoat layer having the following composition. The dry film thickness was designed to become 0.02 μm. The drying temperature was 115° C. and the drying time was 3 minutes.

| | |
|---|---|
| Gelatin | 83 parts by mass |
| Water | 291 parts by mass |
| Salicylic acid | 18 parts by mass |
| Aerosil R972 (trade name, manufactured by Nippon Aerosil Co., Ltd., colloidal silica) | 1 part by mass |
| Methanol | 6900 parts by mass |
| n-Propanol | 830 parts by mass |
| Polyamide/epichlorohydrin resin described in JP-A-51-3619 | 25 parts by mass |

(3) Coating of an Antistatic Layer (1st Backing Layer)

A mixture of 40 parts by mass of SN-100 (trade name, manufactured by Ishihara Sangyo Kaisha, Ltd., electroconductive fine-particles) and 60 parts by mass of water was stirred by a mixer, while adding a 1N sodium hydroxide aqueous solution to the mixture, to carry out dispersing roughly. After that, the resultant mixture was dispersed in a horizontal sand mill. In this way a dispersion of electroconductive fine-particles having an average particle diameter of secondary particles of 0.06 μm (pH=7.0) was obtained.

A coating solution having the following composition was coated on the surface-treated PEN support (back side) such that the coating amount of the electroconductive fine-particles would be 270 mg/m$^2$. The drying condition was 115° C. and 3 minutes.

| | |
|---|---|
| SN-100 (trade name, manufactured by | 270 parts by mass |

-continued

| | |
|---|---|
| Ishihara Sangyo Kaisha, Ltd., electro-conductive fine-particles) | |
| Gelatin | 23 parts by mass |
| Rheodol TW-L120 (trade name, manufactured by Kao Corporation., surfactant) | 6 parts by mass |
| Denakol EX-521 (trade name, manufactured by Nagase Chemicals, Ltd., hardener) | 9 parts by mass |
| Water | 5000 parts by mass |

(4) Coating of a Magnetic Recording Layer (2nd Backing Layer)

Magnetic particles CSF-4085V2 (Co-coated $\gamma$-$Fe_2O_3$, trade name, manufactured by Toda Kogyo Corp.) was surface-treated with X-12-641 (a silane coupling agent, trade name, manufactured by Shin-Etsu Chemical Co., Ltd.) in an amount of 16% by mass relative to the magnetic particles.

A coating solution having the following composition was coated on the 1st backing layer such that the coating amount of the CSF-4085V2 treated with the silane coupling agent became 62 mg/$m^2$. The method for dispersing the magnetic particles and abrasive particles was in accordance with the method described in JP-A-6-035092. The drying condition was 115° C. and 1 minute.

| | |
|---|---|
| Diacetyl cellulose (binder) | 1140 parts by mass |
| X-12-641-treated CSF-4085V2 (magnetic particles) | 62 parts by mass |
| AKP-50 (trade name, alumina manufactured by Sumitomo Chemical Co., Ltd., abrasive) | 40 parts by mass |
| Millionate MR-400 (trade name, manufactured by Nippon Polyurethane Industry Co., Ltd., hardener) | 71 parts by mass |
| Cyclohexanone | 12000 parts by mass |
| Methyl ethyl ketone | 12000 parts by mass |

The color density increment of $D_B$ of the magnetic recording layer according to X-light (blue filter) was about 0.1, the saturation magnetization moment of the magnetic recording layer was 4.2 emu/g, the coercive force was $7.3\times10^4$ A/m, and the angularity ratio was 65%.

(5) Coating of the 3rd Backing Layer

The 3rd backing layer was coated at a side of the magnetic recording layer of the light-sensitive material. Wax (1-2) having the following structure was dispersed by emulsification in water by means of a high-pressure homogenizer, and a wax aqueous dispersion having a concentration of 10% by mass and a weight average particle diameter of 0.25 $\mu$m was obtained.

Wax (1-2) n-$C_{17}H_{35}COOC_{40}H_{81}$-n

A coating solution having the following composition was coated on the magnetic recording layer (2nd backing layer) such that the coating amount of the wax became 27 mg/$m^2$. The drying condition was 115° C. and 1 minute.

| | |
|---|---|
| Wax aqueous dispersion (10% by mass) as described above | 270 parts by mass |
| Pure water | 176 parts by mass |
| Ethanol | 7123 parts by mass |
| Cyclohexanone | 841 parts by mass |

(Preparation of an Emulsified Dispersion Containing a Coupler)

8.95 g of yellow coupler (CPY-1), 0.90 g of development accelerator (X), 4.54 g of high-boiling organic solvent (e), 4.54 g of high-boiling organic solvent (f), and 50.0 ml of ethyl acetate were mixed at a temperature of 60° C. The resulting solution was mixed with 200 g of an aqueous solution containing 18.0 g of lime-processed gelatin and 0.8 g of sodium dodecylbenzenesulfonate dissolved therein, and the resultant mixture was emulsified and dispersed at 10,000 rpm for 20 minutes, using a dissolver stirrer. After the dispersion, distilled water was added to bring the total weight to 300 g, and they were mixed at 2,000 rpm for 10 minutes.

An emulsion was produced in the same manner except that 8.95 g of yellow coupler (CPY-1) was changed to 8.95 g of yellow coupler (CPY-2). The structures of the yellow coupler (CPY-1), the yellow coupler (CPY-2), the development accelerator (X), and the high-boiling organic solvent (e) and the high-boiling organic solvent (f) will be illustrated below.

Yellow Coupler (CPY-1)

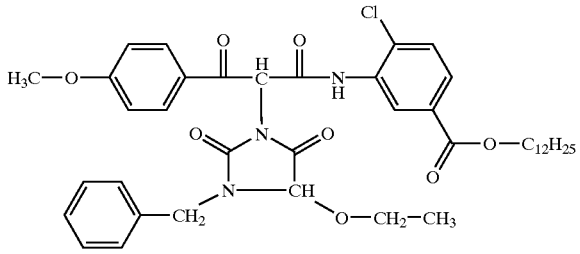

Yellow Coupler (CPY-2)

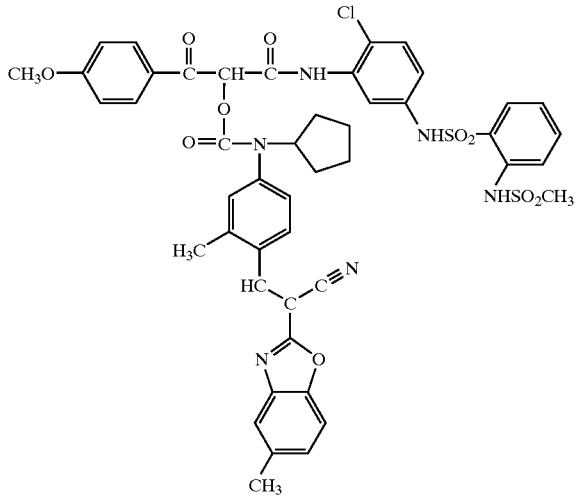

Development Accelerator (X)

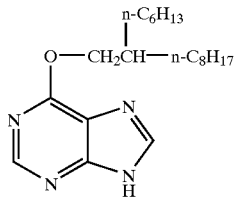

High-boiling Organic Solvent (e)

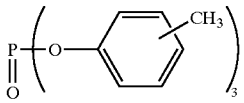

High-boiling Organic Solvent (f)

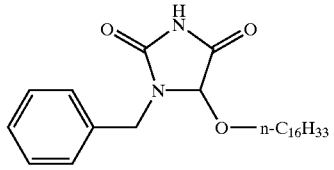

Next, a dispersion of a magenta coupler and a dispersion of a cyan coupler were also prepared.

4.68 g of magenta coupler (CPM-1), 2.38 g of magenta coupler (CPM-2), 0.71 g of Development accelerator (X), 7.52 g of high-boiling organic solvent (e), and 38.0 ml of ethyl acetate were mixed at a temperature of 60° C. The resulting solution was mixed with 150 g of an aqueous solution containing 12.2 g of lime-processed gelatin and 0.8 g of sodium dodecylbenzenesulfonate dissolved therein, and the resultant mixture was emulsified and dispersed at 10,000 rpm for 20 minutes, using a dissolver stirrer. After the dispersion, distilled water was added to bring the total weight to 300 g, and they were mixed at 2,000 rpm for 10 minutes.

An emulsion was produced in the same manner except that 4.68 g of magenta coupler (CPM-1) and 2.38 g of magenta coupler (CPM-2) were changed to 4.68 g of the magenta coupler (CPM-3) and 2.38 g of the magenta coupler (CPM-2), respectively. The structures of the magenta coupler (CPM-1), the magenta coupler (CPM-2), and the magenta coupler (CPM-3) will be illustrated below.

Magenta Coupler (CPM-1)

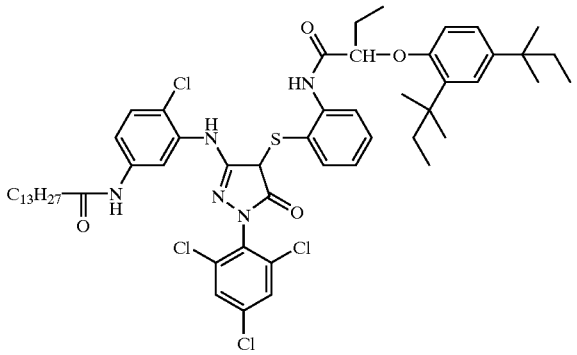

Magenta Coupler (CPM-2)

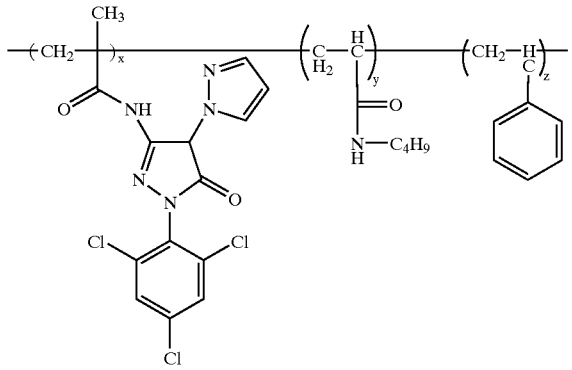

Magenta Coupler (CPM-3)

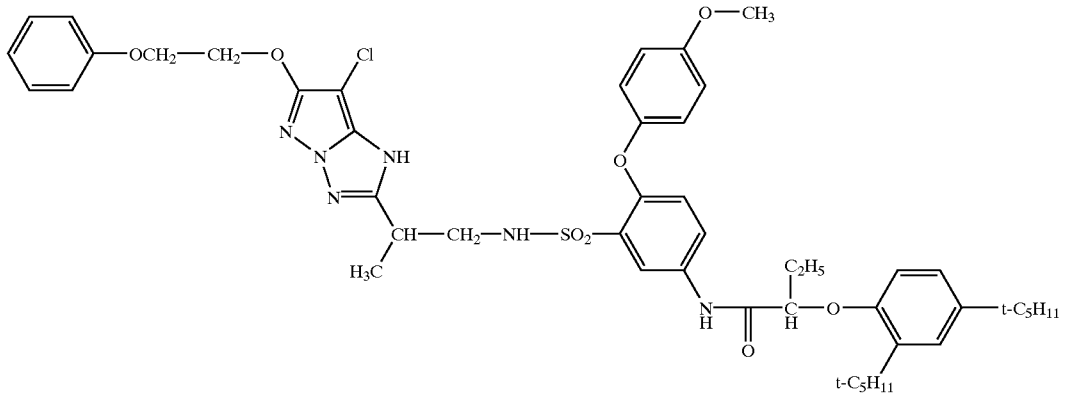

7.32 g of cyan coupler (CPC-1), 3.10 g of cyan coupler (CPC-2), 1.04 g of Development accelerator (X), 11.62 g of high-boiling organic solvent (e), and 38.0 ml of ethyl acetate were mixed at a temperature of 60° C. The resulting solution was mixed with 150 g of an aqueous solution containing 12.2 g of lime-processed gelatin and 0.8 g of sodium dodecylbenzenesulfonate dissolved therein, and the resultant mixture was emulsified and dispersed at 10,000 rpm for 20 minutes, using a dissolver stirrer. After the dispersion, distilled water was added to bring the total weight to 300 g, and they were mixed at 2,000 rpm for 10 minutes.

An emulsion was produced in the same manner except that 7.32 g of cyan coupler (CPC-1) and 3.10 g of cyan coupler (CPC-2) were changed to 7.32 g of cyan coupler (CPC-3) and 3.10 g of cyan coupler (CPC-4), respectively. The structures of the cyan coupler (CPC-1), the cyan coupler (CPC-2), the cyan coupler (CPC-3) and the cyan coupler (CPC-4) will be illustrated below.

Cyan Coupler (CPC-1)

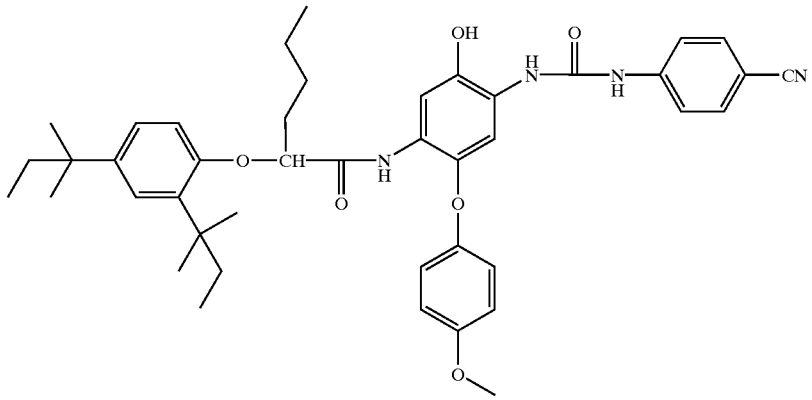

Cyan Coupler (CPC-2)

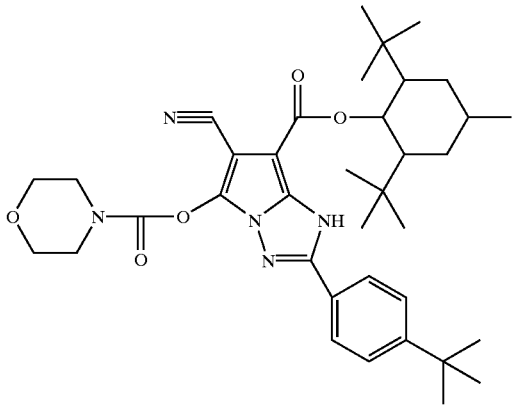

Cyan Coupler (CPC-3)

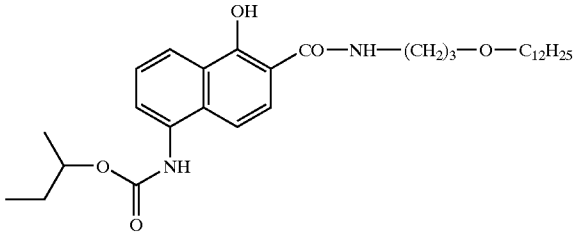

Cyan Coupler (CPC-4)

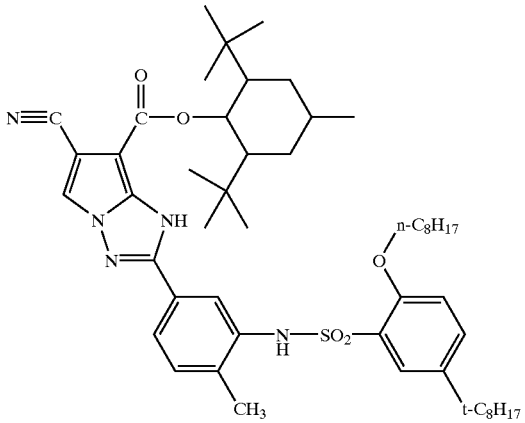

(Preparation of Solid Dispersion of a Developing Agent to be Incorporated in a Light-sensitive Material)

The dispersion of fine crystals of the developing agent DEVP-1X to be incorporated in a light-sensitive material was prepared according to the following method. To 50 g of the incorporated developing agent DEVP-1X and 30 g of a 10% by mass aqueous solution of modified polyvinyl alcohol (Poval MP203, trade name, manufactured by Kuraray Co., Ltd.), were added 1.0 g of Surfactant 10G (trade name, manufactured by Arch Chemicals Co.) and 100 g of water, and these were mixed well so as to prepare a slurry. The slurry was fed by means of a diaphragm pump and dispersed for 6 hours in a horizontal and mill (UVM-2: trade name, manufactured by Imex Co., Ltd.) loaded with zirconia beads having an average diameter of 0.5 mm. After that, water was added to the dispersion thus obtained such that the concentration of the intended compound became 10% by mass. In this way, the dispersion of the intended compound was obtained. The particles contained in the dispersion of the intended compound had a median diameter of 0.50 μm and a maximum particle diameter of 1.5 μm or less. The dispersion of the intended compound was filtered through a polypropylene filter having a pore diameter of 10.0 μm so that foreign matters, such as foreign particles, were eliminated. After that, the dispersion was stored. Immediately before use, the dispersion was filtered again through a polypropylene filter having a pore diameter of 10 μm.

Emulsions of DEVP-2X, DEVP-3X, DEVP-4X and the color developing agents for use in the present invention were also prepared as in the same manner mentioned above. Further, DEVP-1X is the compound D-28 described in EP 111332 A2, and DEVP-2X and DEVP-3X are the compounds D-28 and D-10 described in EP 1113322 A2, respectively. Further, DEVP-4X is the compound described JP-A-2002-116521.

DEVP-1X

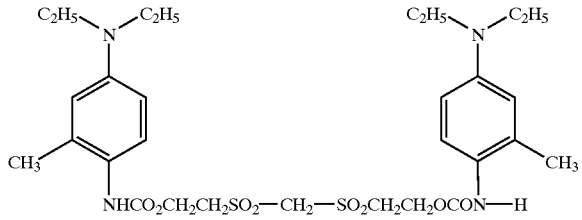

DEVP-2X

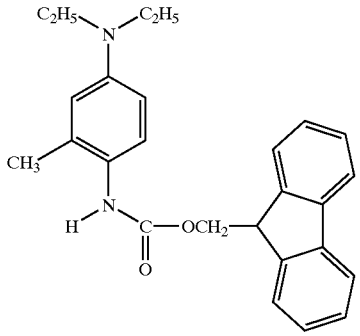

DEVP-3X

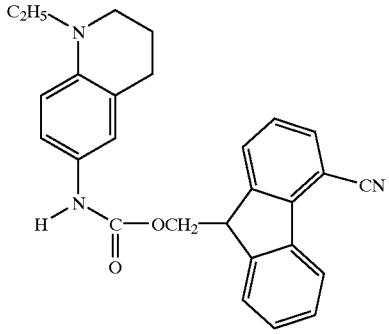

DEVP-4X

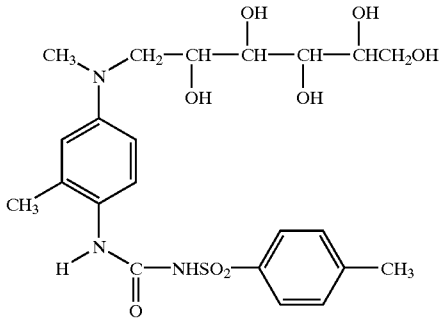

Further, dispersions of dyes, which were decolored at the time of heating, to color an intermediate layer as a filter layer and an antihalation layer, were prepared in the following manner.

<Preparation of a Dispersion of a Dye for Yellow Filter (YH) Layer>

10 g of leuco dye (L1), 40 g of stearyl alcohol and 10 g of color developer (SD-1) were dissolved in 200 ml of ethyl acetate. The resulting solution was mixed with 600 g of an aqueous solution containing 2.0 g of surfactant (r) dissolved therein, and the resultant mixture was emulsified and dispersed at 10,000 rpm for 20 minutes using a dissolver stirrer. After the dispersion, ethyl acetate was removed from the dispersion by a desolvation of stirring for 30 minutes, under a nitrogen atmosphere, at a temperature of 50° C., and then, 30 g of lime-processed gelatin was added. Thereafter, distilled water was added thereto to bring the total weight to 750 g, and they were mixed at 2,000 rpm for 10 minutes.

Further, a magenta filter (MF) dye dispersion and an antihalation (AH) dye dispersion were prepared in the same manner, except that leuco dye (L2) or (L3) was used in place of leuco dye (L1).

The structures of color developer (SD-1), leuco dye (L1), leuco dye (L2) and leuco dye (L3) will be illustrated below.

Leuco dye (L1)

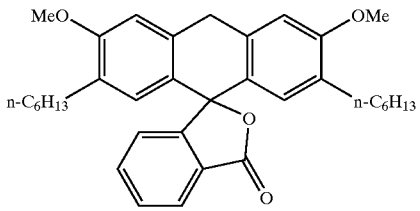

Color developer (SD-1)

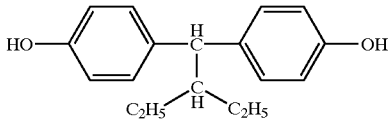

-continued

Leuco dye (L2)

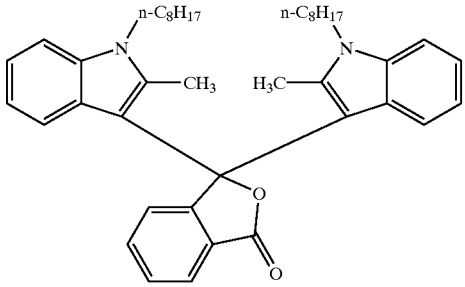

Leuco dye (L3)

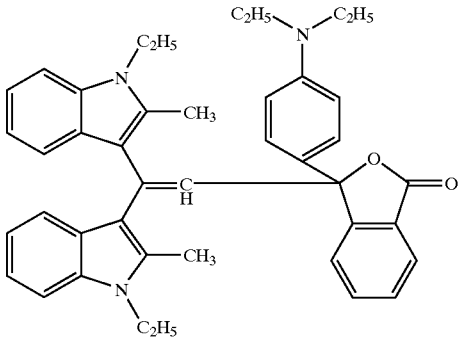

By using these emulsions, Samples 101 and 102 of multilayer color heat-developable light-sensitive materials, as shown in Table 1, were prepared. The structures of the additives shown in Table 1 will be illustrated below.

(The Unit is Parts by Mass)

TABLE 1

| | Light sensitive material Sample 101 | |
|---|---|---|
| Protective layer | Lime processed gelatin | 914 |
| | Matt agent (silica) | 50 |
| | Surfactant (a) | 30 |
| | Surfactant (b) | 40 |
| | Water soluble polymer (c) | 15 |
| | Hardener (t) | 110 |
| Intermediate layer | Lime processed gelatin | 461 |
| | Surfactant (b) | 5 |
| | Salicylanilide | 200 |
| | Formalin scavenger (d) | 150 |
| | Water soluble polymer (c) | 15 |
| Yellow color forming layer (High-sensitivity layer) | Lime processed gelatin | 1750 |
| | Emulsion (in terms of coating amount of silver) | A-1b 550 |
| | Silver benzotriazole (in terms of coating amount of silver) | 165 |
| | Silver 1-phenyl-5-mercaptotetrazole | 437 |
| | Yellow coupler (CPY-1) | 179 |
| | DEVP-1X | 230 |
| | Development accelerator (X) | 17.9 |
| | High-boiling organic solvent (e) | 90 |
| | High-boiling organic solvent (f) | 115 |
| | Surfactant (g) | 27 |
| | Salicylanilide | 200 |
| | Water soluble polymer (c) | 1 |
| Yellow color forming layer (Medium-sensitivity layer) | Lime processed gelatin | 1470 |
| | Emulsion (in terms of coating amount of silver) | A-2b 263 |
| | Silver benzotriazole (in terms of coating amount of silver) | 79 |
| | Silver 1-phenyl-5-mercaptotetrazole | 209 |
| | Yellow coupler (CPY-2) | 269 |
| | DEVP-1X | 380 |

TABLE 1-continued

| | | |
|---|---|---|
| | Development accelerator (X) | 26.9 |
| | High-boiling organic solvent (e) | 134 |
| | High-boiling organic solvent (f) | 190 |
| | Surfactant (g) | 26 |
| | Salicylanilide | 300 |
| | Water soluble polymer (c) | 2 |
| Yellow color forming layer (Low sensitivity layer) | Lime processed gelatin | 1680 |
| | Emulsion (in terms of coating amount of silver) | A-3b 240 |
| | Silver benzotriazole (in terms of coating amount of silver) | 72 |
| | Silver 1-phenyl-5-mercaptotetrazole | 191 |
| | Yellow coupler (CPY-2) | 448 |
| | DEVP-1X | 590 |
| | Development accelerator (X) | 44.8 |
| | High-boiling organic solvent (e) | 224 |
| | High-boiling organic solvent (f) | 295 |
| | Surfactant (g) | 30 |
| | Salicylanilide | 600 |
| | Water soluble polymer (c) | 3 |
| Intermediate layer (Yellow filter layer) | Lime processed gelatin | 560 |
| | Surfactant (b) | 15 |
| | Surfactant (g) | 60 |
| | Stearyl alcohol | 1200 |
| | Leuco dye (L1) | 300 |
| | Color developer (SD-1) | 300 |
| | Water soluble polymer (c) | 15 |
| Magenta color-forming layer (High-sensitivity layer) | Lime processed gelatin | 781 |
| | Emulsion (in terms of coating amount of silver) | A-1g 488 |
| | Silver benzotriazole (in terms of coating amount of silver) | 146 |
| | Silver 1-phenyl-5-mercaptotetrazole | 388 |
| | Magenta coupler (CPM-1) | 47 |
| | Magenta coupler (CPM-2) | 24 |
| | DEVP-1X | 74 |
| | Development accelerator (X) | 4.7 |
| | High-boiling organic solvent (e) | 75 |
| | Surfactant (g) | 8 |
| | Salicylanilide | 100 |
| | Water soluble polymer (c) | 8 |
| Magenta color-forming layer (Medium-sensitivity layer) | Lime processed gelatin | 659 |
| | Emulsion (in terms of coating amount of silver) | A-2g 492 |
| | Silver benzotriazole (in terms of coating amount of silver) | 148 |
| | Silver 1-phenyl-5-mercaptotetrazole | 391 |
| | Magenta coupler (CPM-3) | 94 |
| | Magenta coupler (CPM-2) | 48 |
| | DEVP-1X | 140 |
| | Development accelerator (X) | 14.1 |
| | High-boiling organic solvent (e) | 150 |
| | Surfactant (g) | 11 |
| | Salicylanilide | 80 |
| | Water soluble polymer (c) | 14 |
| Magenta color-forming layer (Low sensitivity layer) | Lime processed gelatin | 711 |
| | Emulsion (in terms of coating amount of silver) | A-3g 240 |
| | Silver benzotriazole (in terms of coating amount of silver) | 72 |
| | Silver 1-phenyl-5-mercaptotetrazole | 191 |
| | Magenta coupler (CPM-3) | 234 |
| | Magenta coupler (CPM-2) | 119 |
| | DEVP-1X | 349 |
| | Development accelerator (X) | 35.3 |
| | High-boiling organic solvent (e) | 376 |
| | Surfactant (g) | 29 |
| | Salicylanilide | 80 |
| | Water soluble polymer (c) | 14 |
| Intermediate layer (Magenta filter layer) | Lime processed gelatin | 850 |
| | Surfactant (g) | 15 |
| | Surfactant (h) | 24 |
| | Stearyl alcohol | 300 |
| | Leuco dye (L2) | 75 |
| | Color developer (SD-1) | 75 |
| | Formalin scavenger (d) | 300 |
| | Water soluble polymer (c) | 15 |
| Cyan color forming layer (High-sensitivity layer) | Lime processed gelatin | 842 |
| | Emulsion (in terms of coating amount of silver) | A-1r 550 |
| | Silver benzotriazole (in terms of coating amount of silver) | 165 |
| | Silver 1-phenyl-5-mercaptotetrazole | 437 |
| | Cyan coupler (CPC-1) | 19 |
| | Cyan coupler (CPC-2) | 44 |
| | DEVP-1X | 91 |
| | Development accelerator (X) | 6.2 |
| | High-boiling organic solvent (e) | 70 |
| | Surfactant (g) | 5 |
| | Salicylanilide | 80 |
| | Water soluble polymer (c) | 18 |
| Cyan color forming layer (Medium-sensitivity layer) | Lime processed gelatin | 475 |
| | Emulsion (in terms of coating amount of silver) | A-2r 600 |
| | Silver benzotriazole (in terms of coating amount of silver) | 180 |
| | Silver 1-phenyl-5-mercaptotetrazole | 477 |
| | Cyan coupler (CPC-3) | 56 |
| | Cyan coupler (CPC-4) | 131 |
| | DEVP-1X | 209 |
| | Development accelerator (X) | 18.7 |
| | High-boiling organic solvent (e) | 209 |
| | Surfactant (g) | 10 |
| | Salicylanilide | 50 |
| | Water soluble polymer (c) | 15 |
| Cyan color forming layer (Low sensitivity layer) | Lime processed gelatin | 825 |
| | Emulsion (in terms of coating amount of silver) | A-3r 300 |
| | Silver benzotriazole (in terms of coating amount of silver) | 90 |
| | Silver 1-phenyl-5-mercaptotetrazole | 239 |
| | Cyan coupler (CPC-3) | 99 |
| | Cyan coupler (CPC-4) | 234 |
| | DEVP-1X | 373 |
| | Development accelerator (X) | 33.2 |
| | High-boiling organic solvent (e) | 372 |
| | Surfactant (g) | 17 |
| | Salicylanilide | 100 |
| | Water soluble polymer (c) | 10 |
| Anti-halation layer | Lime processed gelatin | 440 |
| | Surfactant (g) | 35 |
| | Base precursor compound BP-35 | 207 |
| | Cyanine dye compound (Dye-1) | 260 |
| | Surfactant (b) | 120 |
| | Water soluble polymer (c) | 15 |

Light sensitive material Sample 102

| | | |
|---|---|---|
| Protective layer | Lime processed gelatin | 914 |
| | Matt agent (silica) | 50 |
| | Surfactant (a) | 30 |
| | Surfactant (b) | 40 |
| | Water soluble polymer (c) | 15 |
| | Hardener (t) | 110 |
| Intermediate layer | Lime processed gelatin | 461 |
| | Surfactant (b) | 5 |
| | Salicylanilide | 200 |
| | Formalin scavenger (d) | 150 |
| | Water soluble polymer (c) | 15 |
| Yellow color forming layer (High-sensitivity layer) | Lime processed gelatin | 1750 |
| | Emulsion (in terms of coating amount of silver) | A-1b 550 |
| | Silver benzotriazole (in terms of coating amount of silver) | 165 |
| | 1-Dodecyl-5-mercaptotetrazole | 12 |
| | Yellow coupler (CPY-1) | 179 |
| | DEVP-1X | 230 |
| | Development accelerator (X) | 17.9 |
| | High-boiling organic solvent (e) | 90 |
| | High-boiling organic solvent (f) | 115 |
| | Surfactant (g) | 27 |
| | Salicylanilide | 200 |
| | Water soluble polymer (c) | 1 |
| Yellow color forming layer (Medium-sensitivity layer) | Lime processed gelatin | 1470 |
| | Emulsion (in terms of coating amount of silver) | A-2b 263 |
| | Silver benzotriazole (in terms of | 79 |

TABLE 1-continued

| | | |
|---|---|---|
| | coating amount of silver) | |
| | 1-Dodecyl-5-mercaptotetrazole | 6 |
| | Yellow coupler (CPY-2) | 269 |
| | DEVP-1X | 380 |
| | Development accelerator (X) | 26.9 |
| | High-boiling organic solvent (e) | 134 |
| | High-boiling organic solvent (f) | 190 |
| | Surfactant (g) | 26 |
| | Salicylanilide | 300 |
| | Water soluble polymer (c) | 2 |
| Yellow color forming layer (Low sensitivity layer) | Lime processed gelatin | 1680 |
| | Emulsion (in terms of coating amount of silver) | A-3b 240 |
| | Silver benzotriazole (in terms of coating amount of silver) | 72 |
| | 1-Dodecyl-5-mercaptotetrazole | 5 |
| | Yellow coupler (CPY-2) | 448 |
| | DEVP-1X | 590 |
| | Development accelerator (X) | 44.8 |
| | High-boiling organic solvent (e) | 224 |
| | High-boiling organic solvent (f) | 295 |
| | Surfactant (g) | 30 |
| | Salicylanilide | 600 |
| | Water soluble polymer (c) | 3 |
| Intermediate layer (Yellow filter layer) | Lime processed gelatin | 560 |
| | Surfactant (b) | 15 |
| | Surfactant (g) | 60 |
| | Stearyl alcohol | 1200 |
| | Leuco dye (L1) | 300 |
| | Color developer (SD-1) | 300 |
| | Water soluble polymer (c) | 15 |
| Magenta color-forming layer (High-sensitivity layer) | Lime processed gelatin | 781 |
| | Emulsion (in terms of coating amount of silver) | A-1g 488 |
| | Silver benzotriazole (in terms of coating amount of silver) | 146 |
| | 1-Dodecyl-5-mercaptotetrazole | 11 |
| | Magenta coupler (CPM-1) | 47 |
| | Magenta coupler (CPM-2) | 24 |
| | DEVP-1X | 74 |
| | Development accelerator (X) | 4.7 |
| | High-boiling organic solvent (e) | 75 |
| | Surfactant (g) | 8 |
| | Salicylanilide | 100 |
| | Water soluble polymer (c) | 8 |
| Magenta color-forming layer (Medium-sensitivity layer) | Lime processed gelatin | 659 |
| | Emulsion (in terms of coating amount of silver) | A-2g 492 |
| | Silver benzotriazole (in terms of coating amount of silver) | 148 |
| | 1-Dodecyl-5-mercaptotetrazole | 11 |
| | Magenta coupler (CPM-3) | 94 |
| | Magenta coupler (CPM-2) | 48 |
| | DEVP-1X | 140 |
| | Development accelerator (X) | 14.1 |
| | High-boiling organic solvent (e) | 150 |
| | Surfactant (g) | 11 |
| | Salicylanilide | 80 |
| | Water soluble polymer (c) | 14 |
| Magenta color-forming layer (Low sensitivity layer) | Lime processed gelatin | 711 |
| | Emulsion (in terms of coating amount of silver) | A-3g 240 |
| | Silver benzotriazole (in terms of coating amount of silver) | 72 |
| | 1-Dodecyl-5-mercaptotetrazole | 5 |
| | Magenta coupler (CPM-3) | 234 |
| | Magenta coupler (CPM-2) | 119 |
| | DEVP-1X | 349 |
| | Development accelerator (X) | 35.3 |
| | High-boiling organic solvent (e) | 376 |
| | Surfactant (g) | 29 |
| | Salicylanilide | 80 |
| | Water soluble polymer (c) | 14 |
| Intermediate layer (Magenta filter layer) | Lime processed gelatin | 850 |
| | Surfactant (g) | 15 |
| | Surfactant (h) | 24 |
| | Stearyl alcohol | 300 |
| | Leuco dye (L2) | 75 |
| | Color developer (SD-1) | 75 |

TABLE 1-continued

| | | |
|---|---|---|
| | Formalin scavenger (d) | 300 |
| | Water soluble polymer (c) | 15 |
| Cyan color forming layer (High-sensitivity layer) | Lime processed gelatin | 842 |
| | Emulsion (in terms of coating amount of silver) | A-1r 550 |
| | Silver benzotriazole (in terms of coating amount of silver) | 165 |
| | 1-Dodecyl-5-mercaptotetrazole | 12 |
| | Cyan coupler (CPC-1) | 19 |
| | Cyan coupler (CPC-2) | 44 |
| | DEVP-1X | 91 |
| | Development accelerator (X) | 6.2 |
| | High-boiling organic solvent (e) | 70 |
| | Surfactant (g) | 5 |
| | Salicylanilide | 80 |
| | Water soluble polymer (c) | 18 |
| Cyan color forming layer (Medium-sensitivity layer) | Lime processed gelatin | 475 |
| | Emulsion (in terms of coating amount of silver) | A-2r 600 |
| | Silver benzotriazole (in terms of coating amount of silver) | 180 |
| | 1-Dodecyl-5-mercaptotetrazole | 13 |
| | Cyan coupler (CPC-3) | 56 |
| | Cyan coupler (CPC-4) | 131 |
| | DEVP-1X | 209 |
| | Development accelerator (X) | 18.7 |
| | High-boiling organic solvent (e) | 209 |
| | Surfactant (g) | 10 |
| | Salicylanilide | 50 |
| | Water soluble polymer (c) | 15 |
| Cyan color forming layer (Low sensitivity layer) | Lime processed gelatin | 825 |
| | Emulsion (in terms of coating amount of silver) | A-3r 300 |
| | Silver benzotriazole (in terms of coating amount of silver) | 90 |
| | 1-Dodecyl-5-mercaptotetrazole | 7 |
| | Cyan coupler (CPC-3) | 99 |
| | Cyan coupler (CPC-4) | 234 |
| | DEVP-1X | 373 |
| | Development accelerator (X) | 33.2 |
| | High-boiling organic solvent (e) | 372 |
| | Surfactant (g) | 17 |
| | Salicylanilide | 100 |
| | Water soluble polymer (c) | 10 |
| Anti-halation layer | Lime processed gelatin | 440 |
| | Surfactant (g) | 14 |
| | Stearyl alcohol | 2400 |
| | Leuco dye (L3) | 600 |
| | Color developer (SD-1) | 600 |
| | Surfactant (b) | 120 |
| | Water soluble polymer (c) | 15 |
| Transparent PEN Base (96 μm) | | |

Surfactant (a)

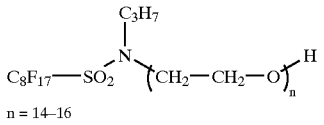

Surfactant (b)

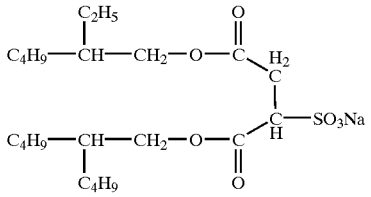

Water-soluble Polymer (c)

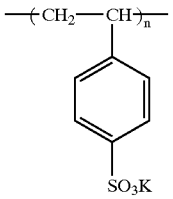

Hardener (t)

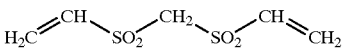

Formalin Scavenger (d)

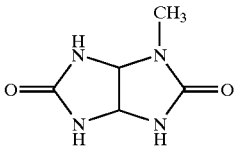

Surfactant (g)

AlkanolXC

Photosensitive material samples 103 to 109 were prepared in the same manner as the photosensitive material sample 101, except that the DEVP-1X of sample 101 was replaced by the DEVP-2X, DEVP-3X and the developing agents according to the present invention as shown in Table 2 below, with an amount twice the molar amount of DEVP-1X, respectively.

Photosensitive material samples 110 to 114 were prepared in the same manner as the photosensitive material sample 102, except that the DEVP-1X of sample 102 was replaced by the color-developing agents according to the present invention and DEVP-4X, with an amount twice the molar amount of DEVP-1X, respectively.

Test pieces were cut out from the light-sensitive material samples 101 to 114. After that, the test pieces were exposed to light of 500 lux from a while light source, for 1/100 second, through a continuous optical wedge, in accordance with a method for determining ISO sensitivity (ANSI PH2.27). After the exposure, the test pieces were subjected to heat development processing at 150° C. for 20 seconds, using a heating drum. Measurement of density was performed, and then color formation efficiency was evaluated from the color formation density of a maximum exposed area, discrimination was evaluated from the difference in density between an unexposed area and the maximum exposed area, and 5-rank evaluation was performed for each color of yellow, magenta and cyan. The results obtained are shown in Table 2. Furthermore, after storing each sample in an atmosphere of 50° C. and 50% RH for 1 week, similarly exposure to light and heat development were performed and discrimination was evaluated. The results odtained are also shown in Table 2. Greater evaluation values indicate better performances.

TABLE 2

| Sample No. | Developing agent | Color formation efficiency | Discrimination Before storage | Discrimination After *) storage | Remarks |
|---|---|---|---|---|---|
| 101 | DEVP-1X | 3 | 4 | 3 | Comparative example |
| 102 | DEVP-1X | 3 | 4 | 3 | Comparative example |
| 103 | DEVP-4 | 5 | 5 | 4 | This invention |
| 104 | DEVP-5 | 5 | 5 | 5 | This invention |
| 105 | DEVP-10 | 5 | 4 | 4 | This invention |
| 106 | DEVP-45 | 5 | 4 | 4 | This invention |
| 107 | DEVP-2X | 2 | 2 | 2 | Comparative example |
| 108 | DEVP-3X | 4 | 3 | 2 | Comparative example |
| 109 | DEVP-39 | 4 | 4 | 3 | This invention |
| 110 | DEVP-4 | 5 | 5 | 4 | This invention |
| 111 | DEVP-5 | 5 | 5 | 5 | This invention |
| 112 | DEVP-22 | 4 | 5 | 5 | This invention |
| 113 | DEVP-26 | 5 | 5 | 4 | This invention |
| 114 | DEVP-4X | 3 | 3 | 2 | Comparative example |

*)After storage in a week at 50° C. with 50% RH.

It revealed that samples using the incorporated developing agent for use in the present invention (Samples 103 to 106 and 109 to 113) not only were excellent in color formation efficiency and discrimination but exhibited excellent performance of showing substantially no change in discrimination after storage at 50° C. and 50% RH for 1 week.

The ClogP values of the compounds released from the incorporated developing agents used in the examples of the present invention (corresponding to the compound of the formula (1) in which $R_5$—$SO_2$—NH—CO— is replaced by a hydrogen atom) are shown below.

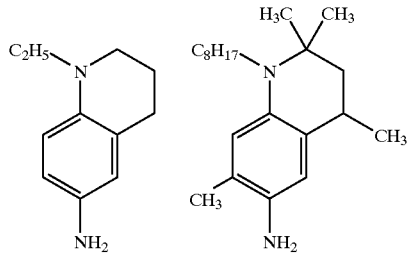

2.13 6.18

-continued

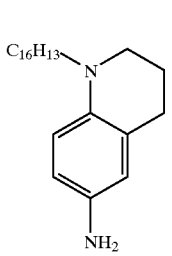

3.96

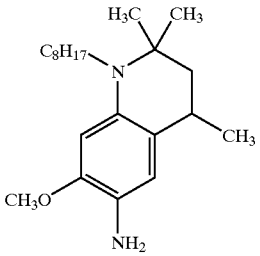

5.56

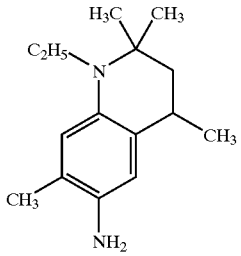

3.60

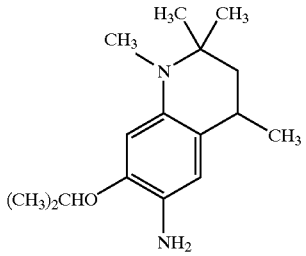

3.31

The light-sensitive material samples 101 and 114 were each cut into a 135-negative film size and punched. The thus-made films were then loaded into a camera, respectively, and a photograph of a person and a Macbeth chart was taken. The films were subjected to heat development in the same manner as above, and the resultant image on the light-sensitive material after the processing was read out by a digital image readout apparatus, Frontier SP-1000 (trade name, manufactured by Fuji Photo Film Co., Ltd.). After being subjected to image processing on a workstation, the image was outputted by a heat development printer (PICTROGRAPHY 3000, trade name, manufactured by Fuji Photo Film Co., Ltd.).

Images on the samples 101 and 103 to 109 were read out at room temperature, and images on the samples 102 and 110 to 114 were read out with keeping a film surface temperature of 60 to 70° C., wherein the temperature was attained by sending warm wind onto the surface of the photosensitive material with a drier at the time of the reading-out. A Macbeth chart in the images was used to conduct color correcting process for raising chroma (color saturation) while keeping color reproducibility, by digital signal processing. As a result, in the case in which the color-developing agents of the present invention (photosensitive materials 103 to 106 and 109 to 113) were used, prints were superior in developed color density, sensitivity and discrimination and high in chroma.

Example 2

Silver halide emulsions composed of tabular grains having a high silver chloride content were prepared, in accordance with the methods described in the examples of U.S. Pat. No. 5,840,475.

Silver Iodochloride (100) Tabular Grain Emulsion 1.48 g of sodium chloride, 0.28 g of potassium iodide, 38.8 g of lime-treated gelatin that had been subjected to oxidizing treatment, and distilled water in an amount to make 4.5 L were placed in a reaction vessel, and the temperature of the resultant solution was kept at 35° C. To this solution, which was vigorously stirred, were added a 4M silver nitrate aqueous solution (hereinafter referred to as Solution 1) containing 0.32 g/L of mercuric chloride, and a 4M sodium chloride aqueous solution, over a period of time of 30 seconds, at an adding rate of 21 mL/minute for each solution. In this way, nuclei were formed.

Immediately after the completion of the addition, 9.1 L of a solution containing 0.39 g/L of sodium chloride and 0.12 g/L of potassium iodide was added and the reaction solution was kept for 8 minutes. Then, the above Solution 1 was added according to the conditions listed below, so as to form silver halide grains. During the addition, a 4M sodium chloride aqueous solution was added at the same time in a controlled manner, such that the pCl of the reaction solution became 2.2.

| Grain growth | Initial flow rate | Final flow rate | Adding time |
|---|---|---|---|
| I | 14 mL/min | 14 mL/min | 5 min |
| II | 14 mL/min | 42 mL/min | 52 min |

Upon completion of the above-described grain growth stage II, a 4M sodium chloride aqueous solution was added at an adding rate of 14 mL/minute over a period of 5 minutes, and the reaction solution was kept for 30 minutes. After that, Solution 1 was added at an adding rate of 14 mL/minute over a period of 5 minutes. Subsequently, 70 mL of an aqueous solution containing 5.25 g of potassium iodide was added. Then, after the reaction solution was kept for 20 minutes, the Solution 1 was added at an adding rate of 14 mL/minute over a period of 8 minutes, while a 4M sodium chloride aqueous solution was added at the same time in a controlled manner such that the pCl of the system became 2.2. In this case, the sodium chloride aqueous solution was incorporated with potassium hexacyanoruthenate such that the concentration thereof was $3\times10^{-5}$ mol/mol of total silver halides. After completion of the grain formation, precipitation, water-washing, and desalting were performed by a usual manner.

The emulsion thus obtained was composed of tabular grains whose average equivalent-circle diameter (average of the diameter of the circle having an area equivalent to the projected area of an individual grain) was 0.56 $\mu$m and average grain thickness was 0.09 $\mu$m, in which the tabular grains having (100) plane as a main face accounted for 70% or more of the entire projected area of all the silver halide grains. This emulsion was designated as Emulsion u.

Then, Emulsion m, which was composed of tabular grains whose average equivalent-circle diameter was 1.60 $\mu$m and average grain thickness was 0.114 $\mu$m, wherein the tabular grains having (100) plane as a main face accounted for 70% or more of the entire projected area of all silver halide grains, was prepared, by adjusting the temperature and time period for grain growth.

Further, Emulsion o, which was composed of tabular grains whose average equivalent-circle diameter was 2.90 $\mu$m and average grain thickness was 0.121 $\mu$m, wherein the tabular grains having (100) plane as a main face accounted for 70% or more of the entire projected area of all silver halide grains, was prepared, by adjusting the temperature and time period for grain growth.

These emulsions were subjected to chemical sensitization and spectral sensitization in the same manner as in Example 1, and blue-sensitive emulsions, green-sensitive emulsions, and red-sensitive emulsions were prepared, respectively. In this way, blue-sensitive emulsions o-b, m-b, and u-b, green-sensitive emulsions o-g, m-g, and u-g, and red-sensitive emulsions o-r, m-r, and u-r, were obtained.

A light-sensitive materials 201 to 214 were prepared in the same manner as in Example 1, except that the emulsions A-1b, A-2b, A-3b, A-lg, A-2g, A-3g, A-1r, A-2r, and A-3r of the light-sensitive material samples 101 to 114 were replaced, respectively, with the blue-sensitive emulsions o-b, m-b, and u-b, the green-sensitive emulsions o-g, m-g, and u-g, and the red-sensitive emulsions o-r, m-r, and u-r.

These light-sensitive materials, samples 201 and 214, were exposed to light and subjected to heat development in the same manner as in Example 1. In the case in which the color-developing agents of the present invention (light-sensitive material samples 203 to 206 and 209 to 213) were used, prints slight in color muddiness and high in chroma were obtained.

Example 3

Silver Iodochloride (111) Tabular Grain Emulsion 9.3 g of sodium chloride, 2.84 g of 7-azaindole, 80 g of lime-treated bone gelatin, and distilled water in an amount to make 3.9 L were placed in a reaction vessel, and the temperature of the resultant solution was kept at 50° C. After adjusting the pH of the solution to 5.5, to this solution, which was vigorously stirred, was added a 2M silver nitrate aqueous solution over a period of 36 seconds at an adding rate of 8 mL/minute. In this way, nuclei were formed.

Immediately after the completion of the addition, a silver nitrate aqueous solution was added according to the conditions listed below so as to form silver halide grains. During the addition, a 4M sodium chloride aqueous solution was added at the same time in a controlled manner such that the pCl of the reaction solution became 1.5.

| Grain growth | $AgNO_3$ solution | Initial flow rate | Final flow rate | Adding time |
|---|---|---|---|---|
| I | 2M | 8 mL/min | 16 mL/min | 2.8 min |
| II | 4M | 8 mL/min | 30 mL/min | 15 min |
| III | 4M | 30 mL/min | 30 mL/min | 14 min |

One minute after the completion of the above-described grain growth stage, a 4M silver nitrate aqueous solution was added at an adding rate of 23 mL/minute over a period of 2.4 minutes. A 3.6M sodium chloride/0.4M potassium iodide aqueous solution was added at the same time in a controlled manner such that the pCl of the system became 1.5. In this case, the sodium chloride/potassium iodide aqueous solution was incorporated with potassium hexacyanoruthenate such that the concentration thereof was $3\times10^{-5}$ mol/mol of total silver halides. After completion of the grain formation, precipitation, water-washing, and desalting were performed by a usual manner.

The emulsion thus obtained was composed of tabular grains whose average equivalent-circle diameter was 0.86 μm and average grain thickness was 0.10 μm, wherein the tabular grains having (111) plane as a main face accounted for 70% or more of the entire projected area of all silver halide grains. This emulsion was designated as Emulsion u'.

Then, Emulsion m', which was composed of tabular grains whose average equivalent-circle diameter was 1.58 μm and average grain thickness was 0.119 μm, wherein the tabular grains having (111) plane as a main face accounted for 70% or more of the entire projected area of all silver halide grains, was prepared by adjusting the temperature and time period for grain growth.

Further, Emulsion o', which was composed of tabular grains whose average equivalent-circle diameter was 2.85 μm and average grain thickness was 0.131 μm, wherein the tabular grains having (111) plane as a main face accounted for 70% or more of the entire projected area of all silver halide grains, was prepared by adjusting the temperature and time period for grain growth.

These emulsions were subjected to chemical sensitization and spectral sensitization in the same manner as in Example 1, and blue-sensitive emulsions, green-sensitive emulsions, and red-sensitive emulsions were prepared, respectively. In this way, blue-sensitive emulsions o'-b, m'-b, and u'-b, green-sensitive emulsions o'-g, m'-g, and u'-g, and red-sensitive emulsions o'-r, m'-r, and u'-r, were obtained.

A light-sensitive material, Samples 301 to 314, were prepared in the same manner as in Example 1, except that the emulsions A-1b, A-2b, A-3b, A-1g, A-2g, A-3g, A-1r, A-2r, and A-3r of the light-sensitive material samples 101 to 114 were replaced, respectively, with the blue-sensitive emulsions o'-b, m'-b, and u'-b, the green-sensitive emulsions o'-g, m'-g, and u'-g, and the red-sensitive emulsions o'-r, m'-r, and u'-r.

These light-sensitive materials, samples 301 and 314, were exposed to light and subjected to heat development in the same manner as in Example 1. In the case in which the color-developing agents of the present invention (light-sensitive material samples 303 to 306 and 309 to 313) were used, prints slight in color muddiness and high in chroma were obtained.

Example 4

A light-sensitive material sample 103 produced in the same manner as in Example 1 was used to take a photograph, and was then heat-developed in the same manner as in Example 1. Thereafter, a Scanner LS-4000 (trade name, manufactured by NIKON CORPORATION) was used to read out BGR data and IR data. In a work station, the data were subjected to image processing, and subsequently images were outputted from a heat-developing printer (PICTROGRAPHY 3000, made by Fuji Photo Film Co., Ltd.).

A print 103a obtained by subjecting only the BGR data to the image processing was compared with a print 103b obtained by subjecting the BRG data and the IR data to the image processing. As a result, the image on the print 103b was fewer in image defects such as blemish, less in color muddiness, higher in chroma, and less in graininess deterioration caused following the color-correction operation, than the image on the print 103a.

Example 5

(Preparation of an Emulsified Dispersion Containing a Coupler Developing a Color in a Non-visible Wavelength Range)

There were mixed 5.91 g of the coupler ((1)-37), 3.04 g of the coupler ((5)-4), 0.90 g of the development accelerator (X), and 4.54 g of the high-boiling organic solvent (e), and 50.0 mL of ethyl acetate at 60° C. The resultant solution was incorporated into 200 g of an aqueous solution containing 18.0 g of limed-treated gelatin and 0.8 g of sodium dodecylbenzenesulfonate dissolved therein, and the resultant mixture was emulsified and dispersed at 10,000 rpm for 20 minutes using a dissolver stirrer. Thereafter, distilled water was added to bring the total weight to 300 g, and they were mixed at 2,000 rpm for 10 minutes.

An emulsion was produced in the same way, except that the coupler ((1)-37) and the coupler ((5)-4) were changed to 5.91 g of the coupler ((1)-1) and 3.04 g of the coupler ((3)-1), respectively.

Light-sensitive material samples 401, 402 and 403 were produced in the same way, except that the emulsion of the coupler CPY-1 and the emulsion of the coupler CPY-2 in the light-sensitive material samples 103, 203 and 303 were replaced by an equimolecular amount of an emulsion of the coupler ((1)-37) and the coupler ((5)-4) and an equimolecular amount of an emulsion of the coupler ((1)-1) and the coupler ((3)-1), respectively.

These light-sensitive materials samples 401 to 403, and the light-sensitive material sample 103 produced in Example 1 were exposed to light and heat-developed in the same manner as in Example 1.

B, G and R image data on the processed light-sensitive material 103 were read out by a digital image reading device Frontier SP-1000 (trade name). Furthermore, a filter through which blue light transmits, among color filters set up to a light source of the Frontier SP-1000, was changed to an IR filter having a transmittance property of a rectangular wave having a central wavelength of 800 nm and a wavelength range of ±50 nm, so as to read out G, R, and IR data on the light-sensitive material samples 401 to 403. At this time, a thermal ray absorbing filter set up between a light source of the reading optical system and a CCD was changed to a filter for absorbing wavelengths of 900 nm or more. G, R and IR image data on the processed light-sensitive material samples 401 to 403 were used to perform image processing in a work station, and subsequently images were outputted from a heat-developing printer (PICTROGRAPHY 3000 (trade name), made by Fuji Photo Film Co., Ltd.). As a result, in the same manner as in the case in which the BGR image data on the light-sensitive material sample 103 were used, prints less in color muddiness and high in chroma was obtained.

Furthermore, the blue LED in the Scanner LS-4000 (trade name, made by NIKON CORPORATION) was changed to an LED (made by NICHIA CORPORATION) having a maximum wavelength of 780 nm to read out G, R, IR1 (780 nm) data, and IR2 (about 900 nm) formed on the processed light-sensitive material samples 401 to 403. The read data were subjected to image processing in a work station, and subsequently images were outputted from a heat-developing printer (PICTROGRAPHY 3000 (trade name), made by Fuji Photo Film Co., Ltd.). As a result, prints fewer in blemish, less in color muddiness and high in chroma were obtained.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material, containing a color-developing agent represented by formula (1):

formula (1)

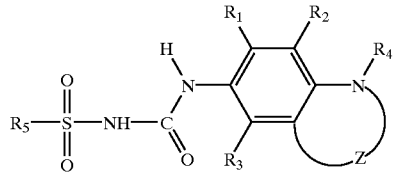

wherein $R_1$, $R_2$, and $R_3$ each independently represent a hydrogen atom or a substituent; $R_4$ represents an alkyl group, an aryl group, or a heterocyclic group; $R_1$ and $R_2$, or/and $R_2$ and $R_4$ may combine with each other to form a 5-membered, 6-membered or 7-membered ring; Z represents a group of non-metallic atoms that form a 5-membered, 6-membered or 7-membered ring together with the nitrogen atom and two carbon atoms in the benzene ring; $R_5$ represents an alkyl group, an aryl group or a heterocyclic group, in which the compound represented by formula (1) contains none of a hydroxyl group, a carboxyl group and a sulfo group in each of $R_1$, $R_2$, $R_3$ and $R_4$.

2. The silver halide color photographic light-sensitive material according to claim 1, wherein, in formula (1), $R_1$, $R_2$ and $R_3$ each independently represent a hydrogen atom, a halogen atom, an alkyl group, an alkenyl group, an alkynyl group, an aryl group, a heterocyclic group, a cyano group, a nitro group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoyl amino group, an alkyl- or aryl-sulfonylamino group, a mercapto group, an alkylthio group, an arylthio group, a heterocyclic thio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

3. The silver halide color photographic light-sensitive material according to claim 1, wherein, in formula (1), at least one of $R_1$ and $R_3$ represents a hydrogen atom.

4. The silver halide color photographic light-sensitive material according to claim 1, wherein, in formula (1), $R_2$ represents an alkyl group or an alkoxy group.

5. The silver halide color photographic light-sensitive material according to claim 1, wherein, in formula (1), $R_4$ represents an alkyl group.

6. The silver halide color photographic light-sensitive material according to claim 1, wherein $R_5$ in the compound represented by formula (1) is represented by formula (2):

Formula (2)

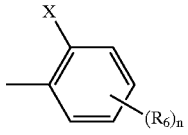

wherein X represents a halogen atom, or a substituent which is bonded to the benzene ring through a hetero atom; $R_6$ represents a substituent; and n is an integer of 0 (zero) to 4.

7. The silver halide color photographic light-sensitive material according to claim 1, which is a heat-developable light-sensitive material.

8. The silver halide color photographic light-sensitive material according to claim 7, which has, on a support, the color-developing agent, a image dye-forming coupler, an organosilver salt as a reducible silver salt, and a binder.

9. The silver halide color photographic light-sensitive material according to claim 1, which has, on a support, an image-forming layer containing the color-developing agent and the image dye-forming coupler.

10. The silver halide color photographic light-sensitive material according to claim 9, wherein a light-sensitive silver halide is contained in the image-forming layer.

11. The silver halide color photographic light-sensitive material according to claim 7, which comprises the color-developing agent and a thermal solvent, as a fine crystalline particle dispersion.

12. The silver halide color photographic light-sensitive material according to claim 11, wherein a number-average particle size of the fine crystalline particle dispersion is from 0.001 to 5 $\mu$m.

13. The silver halide color photographic light-sensitive material according to claim 1, wherein a compound obtained by replacing $R_5$—$SO_2$—NH—CO— in the compound represented by formula (1) by a hydrogen atom has a ClogP value of 3.0 or more.

14. The silver halide color photographic light-sensitive material according to claim 9, wherein an amount to be added of the color-developing agent is 0.01 to 100 molar times an amount of a coupler compound to be added.

15. The silver halide color photographic light-sensitive material according to claim 9, wherein the image dye-forming coupler is a compound which can form a dye having a maximum absorption wavelength in a non-visible absorption wavelength range.

* * * * *